US011815083B2

(12) United States Patent
Mu et al.

(10) Patent No.: US 11,815,083 B2
(45) Date of Patent: Nov. 14, 2023

(54) FRACTURING OPERATIONS PUMP FLEET BALANCE CONTROLLER

(71) Applicant: Schlumberger Technology Corporation, Sugar Land, TX (US)

(72) Inventors: Nan Mu, Sugar Land, TX (US); Yan P. Kuhn De Chizelle, Sugar Land, TX (US); Florence Binet, Sugar Land, TX (US); Manbro Lee, Beijing (CN); Alexander Tanner Taylor, Missouri City, TX (US); Bryan Suharik, Denton, TX (US); Clare Schoene, Sugar Land, TX (US); James Matthews, Sugar Land, TX (US); Bao Mi, Sugar Land, TX (US); Muktabh Anchlia, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 156 days.

(21) Appl. No.: 17/291,421

(22) PCT Filed: Nov. 5, 2019

(86) PCT No.: PCT/US2019/059840
§ 371 (c)(1),
(2) Date: May 5, 2021

(87) PCT Pub. No.: WO2020/097060
PCT Pub. Date: May 14, 2020

(65) Prior Publication Data

US 2022/0003229 A1 Jan. 6, 2022

Related U.S. Application Data

(60) Provisional application No. 62/832,102, filed on Apr. 10, 2019, provisional application No. 62/755,803, filed on Nov. 5, 2018.

(51) Int. Cl.
*F04B 49/06* (2006.01)
*E21B 43/26* (2006.01)
(Continued)

(52) U.S. Cl.
CPC ..... *F04B 49/065* (2013.01); *E21B 43/2607* (2020.05); *F04B 17/05* (2013.01);
(Continued)

(58) Field of Classification Search
CPC ..... E21B 43/2607; E21B 2200/20; F04B 49/065; F04B 17/05; F04B 17/06; F04B 23/04
See application file for complete search history.

(56) References Cited

U.S. PATENT DOCUMENTS 4,901,563 A 2/1990 Pearson
9,228,425 B2 1/2016 Ganguly et al.
(Continued)

FOREIGN PATENT DOCUMENTS

WO 03071091 A1 8/2003
WO 2008124765 A1 10/2008
(Continued)

OTHER PUBLICATIONS

"Automated Fracturing Pump Control at Wellsite", Aug. 24, 2006, Published by IP.com, IP.com No. IPCOM000139439D. (Year: 2006).*
(Continued)

*Primary Examiner* — Charles G Freay
(74) *Attorney, Agent, or Firm* — Jeffrey D. Frantz

(57) ABSTRACT

A system can include one or more processors; memory; a data interface that receives data; a control interface that transmits control signals for control of pumps of a hydraulic fracturing operation; and one or more components that can include one or more of a modeling component that predicts pressure in a well fluidly coupled to at least one of the
(Continued)

pumps, a pumping rate adjustment component that generates a pumping rate control signal for transmission via the control interface, a capacity component that estimates a real-time pumping capacity for each individual pump, and a control component that, for a target pumping rate for the pumps during the hydraulic fracturing operation, generates at least one of engine throttle and transmission gear settings for each of the individual pumps using an estimated real-time pumping capacity for each individual pump where the settings are transmissible via the control interface.

25 Claims, 29 Drawing Sheets

(51) Int. Cl.
*F04B 23/04* (2006.01)
*F04B 17/06* (2006.01)
*F04B 17/05* (2006.01)

(52) U.S. Cl.
CPC ..... *F04B 17/06* (2013.01); *F04B 23/04* (2013.01); *E21B 2200/20* (2020.05)

(56) References Cited

U.S. PATENT DOCUMENTS

| | | | | |
|---|---|---|---|---|
| 9,638,194 | B2 | 5/2017 | Wiegman et al. | |
| 9,879,514 | B2 | 1/2018 | Ciezobka et al. | |
| 10,584,698 | B2 * | 3/2020 | Haddad | F04B 53/14 |
| 10,655,435 | B2 * | 5/2020 | Oehring | E21B 41/0092 |
| 10,689,972 | B1 | 6/2020 | Zhao et al. | |
| 11,408,417 | B1 * | 8/2022 | Stephenson | F04B 23/06 |
| 2004/0065477 | A1 | 4/2004 | Paulk et al. | |
| 2007/0214877 | A1 | 9/2007 | Shammai | |
| 2008/0209997 | A1 | 9/2008 | Bailey et al. | |
| 2009/0053072 | A1 | 2/2009 | Borgstadt et al. | |
| 2012/0179444 | A1 | 7/2012 | Ganguly et al. | |
| 2012/0203507 | A1 | 8/2012 | Thomeer et al. | |
| 2013/0138254 | A1 | 5/2013 | Seals et al. | |
| 2014/0291023 | A1 | 10/2014 | Edbury et al. | |
| 2016/0195082 | A1 * | 7/2016 | Wiegman | F04B 23/04 417/63 |
| 2016/0258267 | A1 | 9/2016 | Payne et al. | |
| 2017/0082101 | A1 * | 3/2017 | Urdaneta | F04B 1/00 |
| 2017/0090457 | A1 * | 3/2017 | Pandurangan | F04C 14/00 |
| 2017/0130712 | A1 | 5/2017 | Zhang et al. | |
| 2017/0292513 | A1 | 10/2017 | Haddad et al. | |
| 2020/0232454 | A1 | 7/2020 | Chretien et al. | |
| 2020/0370423 | A1 * | 11/2020 | Li | G06N 3/047 |
| 2021/0396223 | A1 * | 12/2021 | Yeung | G01L 5/0061 |
| 2022/0003229 | A1 | 1/2022 | Mu et al. | |

FOREIGN PATENT DOCUMENTS

| | | | |
|---|---|---|---|
| WO | 2016100535 | A1 | 6/2016 |
| WO | 2017106865 | A1 | 6/2017 |
| WO | 2020097053 | A1 | 5/2020 |
| WO | 2020097060 | A2 | 5/2020 |
| WO | WO 2021/178602 | A1 * | 9/2021 |

OTHER PUBLICATIONS

Office Action and Search Report issued in Russian Patent Application No. 2021116186 dated Dec. 29, 2021, 11 pages with English translation.
Office Action and Search Report issued in Russian Patent Application No. 2021116167 dated Dec. 29, 2021, 10 pages with English translation.
Gulrajani, S. N. et al., "Fracture Evaluation Using Pressure Diagnostics" in Reservoir Stimulation, 3rd Edition, Chapter 9, Editors Michael J. Economides and Kenneth Nolte, 2000, 63 pages.
International Preliminary Report on Patentability of International Patent Application No. PCT/US2019/059840 dated May 20, 2021, 6 pages.
International Preliminary Report on Patentability of of International Patent Application No. PCT/US2019/059832 dated May 20, 2021, 6 pages.
Decision to Grant in Russian Patent Application No. 2021116167 dated May 18, 2022, 21 pages with English translation.
Decision to Grant in Russian Patent Application No. 201116186 dated May 18, 2022, 21 pages with English translation.
Cipolla, C. et al., "New Algorithms and Integrated Workflow for Tight Gas and Shale Completions", SPE-146872-MS, presented at the SPE Annual Technical Conference and Exhibition, Denver, Colorado, USA, 2011, 18 pages.
Cleary, M. P. et al., "Field Implementation of Proppant Slugs to Avoid Premature Screen-out of Hydraulic Fractures with Adequate Proppant Concentration," SPE 25892, presented at the SPE Rocky Mountain Regional/Low Permeability Reservoirs Symposium, Denver, Colorado, USA, 1993, pp. 493-508.
Gu, H., et al., "Formation Permeability Determination Using Impulse Fracture Injection", SPE 25425-MS. presented at the SPE Production Operations Symposium, Oklahoma City, Oklahoma, USA, 1993, pp. 189-201.
Miller, C. K. et al. "Evaluation of Production Log Data from Horizontal Wells Drilled in Organic Shales", SPE-144326-MS, presented at the SPE North American Unconventional Gas Conference & Exhibition, The Woodlands, Texas, USA, 2011, 23 pages.
Nolte, K. G., "Determination of Fracture Parameters from Fracturing Pressure Decline", SPE 8341, SPE presented at the SPE Annual Technical Conference and Exhibition, Las Vegas, Nevada, USA, 1979, 16 pages.
Nolte, K. G., "A General Analysis of Fracturing Pressure Decline with Application to Three Models", SPE-12941-PA, . SPE Formation Evaluation, 1986, 1(6), pp. 571-583.
Nolte, K. G. et al., "After-Closure Analysis of Fracture Calibration Tests", SPE 38676, presented at the SPE Annual Technical Conference, San Antonio, Texas, USA, 1997, 17 pages.
Walker, K. et al., "Improving Production in the Marcellus Shale Using an Engineered Completion Design: A Case Study", SPE-159666-MS, presented at the SPE Annual Technical Conference and Exhibition, San Antonio, Texas, USA, 2012, 9 pages.
Waters, G. et al., "The Impact of Geomechanics and Perforations on Hydraulic Fracture Initiation and Complexity in Horizontal Well Completions", SPE-181684-MS, presented at the SPE Annual Technical Conference and Exhibition, Dubai, UAE, 2016, 36 pages.
Weng, X. et al., "Analytical Model for Predicting Fracture Initiation Pressure from a Cased and Perforated Wellbore", SPE-191462-18IHFT-MS, presented at the SPE International Hydraulic Fracturing Technology Conference & Exhibition, Muscat, Oman, 2018, 21 pages.
Wutherich, K. et al., "Evaluating an Engineered Completion Design in the Marcellus Shale Using Mircoseismic Monitoring", SPE-159681-MS, presented at the SPE Annual Technical Conference and Exhibition, San Antonio, Texas, USA, 2012, 10 pages.
International Search Report and Written Opinion issued in International Patent Application No. PCT/US2019/059832 dated Apr. 9, 2020; 10 pages.
International Search Report and Written Opinion issued in International Patent Application No. PCT/US2019/059840 dated Apr. 7, 2020; 9 pages.
Office Action issued in U.S. Appl. No. 17/291,388 dated Feb. 8, 2023, 29 pages.
Substantive Exam issued in Saudi Arabia Patent Application No. 521421946 dated Mar. 31, 2023, 9 pages with English translation.

* cited by examiner

1 Initial Breakdown Pressure at Lower Rate (e.g., pump down landing)

2 Breakdown Pressure at Treating Rate

3 Pressure Drop with Slurry Rate

4 Instantaneous Shut-in Pressure (ISIP)

3 - 4 = ΔPfric

FRACTURING OPERATIONS PUMP FLEET BALANCE CONTROLLER

RELATED APPLICATIONS

This application claims priority to and the benefit of a US Provisional Application having Ser. No. 62/755,803, filed 5 Nov. 2018, entitled "Auto Hydraulic Treating Pressure Management", which is incorporated by reference herein, and claims priority to and the benefit of a US Provisional Application having Ser. No. 62/832,102, filed 10 Apr. 2019, entitled "Fracturing Pumping Automation by Condition Based Operation", which is incorporated by reference herein.

BACKGROUND

This disclosure generally relates to automated fracturing by automating pumping rate.

In a hydraulic fracturing job, pressure control is involved to ensure proper fracturing. The way to manage the pressure is by adjusting the pumping rate as appropriate to maintain the safe range for treating pressure. Today the process is difficult and demands a pump operator to work closely with a client representative to monitor the treating pressure at the wellhead and make manual changes on pumping rate as appropriate to maintain the treating pressure in the safe range. However, the pump operator often has difficulty managing treating pressure (especially during the starting stage of a fracturing job) to keep the treating pressure in designed safe range. Therefore, a system that can automatically and accurately manage the treating pressure can be beneficial in various types of wells.

In various scenarios, depending on various conditions, a wellbore may be drilled at least in part using directional drilling. Directional drilling generally refers to deviating from vertical, for example, departure of a wellbore from vertical exceeding about 80 degrees. Directional drilling can be utilized to form a wellbore that includes at least one lateral portion, which may thereby characterize the wellbore or the well as being a horizontal well. A horizontal well may aim to penetrate a greater length of a reservoir, particularly a laterally extensive reservoir, where it can offer greater reservoir contact when compared to a vertical well.

Hydraulic fracturing may be utilized in various types of wells, which may include one or more vertical portions, one or more lateral portions, etc. A horizontal well with multiple fracturing stages, with each stage containing multiple perforation clusters to initiate multiple fractures, has become one of the most common choices of well completion in developing unconventional oil and gas resources (e.g., unconventional reservoirs). However, downhole diagnostic measurements using fiberoptic technology or production logging often indicate that not each perforation cluster is effectively stimulated, which can negatively impact well production. There are several possible mechanisms that can lead to uneven stimulation among multiple perforations, including lateral heterogeneity of the reservoir properties, especially the in-situ stress, poor limited-entry perforation design to provide sufficient divertive perforation friction to overcome the stress differences, perforation erosion by proppant that reduces the perforation friction (e.g., or perf friction), and the mechanical interference between adjacent fractures (e.g., the so-called stress shadow effect).

An effective and proven method to increase the completion efficiency (e.g., stimulation coverage among the multiple clusters) involves use of an "engineered completion" strategy to select and optimize perforation locations so that they are located in the rocks of similar properties to avoid disparities that may promote uneven stimulation. However, the effectiveness of such an approach depends on logs to determine appropriate reservoir rock properties, especially sonic logs for estimating the in-situ stress, which add substantial costs and are hence not often acquired. An available gamma ray log that may be used to aid steering a well during drilling can be insufficient to provide quality information to achieve reliable engineered completion.

Another method that aids fracturing engineers in the fracturing operation in conventional wells is pressure diagnosis. Various injection tests and techniques for analyzing the corresponding pressure responses have been utilized to determine formation fracturing rate and pressure, closure stress, fluid leakoff properties, perforation friction and near-wellbore tortuosity. However, most methods become severely limited in unconventional reservoirs due to extreme low rock permeability which can demand a very long shut-in time to see fracture closure, rendering most of such techniques impractical. Furthermore, one of the factors that allows effective exploitation of unconventional reservoirs is operation efficiency. Operators can aim to minimize operation downtimes during a fracturing treatment and between stages to reduce cost, and therefore, to save time as these injection tests are not generally integrated in the routine operations as in the conventional reservoirs.

Various deficiencies in fracturing operations can be overcome by using various examples of automated systems and control circuitry and/or instructions as described herein.

SUMMARY

A system can include one or more processors; memory accessible to at least one of the one or more processors; a data interface that receives data acquired by one or more sensors operatively coupled to one or more pumps, where the one or more sensors include a pump discharge pressure transducer and a pumping rate sensor; a control interface that transmits control signals to at least one of the one or more pumps; a modeling component, operatively coupled to at least one of the one or more processors, that predicts pressure in a well using a model, an intended pumping rate, and at least a portion of the data indicative of an actual pumping rate and a well head pressure estimate, where the well is fluidly coupled to at least one of the one or more pumps; and a pumping rate adjustment component, operatively coupled to at least one of the one or more processors, that, in a predicted pressure mode, generates, using a predicted pressure of the modeling component and a pressure threshold, a pumping rate control signal for transmission via the control interface. A method can include receiving data acquired by one or more sensors operatively coupled to one or more pumps, where the one or more sensors include a pump discharge pressure transducer and a pumping rate sensor; predicting pressure in a well using a model, an intended pumping rate, and at least a portion of data indicative of an actual pumping rate and a well head pressure estimate, where the well is fluidly coupled to the one or more pumps; generating, in a predicted pressure mode, a pumping rate control signal using the predicted pressure and a pressure threshold; and transmitting the pumping rate control signal via a control interface to control operation of the at least one of the one or more pumps. A system can include one or more processors; memory accessible to at least one of the one or more processors; a data interface that receives real-time data for individual pumps in a fleet of pumps during a hydraulic fracturing operation; a control interface that transmits control signals for control of each of the individual pumps in the fleet of pumps during the hydraulic fracturing operation; a capacity component, operatively coupled to at least one of the one or more processors, that estimates a real-time pumping capacity for each of the individual pumps in the fleet of pumps using at least a portion of the real-time data, where an estimated real-time pumping capacity for the fleet of pumps computed using the estimates is less than a maximum specified pumping capacity for the fleet of pumps due to operational degradation of at least one of the individual pumps; and a control component, operatively coupled to at least one of the one or more processors, that, for a target pumping rate for the fleet of pumps during the hydraulic fracturing operation, generates at least one of engine throttle and transmission gear settings for each of the individual pumps using the estimated real-time pumping capacity for each of the individual pumps, where the settings are transmissible via the control interface as one or more of the control signals. A method can include receiving real-time data for individual pumps in a fleet of pumps during a hydraulic fracturing operation; estimating a real-time pumping capacity for each of the individual pumps in the fleet of pumps using at least a portion of the real-time data, where an estimated real-time pumping capacity for the fleet of pumps computed using the estimates is less than a maximum specified pumping capacity for the fleet of pumps due to operational degradation of at least one of the individual pumps; generating, for a target pumping rate for the fleet of pumps during the hydraulic fracturing operation, at least one of engine throttle and transmission gear settings for each of the individual pumps using the estimated real-time pumping capacity for each of the individual pumps; and transmitting the settings via a control interface as one or more control signals that control each of the individual pumps in the fleet of pumps during the hydraulic fracturing operation. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

Figure 1:
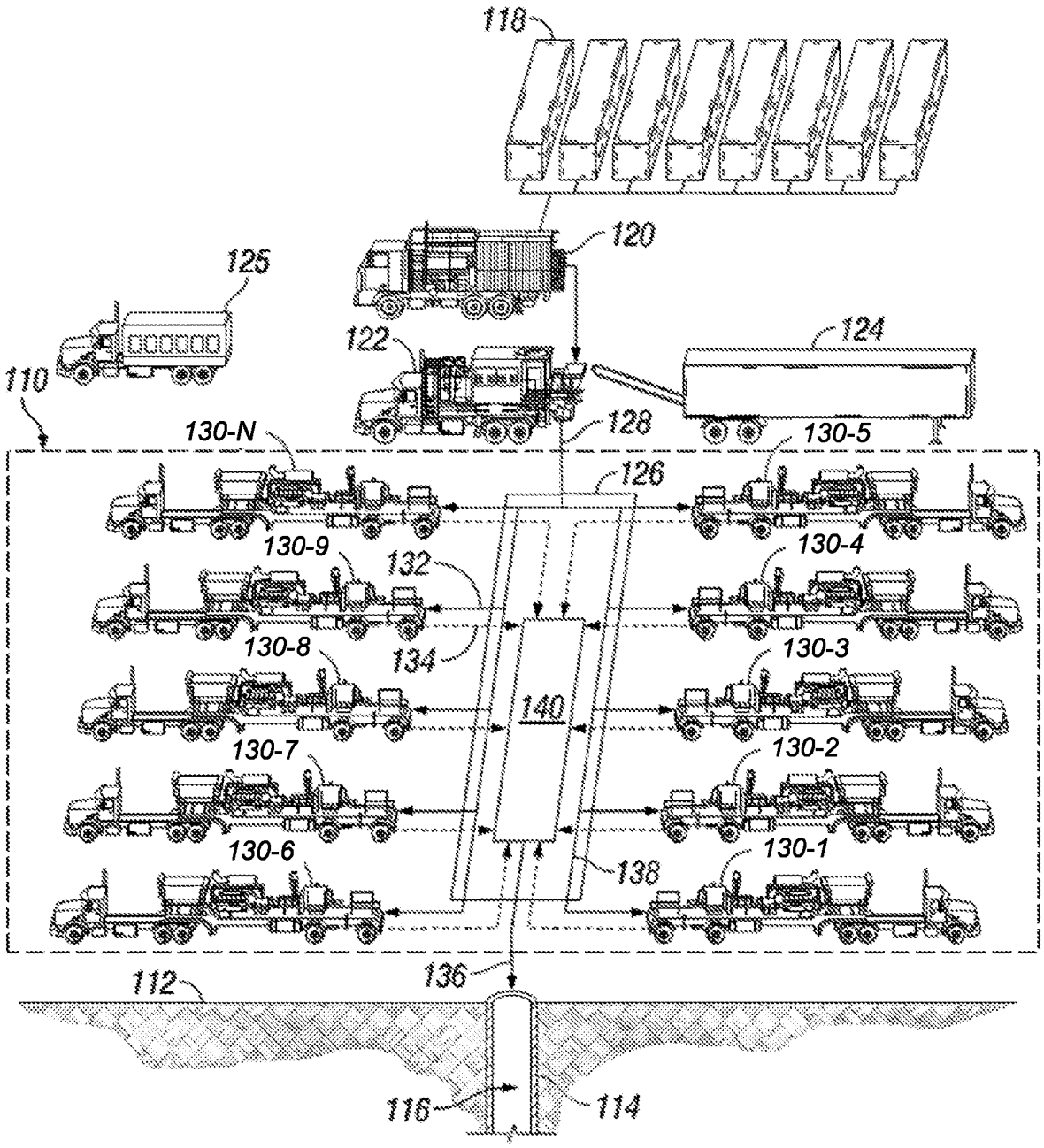
FIG. 1 illustrates an example of a system.

This description is not to be taken in a limiting sense, but rather is made merely for the purpose of describing the general principles of the implementations. The scope of the described implementations should be ascertained with reference to the issued claims.

In one or more embodiments, a control system can manage pressure automatically by adjusting the pumping rate based on the estimated wellhead pressure, pressure change rate, and the predicted pressure trend under given pumping rate.

An estimate of well head pressure can be measured by one or more wellhead pressure transducers, one or more pump discharge transducers, one or more other sensors, or combinations thereof. When there are one or more pumps in the system, the pressure measurements from the connected pumps can be averaged. In one or more embodiments the control system can be configured to filter the pressure measurements to remove outliers, and the filtered pressure measurements can be averaged to provide an estimated well head pressure.

The pressure change rate can be derived from the estimated well head pressure and history of pressure measurement.

The wellhead pressure Pw is the combination of following three components:

Pb: Bottom hole pressure (e.g., or Pbh);

Ph: Hydrostatic pressure of the fluid in the well bore; and

Pf: Friction pressure caused by the flow of the fluid $$Pw=Pb-Ph+Pf$$

Above, Pb is a function of the formation and reservoir fluid, which can be estimated from the fracturing job design; Ph can be derived from a fracturing slurry property and a wellbore geometry; and Pf is a function of pumping rate and a fluid friction property.

A control system can have or be in communication with machine learning algorithms. As an example, one or more machine learning algorithms can be applied to update models that estimate Pb and Pf. With the updated model(s), the future pressure is predicted by estimated well head pressure, pressure change rate, pumping rate, and intended pumping rate. In one or more embodiments, 1st order and/or 2nd order polynomial regression can be used for a prediction algorithm. As an example, a model can be a hybrid model (e.g., a physics-based model supported by data).

As an example, Pf can be expressed as a function of flow rate: $Pf=K*Q^2$, where the coefficient K relates to the fluid property, and the well bore geometry. While the fluid type and well bore geometry information may not be readily available to derive K directly, the real-time data measurement may be used to estimate K.

As an example, a control system can be in communication with or contain a treating pressure versus pumping rate curve. The treating pressure versus pumping rate curve can have a default chosen from the past job record in the similar area assuming the well behaves in a similar way. For example, treating pressure versus pumping rate curves for wells in the same or similar area can be presented as a probability model, where a third axis shows the probability of each pair of pressure and rate that are the other two axis. In one or more embodiments, the treating pressure vs pumping rate curve can be stored in a server or servers and updated as new fracturing jobs are being performed. In one or more embodiments, the treating pressure versus pumping rate curve can be stored in a control system and updated as the current job is being performed or updated from data sent to the control system from remote devices.

As an example, a control system can be configured to use a treating pressure versus pumping rate curve, estimated well head pressure, pumping rate, pressure change rate, or combinations thereof to predict if pressure is approaching or exceeding a specified pressure threshold as the current pumping rate, and automatically reduce the pumping rate in a way to keep the pressure under the threshold pressure.

In one or more embodiments, a control system may receive user input setting a higher pumping rate set point, as such the control system can predict if the pressure threshold will be approached or exceeded by the new pumping rate set point. If it is determined that the pressure threshold will be approached or exceeded, the control system can be configured to automatically adjust the rate ramping slope, reduce the new rate set point, or combinations thereof to maintain the pressure below the pressure threshold. In one or more embodiments, the control system can use the treating pressure versus the pump rate curve to optimize the adjusted pressure set point; thereby, identifying a rate that is as close as possible to the new rate set point while maintaining pressure below the pressure threshold.

In one or more embodiments, a control system can be configured to operate either as above or to switch to another way of controlling the pump rate. For example, the control system can receive an input from a user to use a pressure control mode. For example, the control system can set the pump rate to a maximum rate afforded by available horse power of connected pumps, and to maintain this rate as long as the pressure is within the limit. If enough horse power is provided at the location, this operational mode can result in a constant wellhead pressure during the stimulation, which can reduce the pumping time and increase operation efficiency. However, if the pressure starts approaching or exceeding the threshold pressure, the pump rate can be reduced. A mode that differs from the pressure control mode may be referred to as an alternative mode.

As an example, a control system can be used to perform automated frac initiation. Automated frac initiation helps hit frac clusters stronger and faster based on maximum allowable pressure (e.g., rather than pre-determined rate) without tripping pumps, which can lead to better cluster frac initiation coverage.

As an example, a control system can also assist with automated cluster monitoring and re-initiation. For example, the control system can be in communication with one or more cloud applications, edge applications, the like, or combinations thereof that determine frac cluster coverage in real-time (see, e.g., frac clusters of FIGS. 7 and 8). As an example, consider a real-time planning tool that uses the frac cluster coverage estimated in real-time. As an example, a control system can use feedback in conjunction with predicted pressure, and pump rate, estimated well head pressure, pressure change rate, intended rate, and models as described above to adjust the rate/pressure to gain better cluster coverage.

As an example, a control system can also be configured to enable automated screen out shut down sequencing. For example, the control system can be configured to manage pressure such that a job is allowed to go to flush at a maximum possible rate based on maximum allowable pressure. Such an approach can lead to better flush and increase chances to remedy screen out conditions (e.g., or screenout conditions); thereby, reducing the probability of coil intervention.

As an example, a control system can also allow for faster frac execution by maximizing rate towards tail end of the frac job, and throughout the flushing operation based on max allowable pressure.

As an example, a control system can also allow for power distribution to ensure that power is distributed to the prime movers to optimize the power more efficiently between available pumping units.

FIG. 1 depicts an example of a system 100 that can be used for a hydraulic fracturing operation, which may also be referred to as a job. The system 100 can include a pumping system 110 for pumping a fluid from a surface 112 of a well 114 to a well bore 116 during the oilfield operation. In the illustrated embodiment, the system 100 is being used for a hydraulic fracturing operation, and the fluid pumped is a fracturing fluid. For example, the fluid can be a slurry that includes a proppant. In the illustrated embodiment, the system 100 includes a plurality of water tanks 118 that feed water to a gel maker 120. The gel maker 120 combines water from the water tanks 118 with a gelling agent to form a gel. The gel is then sent to a blender 122 where it is mixed with a proppant from a proppant feeder 124 to form the fracturing fluid. A computerized control system 125 can be employed to direct at least a portion of the system 100 during at least a portion of a fracturing operation.

The fracturing fluid is pumped at low pressure (e.g., within a range of from about 50 psi (345 kPa) to about 200 psi (1379 kPa) or more) from the blender 122 to the pumping system 110 via one or more conduits, as depicted by a solid line 128. The pumping system 110 can include a common manifold system 126, which can also be referred to herein as a missile.

In FIG. 1, the manifold system 126 is depicted schematically via an enlarged box having inbound and outbound arrows depicting various flow path segments. In the illustrated embodiment, the manifold system 126 includes a low pressure manifold 138 and a high pressure manifold 140. The low pressure manifold 138 of the manifold system 126 can distribute the low pressure slurry to a plurality of pumps 130-1, 130-2, 130-3, 130-4, 130-5, 130-6, 130-7, 130-8, 130-9 and 130-N, as shown by solid lines 132. The pumps 130-1 to 130-N can also be referred to as fracturing pumps, and may, for example, be plunger pumps. In the illustrated embodiment, each of the fracturing pumps 130-1 to 130-N can receive the fracturing fluid at a low pressure and discharges it to the high pressure manifold 140 portion of the manifold system 126 at a high pressure, as shown by dashed lines 134 (for example, in various embodiments, the high pressure can be within a range of from about 3,000 psi (20.7 MPa) to about 15,000 psi (103 MPa)). The high pressure manifold 140 then directs the fracturing fluid from the pumps 130-1 to 130-N to the well bore 116 as shown by solid line 136. Stated otherwise, an outlet of the high pressure manifold 140 can be in fluid communication with the well bore 116, and can be configured to deliver a fluid down the wellbore.

The manifold system 126 can include a plurality of valves that can be connected to the fracturing pumps 130-1 to 130-N, as discussed further below. The control system 125 can be used to automate the valves, as also discussed below. For example, the control system 125 can be configured to execute machine-readable code to control movement of the valves. In some arrangements, the control system 125 can automatically pair the valves with the pumps 130-1 to 130-N. For example, the control system 125 can create a flow path definition that is representative of various flow paths between separate portions of the manifold system 126. Based on the flow path definition, the control system 125 can create interlocks between the pumps 130-1 to 130-N and the manifold system 126.

In some embodiments, fracturing pumps 130-1 to 130-N can be independent units that are plumbed to the manifold system 126 onsite. In some arrangements, after the completion of a job, the fracturing pumps 130-1 to 130-N can be disconnected from the manifold system 126, transported to another site, and connected to a manifold system at the new site. A particular one or more of the fracturing pumps 130-1 to 130-N may be connected differently to the same manifold system 126 or to different manifold systems on different jobs. In some embodiments, each of the fracturing pumps 130-1 to 130-N can include a pump unit mounted on a truck or trailer for ease of transportation. Other arrangements are also possible. For example, one or more of the pumps 130-1 to 130-N can be mounted to a skid or any other suitable frame or platform, such as can be used for longer term operations.

In some embodiments, a pump (e.g., one or more of the pumps 130-1 to 130-N) can include a prime mover that drives a crankshaft through a transmission and a drive shaft. The crankshaft, in turn, can drive one or more plungers toward and away from a chamber in the pump fluid end in order to create pressure oscillations of high and low pressure in the chamber. These pressure oscillations can allow the pump to receive a fluid at a low pressure and discharge it at a high pressure, such as via check valves. In some embodiments, a fluid end of a pump can include an inlet (e.g., intake pipe) for receiving fluid at a low pressure from the manifold system 126 and an outlet (e.g., discharge pipe) for discharging fluid at a high pressure to the manifold system 126.

Figure 2:
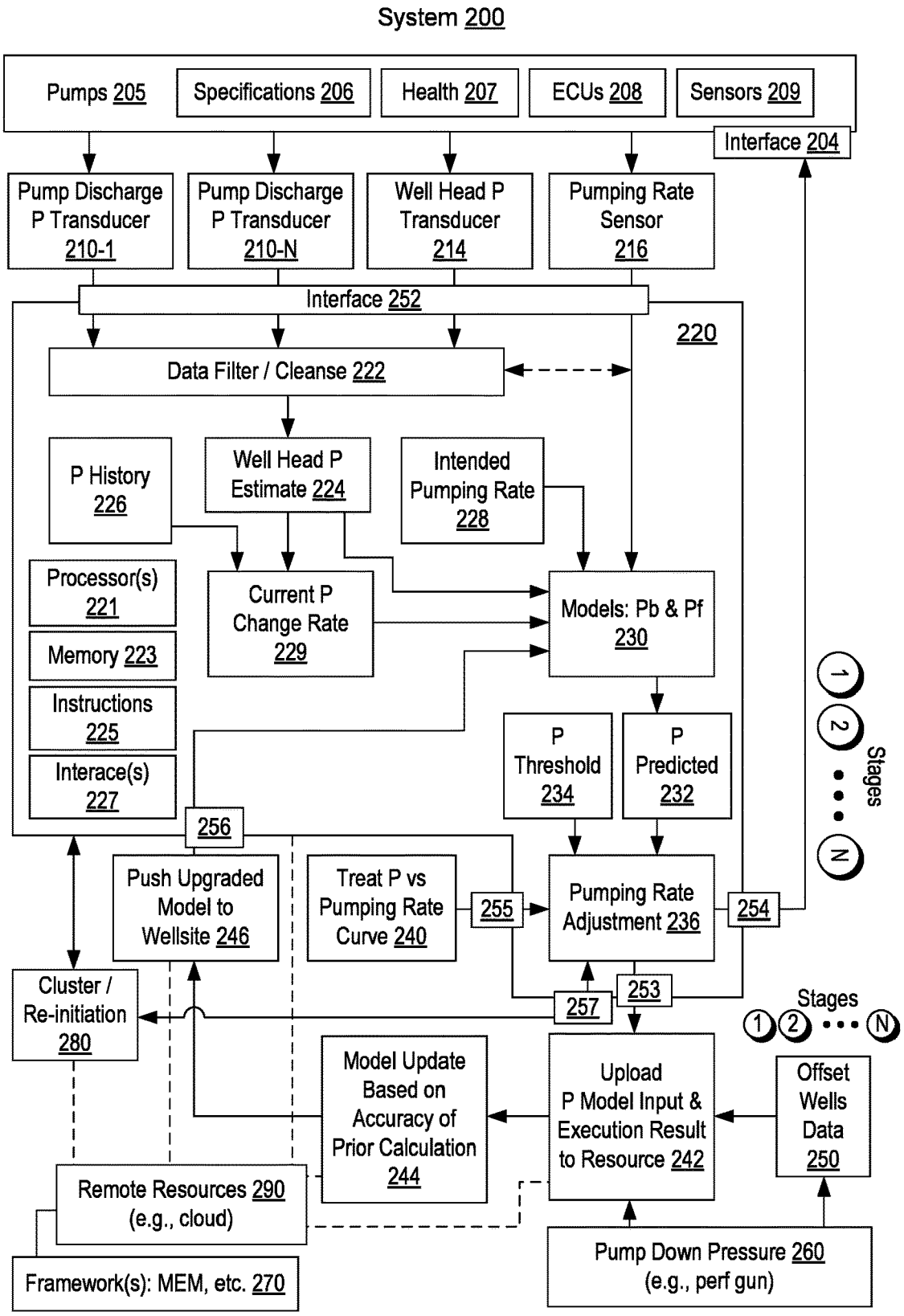
FIG. 2 illustrates an example of a system.

FIG. 2 depicts an example schematic of a system 200 that can be utilized for automated pressure control.

A pump site can include a number of engaged pumps 205 (see, e.g., the pumps 130-1 to 130-N of FIG. 1). In the example of FIG. 2, the pumps 205 can include one or more interfaces 204, specifications 206, health data 207, engine control units ("ECUs") 208 (e.g., and other control units), and sensors 209. The system 200 can include various sensors (e.g., transducers, etc.), for example, consider various types of sensors that can measure one or more physical phenomena such as flowrate, pressure, etc. For example, consider various sensors that can measure flowrate and/or pressure from one or more of the pumps 205. As an example, there can be one or more pump discharge pressure transducers 210-1 and 210-N, one or more well head pressure transducers 214, one or more pump rate sensors 216, or combinations thereof.

As to data acquisition, rates may be determined for one or more channels depending on equipment, methods implemented, etc. As an example, data acquisition via one or more data interfaces can be of various frequencies that may define a range of frequencies from low to high. As an example, a frequency can be of 200 Hz or more (e.g., consider high frequency pressure data being acquired for one or more friction determinations, etc.). As an example, equipment such as WELLWATCHER STIM equipment (Schlumberger Limited, Houston, Texas) may be utilized for acquisition and analysis of high-frequency pressure pulse data. As a monitoring service, WELLWATCHER STIM equipment can help to identify fracturing fluid entry points and pressure changes that can indicate isolation failures or frac hits, which may provide for rapid reaction to unexpected stimulation challenges. As an example, consider monitoring during fracturing to identify frac hits during one stage and modify subsequent stages to limit further encroachment. Such a service may provide for event verification such as, for example, actuation ball landing, plug setting, port shifting, fluid entry into the reservoir, and fluid diversion.

A control system 220 can be operatively coupled to the pumps 205 to adjust the pump rate of the pumps 205. In the example of FIG. 2, the control system 220 can include one or more processors 221, memory 223 accessible to at least one of the one or more processors 221, instructions 225 (e.g., one or more sets of processor-executable instructions), and one or more interfaces 227 (e.g., serial, parallel, wired, wireless, optical, power, data, command, etc.). As an example, instructions can be stored in one or more non-transitory computer-readable storage media (e.g., CRM) where such instructions may be referred to as being processor-executable or computer-executable. Such instructions can be executable to instruct the control system 220 to perform one or more actions.

As an example, one or more blocks illustrated in the example of FIG. 2 can represent circuitry, which can include instructions. As an example, a block may represent a CRM and/or one or more other types of circuitry.

As shown, the control system 220 can include various interfaces such as, for example, the interfaces 252, 253, 254, 255, 256, 257, etc. As an example, one or more of such interfaces may be a common interface such as, for example, a network interface, which may be wired, wireless, optical, etc. As an example, the interface 252 can be a data interface operatively coupled to one or more sensors (e.g., transducers, etc.) and the interface 254 can be a control signal interface, for example, for transmission of one or more control signals to at least one of the one or more pumps 205.

In the example of FIG. 2, the control system 220 can include a data filtering and/or cleansing block 222 that can receive data from one or more sensors operatively coupled to the one or more pumps 205. As shown, the data filtering and/or cleansing block 222 can receive output from the pump discharge pressure transducer 210-1, the pump discharge pressure transducer 210-N, the well head pressure transducer 214 and the pumping rate sensor 216.

The control system 220 may receive data at one or more rates, which can depend on operational parameters of one or more sensors (e.g., analog to digital conversion, timers, other circuitry, etc.).

As shown, the control system 220 can include a well head pressure estimation block 224, a pressure history block 226 (e.g., pressure data for one or more of the pumps 205, etc.), an intended pumping rate block 228, a current pressure change rate block 229, a models block 230, a pressure predicted block 232, a pressure threshold block 234 and a pumping rate adjustment block 236. The well head pressure estimation block 224 can estimate a well head pressure for output to the current pressure change rate block 229, which may also receive data as to historical pressure values per the pressure history block 226.

As shown, the pumping rate adjustment block 236 can receive output of the pressure predicted block 232 and the pressure threshold block 234 as well as output of a treating pressure versus pumping rate curve block 240.

Referring again to the models block 230, as shown, various blocks can feed the models block 230, which is instrumental in providing the predicted pressure of the pressure predicted block 232, which instructs the pumping rate adjustment block 236. As to the models block 230, it can receive data from the pumping rate sensor 216 (e.g., optionally via the data filtering and/or cleansing block 222), can receive data from the well head pressure estimation block 224, can receive data from the intended pumping rate block 228, can receive data from the current pressure change rate block 229 and can receive feedback via an upgrade model block 246 that provides for one or more updates to one or more models of the models block 230.

As shown, the upgrade model block 246 is part of a feedback loop where output of the pumping rate adjustment block 234 provides for model update based on accuracy of one or more prior calculations per the block 244. In the example of FIG. 2, an upload block 242 can be utilized to upload a pressure model or pressure models of the models block 230 and an execution result such as, for example, a pumping rate of the pumping rate adjustment block 236 (e.g., a pumping rate, an adjusted pumping rate, etc.) to a resource or resources (see, e.g., a remote resources block 290). As shown, the block 242 can provide output to a block 244 where the block 242 can utilize one or more resources (e.g., cloud-based resources, etc.) as to one or more pressure models (e.g., using input and an execution result) such that the block 244 can appropriately update one or more models of the models block 230 based on accuracy of a prior calculation (or calculations) such that the block 246 is properly provided with upgrades to one or more models of the models block 230. In such an approach, one or more models of the models block 230 can be refreshed as appropriate using output of the pumping rate adjustment block 236 and, for example, resources that may be remote from the wellsite (e.g., remote computing resources, etc.).

As to the models block 230, it can, for example, include a model that can be a bottom hole pressure model (Pb) and a model that can be a friction pressure caused by flow of fluid model (Pf). Such models can, for example, estimate Pb (bottom hole pressure) and Pf (friction pressure caused by the flow of the fluid).

The control system 220 can use a predicted pressure per the block 232, a pressure threshold per the block 234, and a treating pressure versus pumping rate curve per the block 240 to automatically control pump rate per the block 236. As shown, the pumping rate adjustment block 236 can output an appropriate control signal (e.g., command, etc.) to cause one or more of the pumps 205 to adjust pumping rate.

The control system 220 can be utilized in an onsite control loop for pumping rate control and can be utilized in a partially offsite loop for providing one or more model updates. As an example, the onsite control loop can be operational while the partially offsite loop may be operational or not. As an example, the control system 220 can include instructions that control use of the partially offsite loop, for example, in response to one or more conditions that may occur, be detected, etc., at a wellsite. For example, a condition may occur or be detected during and/or after performing a fracturing stage such that the control system 220 calls for one or more model updates using the partially offsite loop prior to performing a subsequent stage. Depending on the speed of the partially offsite loop, an update may be available during or after the performance of a fracturing stage, which can determine whether or not the update may be implemented during the performance of the fracturing stage.

As explained, the control system 220 can be implemented in a manner where the one or more models of the model block 230 are "evergreen", for example, at least in part through utilizing output of the control system 220 (e.g., the pumping rate adjustment block 236). As explained, the control system 220 can be "in control" of its models in the models block 230 in a manner that is based on performance of the control system 220 for a job or jobs and/or based on a change in one or more conditions (e.g., a physical condition, a job condition, etc.).

As to the well head pressure estimation block 224, the data filtering and cleansing block 222 can take measured pressures and perform various actions to, for example, remove outliers from the measure pressures. The well head pressure estimation block 224 can use the output from the data filtering and cleansing block 222 to determine a well head pressure estimate. For example, the filtered and cleansed pressure data can be averaged to obtain an estimate of the well head pressure (e.g., a well head pressure estimate, Pw).

As mentioned, the well head pressure estimate (Pw) can be used by the models block 230 to estimate Pb and Pf. As an example, the models can estimate Pb and Pf using the equation $Pw=Pb-Ph+Pf$, where Pb, Ph, and Pf are defined as:

Pb: Bottom hole pressure;

Ph: Hydrostatic pressure of the fluid in the well bore; and

Pf: Friction pressure caused by the flow of the fluid.

As mentioned, the well head pressure estimate (Pw) can also be provided to the current pressure change rate block 229, which can also receive data as to the history of pressure measurements per the block 226. For example, the history of pressure measurements per the block 226 can provide historical data on pressure measurements of the one or more pumps 205 for a preceding time period, such as 1 sec, 2 secs, 1 minute, 1 hour, 24 hours, etc. The current pressure change rate block 229 can use the provided well head pressure estimate (Pw) and the provided historical data per the block 226 to obtain a current pressure change rate value. For example, if the historical pressure data is for a 10-minute time interval, instructions can be executed to subtract the well head pressure estimate (Pw) from the average historical pressure date and divide by 10 minutes to obtain the current pressure change rate.

As an example, instructions can be executed to send the calculated pressure change rate to the models block 230 that estimates Pb and Pf. Instructions can also be executed to provide the inputted intended pumping rate per the block 228 to the models block 230 for estimating Pb and Pf. The models that estimate Pb and Pf can use the well head pressure estimate (Pw), the intended pumping rate, and the current pressure change rate to provide a predicted pressure per the block 232. As an example, the models that estimate Pb and Pf can use 1st order and/or 2nd order polynomial regression to predict the pressure. As an example, one or more machine learning (ML) algorithms can be used to update the models that estimate Pb and Pf (see, e.g., the loop of blocks 242, 244 and 246).

Instructions can be executed to provide the predicted pressure per the block 232, a predetermined pressure threshold per the block 236, and a treating pressure vs pumping rate curve per the block 240 to the pumping rate adjustment block 236, which can include instructions executable to adjust the pump rate of the one or more pumps 205. As an example, the treating pressure vs pumping rate curve per the block 240 can be provided to the control system 220 from a central server. The treating pressure vs pumping rate curve 240 can be updated using data from surrounding operations and data from operations on similar formations. The pumping rate adjustment block 236 can determine if the predicted pressure per the block 232 is approaching the pressure threshold per the block 234; where, if it is determined that it is approaching the pressure threshold, the pumping rate adjustment block 236 can determine a pumping rate from the treating pressure vs pumping rate curve 240 that aims to maintain the pressure below the pressure threshold. The control system 220 can then control the one or more pumps 205 to get a new pumping rate (e.g., where it is determined that adjustment is desired).

In one or more embodiments, the control system 220, using the pumping rate adjustment module 236, can receive input from a user to set a new rate setpoint (e.g., a higher setpoint). In such an example, a new higher rate setpoint can be used to predict the pressure and adjust and optimize the rate to be as close as possible to the new higher rate setpoint while maintaining the pressure below the threshold pressure. For example, this may be accomplished by adjusting the rate ramping slope so that it is slowed down to optimize the operation and maintain pressure below the pressure threshold. As another example, the pumping rate adjustment block 236 can determine that the predicted pressure per the block 232, calculated using the new rate setpoint, is going to exceed the pressure threshold per the block 234. As such, the pumping rate adjustment block 236 can use the treating pressure vs pumping rate curve per the block 240 to identify an adjusted rate setpoint as close to the desired new rate setpoint that will maintain the pressure below the threshold pressure per the block 234.

As shown in the example of FIG. 2, the block 242 can receive input from one or more offset wells per the offset well data block 250 and/or can receive input from a pump down pressure block 260, which may be associated with pump down of one or more types of equipment such as, for example, a perforation gun that can be utilized to perforate a casing for purposes of hydraulic fracturing a formation where the casing is disposed in the formation.

Perforating can create a fluid communication tunnel in a casing or a liner to a reservoir formation, through which oil or gas may be produced. As an example, perforating can utilize a jet perforating gun equipped with a shaped explosive charge. Various types of equipment can be utilized for perforating (e.g., bullet perforating, abrasive jetting or high-pressure fluid jetting). As an example, a perforating gun system such as the TEMPO perforating gun system may be utilized (Schlumberger Limited, Houston, Texas).

As shown in FIG. 2, the system 200 can include one or more computational frameworks 270, which may include, for example, a mechanical earth model (MEM) framework, a hydraulic fracturing simulation framework (e.g., consider features of one or more of the MANGROVE framework (Schlumberger Limited, Houston, Texas), the KINETIX framework (Schlumberger Limited, Houston, Texas), etc.), etc. As an example, the control system 220 may be a reservoir aware pump controller that can operate using measured and/or computed reservoir stresses. In such an example, the stresses may be computed using one or more frameworks, which can include coupled frameworks where, for example, modeled hydraulic fracturing and MEM modeling are coupled to provide updated stresses (e.g., near well, far field, etc.), which may also provide indications of fracturing, optionally represented as a discrete fracture network (DFN), which may provide for estimates of permeability and/or one or more other physical properties of a formation (e.g., a reservoir formation, etc.). As an example, the one or more frameworks 270 can include a reservoir simulation framework, which may utilize data, simulation results, etc., for modeling fluid flow. For example, consider the ECLIPSE framework (Schlumberger Limited, Houston, Texas) and/or the INTERSECT framework (Schlumberger Limited, Houston, Texas), which includes various features for modeling fluid flow in a reservoir (e.g., production post fracturing, production responsive to enhanced oil recovery, etc.). As explained, various stresses can determine how and where fractures occur in response to one or more stimulation treatments (see, e.g., FIG. 5).

As an example, a MEM framework and a hydraulic fracturing simulation framework may be utilized to determine fracture initiation pressure for one or more perforations and, for example, overall breakdown pressure at a given pump rate in a cased and perforated completion with multiple perforations and/or perforation clusters. As an example, for given formation properties and in-situ stresses, the MEM can determine expected breakdown pressure and the number of perforations/clusters that are broken down and the associated perforation friction.

Knowledge of fracturing, including wet and dry types of fractures, can improve knowledge of further fracturing and/or production of a resource from a reservoir. A DFN approach can provide for knowledge of interconnected networks where fluid may flow, which can be indicative of enhanced "permeability" of a reservoir, which can inform reservoir simulation for estimates as to actual production (e.g., with respect to time, etc.). As explained, reservoir aware optimization via a system such as the system 200 of FIG. 2 can include optimizing a reservoir for production, for example, by optimizing efficiency (e.g., over time). Such optimizing can address drilling, completion/frac treatment as well as minimizing risk of frac hits, screen-outs (or screenouts), and other losses (fluid loss etc.).

As shown, the system 200 can be utilized for one or more stages of hydraulic fracturing. For example, consider a multi-stage fracturing job that includes two or more stages.

In the example of FIG. 2, a remote resources block 290 is shown, which may include, for example, cloud-based resources (e.g., servers, cores, virtual machines, storage drives, network equipment, etc.). As shown, various features of the system 200 can be operatively coupled to, stored in, instantiated in, etc., the cloud (e.g., a network of equipment that includes computing equipment). As an example, the control system 220 can include instructions executable to call for one or more of provisioning of remote resources, instantiating one or more instances of one or more applications, accessing data, etc. As an example, such call or calls may be responsive to operation of wellsite equipment, wellsite conditions, etc.

As shown in the example of FIG. 2, the system 200 can include various features, which may be blocks that include circuitry and/or instructions stored in one or more CRM that can be executed to perform one or more actions. As shown, a cluster and/or re-initiation block 280 can be operatively coupled to the pumping rate adjustment block 236. The cluster and/or re-initiation block 280 can be part of the control system 220 or may be operatively coupled to the control system 220 and, for example, may utilize one or more of the remote resources 290.

As to the loop involving the blocks 242, 244 and 246, various examples of model updates (e.g., upgrades) are described below.

In the system 200, one or more interfaces, components, etc., can provide for inputs of data for reservoir aware pump control, which may include, for example, reservoir stresses, which may be model-based (see, e.g., the frameworks block 270).

As an example, the system 200 can provide for reservoir aware optimization that can involve optimizing for production efficiency (e.g., over time) and, for example, one or more of cost of drilling, completion/frac treatment as well as minimizing risk of frac hits, screenouts, and other losses (e.g., fluid loss, etc.).

Figure 3:
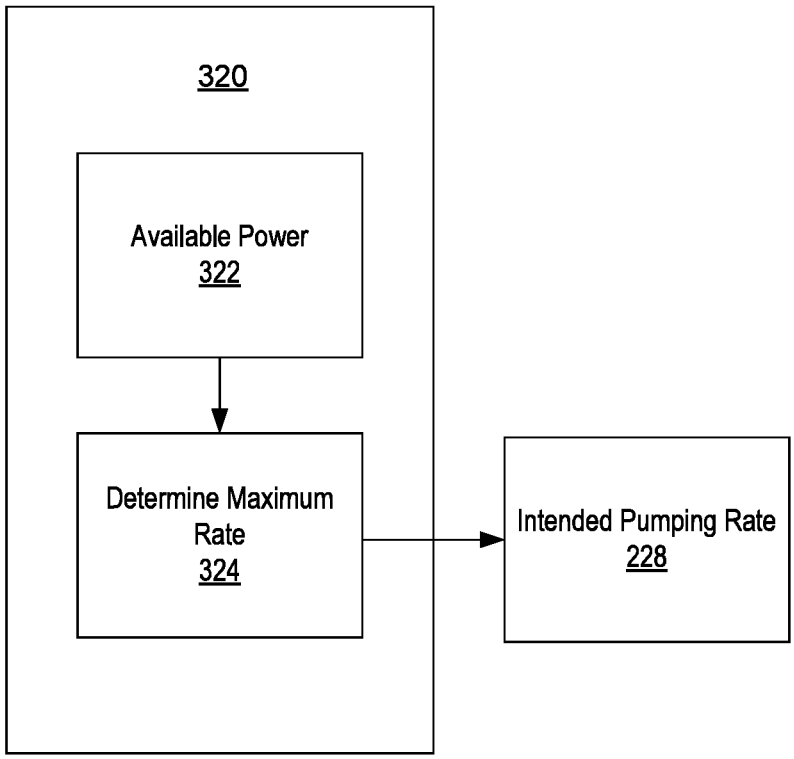
FIG. 3 illustrates examples of components and an example of a method.

FIG. 3 shows an example of a maximum power block 320. As an example, the control system 220, in one or more embodiments, can include the maximum power block 320, which may be a maximum horse power block (e.g., units of HP or foot-pound-second, or watts, etc.). The maximum power block 320 can include an available power block 322, which may be, for example, preinstalled or otherwise obtained by the maximum power block 320. For example, a user can input available power data into the control system 220 where it can be stored in the maximum power block 320. As an example, instructions can be executable to determine a maximum rate per a determination block 324. For example, consider instructions executable to use available power data per the block 322 to calculate the maximum rate for a fracturing job per the block 324.

As an example, a maximum rate can be determined one or more techniques for calculating pump flowrates. For example, known, acquired parameters, or combinations thereof, such as pump HP, pump head, flow characteristics of the fluid, or the like, can be used to calculate a maximum rate using a physics-based model or one or more other types of computational operations. The maximum rate determined by the block 324 of the maximum power block 320 can be utilized, for example, as the intended pumping rate of the block 228 of the control system 220. As an example, the control system 220 can function in a manner that allows the one or more pumps 205 to run at a maximum power (e.g., max. HP) if a predicted pressure per the block 232 does not start to approach the pressure threshold per the block 234.

Figure 4:
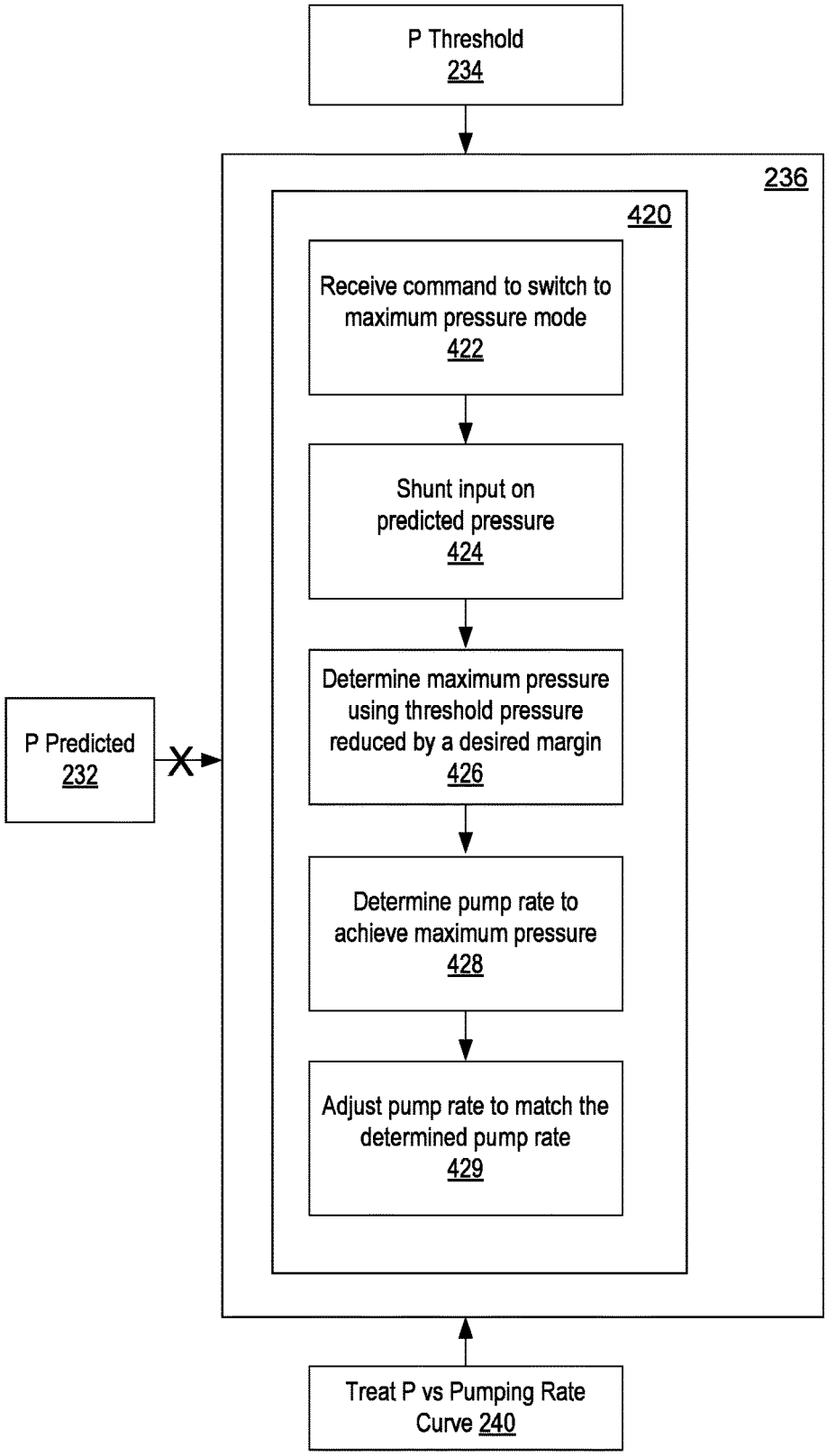
FIG. 4 illustrates examples of components and an example of a method.

FIG. 4 shows an example of the pumping rate adjustment block 236 where there can be an additional maximum pressure block 420 where the maximum pressure block 420 may be stored in or with the pumping rate adjustment block 236. In one or more embodiments, the maximum pressure block 420 can be in communication with the pumping rate adjustment block 236 but installed remotely, for example, in a cloud resource or in another portion of the control system 220. The maximum pressure block 420 can include instructions executable to receive a command to switch from a flowrate-based control mode to maximum pressure control mode per a reception block 422. These instructions can instruct a processor to switch modes (see, e.g., the one or more processors 221, the remote resources 290, etc.) by causing the pumping rate adjustment block 236 to shunt input from the predicted pressure block 232 per a shunt block 424. As shown in the example of FIG. 4, the maximum pressure block 420 can also include instructions executable to instruct the pumping rate adjustment block 236 to use a threshold pressure per the threshold pressure block 234, for example, with a predetermined working safety factor (e.g., margin or safety margin) to obtain a maximum pressure value per the determination block 426. The obtained maximum pressure as determined can be used by the pumping rate adjustment block 236 to determine a pump rate that achieves the determined maximum pressure per the determination block 428. For example, executable instructions can provide for determining the flowrate by using the treating pressure versus pump rate curve block 240 to match a desired maximum pressure to a corresponding pump rate. As an example, the maximum pressure block 420 can then instruct the pumping rate adjustment block 236 to adjust the connected one or more pumps 205 to achieve the desired maximum pump rate per an adjustment block 429.

As an example, a method can include using the reception block 422 for receiving a command to switch to a maximum pressure mode; the shunt block 424 for shunting input on predicted pressure (e.g., as may be provided per block 232); the determination block 426 for determining a maximum pressure using a threshold pressure that may be reduced by a desired margin (e.g., a safety margin); the determination block 428 for determining pump rate to achieve maximum pressure; and the adjustment block 429 for adjusting the pump rate (e.g., pumping rate) to match the determined pump rate.

Such a method can, for example, be implemented using the control system 220 of FIG. 2 where the method may be executed using instructions of the pumping rate adjustment block 236, for example, with appropriate inputs (e.g., per the block 234, per the block 240, per one of the one or more interfaces 227 that may be a user interface for mode switching, etc.).

As an example, a multistage fracturing workflow can include stimulating a reservoir via perforation clusters where, for example, a perforation cluster-by-perforation cluster stimulation approach may be utilized or where multiple perforation clusters may be stimulated simultaneous (e.g., consider a stage that includes multiple perforation clusters that may be stimulated simultaneously). It can be desirable for fractures to propagate evenly from each of the perforation clusters, which can be challenging in heterogeneous zones, particularly in long horizontal sections penetrating heterogeneous reservoirs.

As an example, a workflow can include generating perforation clusters, generating frac clusters in a treating stage and fracture re-initiation from one or more of the generated frac clusters (e.g., re-initiated frac clusters). For example, consider a horizontal well plug and perf completion where a section of the well (e.g., a targeted treatment stage) is perforated sequentially at several separated target depth intervals (e.g., measured depth intervals). In such an example, each perforated interval may be of a length of a few feet (e.g., a meter, etc.) to help facilitate a single fracture (e.g., transverse, longitudinal, hybrid, etc.).

As an example, a fracture stage can include multiple perforation clusters where each of the perforation clusters can be of a length that is of the order of 30 cm or more (e.g., one or more feet, etc.) and where each of the perforation clusters is spaced according to one or more dimensions (e.g., one or more measured depths), which may be of the order of approximately 5 meters or more (e.g., consider 10 meters to 20 meters, etc.). As an example, design parameters can include number of stages, number of clusters, cluster spacing, cluster length, number of perforations, etc.

In one or more embodiments, the control system 220 can include features for directly and/or indirectly performing automated frac cluster monitoring and, for example, re-initiation of one or more generated frac clusters (e.g., optionally including monitoring of re-initiation, etc.). For example, the instructions 225 can include instructions executable to perform one or more clustering operations and/or to call for performance of one or more clustering operations, for example, using the remote resources 290. As explained, the system 200 can include the cluster and/or re-initiation block 280, which may be part of the control system 220 or operatively coupled to the control system 220.

The block 280 can be or be operatively coupled to a real-time planning tool that is a computational framework with features for determining real-time frac cluster coverage estimates in real-time. Such real-time frac coverage estimates can be output to and received by the pumping rate adjustment block 236, for example, as feedback to adjust the pumping rate and/or pressure as appropriate in an effort to achieve a desired cluster coverage (see, e.g., FIGS. 7 and 8).

In fracturing, generation of and/or re-initiation of a frac cluster can generate seismic energy, generally, at a relatively low level such that it may be referred to as microseismic energy. Microseismic monitoring during and/or after a fracturing operation can detect microseismic emissions that may be utilized to determine corresponding microseismic event locations as cause by corresponding disruptions to rock, etc.

The control system 220 can also include an automated screenout shut down sequencing block. Such a block can include instructions executable to adjust to a maximum pump rate and maximum pressure, for example, using the treating pressure versus pump rate curve per the block 240, the threshold pressure per the block 234, and/or one or more other inputs to achieve a maximum flush rate. As to achieving a desired flush rate (e.g., a maximum flush rate, etc.), this can lead to better flush, and increase chances of remedying a screen out condition and reducing probability of coil intervention. Such an approach can also expedite frac execution by maximizing rate towards a tail end of a frac job, and, for example, throughout a flushing operation based on a maximum allowable pressure.

As an example, the control system 220 can include or be operatively coupled to a performance model. For example, consider a performance belief model that describes the relationship between treating pressure and pumping rate where the performance belief model can be used to predict a pressure change for a new target rate. In such an example, where the pumping rate adjustment block 236 determines that a new target rate is to be utilized, the performance belief model can provide a pressure change prediction. As to an example of a workflow, consider, at the beginning of a job, the control system 220 uses use the treating pressure versus pumping rate curve block 240, which may utilize data collected from one or more jobs performed in the same basin and/or similar basins, to inform the pumping rate adjustment block 236 for making adjustments to the one or more pumps 205 during the process. For example, the curves from the same basin can be chosen as a starting default. Then the possibility of new pressures can be updated during the job execution.

Figure 5:
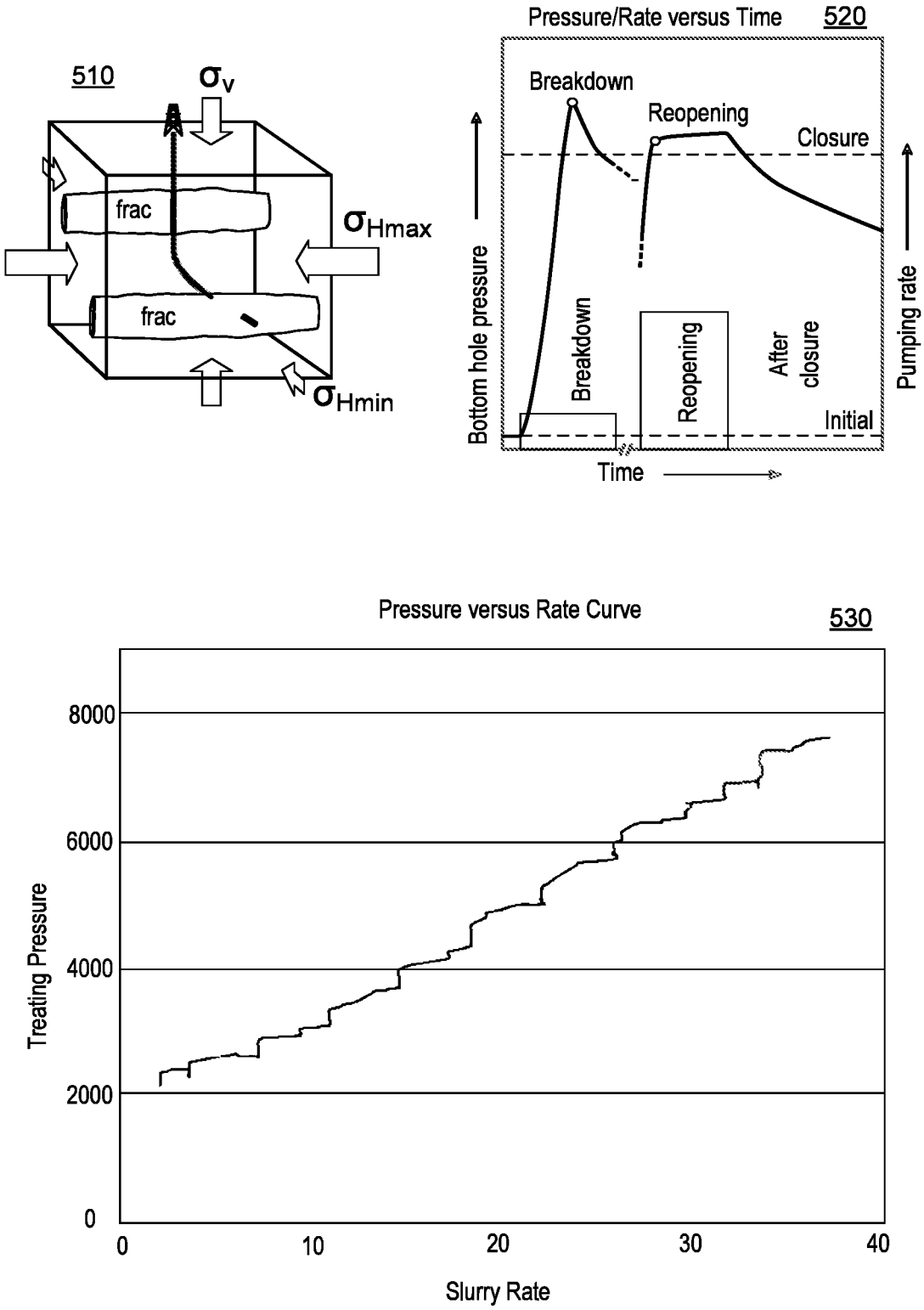
FIG. 5 illustrates examples of fracturing operations and data.

FIG. 5 shows an example graphic 510 of a hydraulic fracturing operation (e.g., a job), an example plot of bottom hole pressure and pumping rate versus time 520 and an example plot 530 of treating pressure versus slurry rate.

As an example, a hydraulic proppant fracturing job may include a pad phase (e.g., a pad step) followed by a slurry phase (e.g., one or more slurry steps). In the pad phase, fracturing fluid can be injected into the well to breakdown the formation and to create a fracture. The pad volume design can be imperative because the volume of fracture created tends to be a fraction of the total pad volume due to fluid leaking off into the formation depending on various parameters including, for example, pumping rate, formation permeability, reservoir pressure. After the design pad volume is pumped, the fracture is expected to grow at a desirable size and the slurry phase can be started. During the slurry phase, the fracturing fluid is mixed with sand/proppant in a blender and the mixture is injected into the fracture volume that was created by the pad phase. After filling the fracture with sand/proppant, the fracturing job is over and the pump can be shut down. As an example, to reduce the injection rate demand, a low leak-off fracturing fluid can be utilized. Proppants tend to be used to keep the fractures propped open and can have a compressive strength that is high enough to bear stresses from the formation acting on the proppant.

As an example, fracturing fluid can include one or more of water frac or slick water, linear gel, and crosslinked gel. For example, water frac is water containing a friction reducer and optionally a biocide, surfactant, breaker or clay control additive. Such fluid may have a relatively low viscosity of 2-3 cP, which can demand a relatively high pump rate to transport proppant. Small proppant size like 40/70 mesh, 100 mesh (e.g., for slickwater operations, etc.), etc., may be utilized with such fluid due to its low viscosity and light weight proppant may be utilized due to its better proppant transport capability. Water frac tends to be the least damaging to a proppant pack and finds particular use in high efficiency tight gas wells. As an example, a fluid can include one or more types of viscoelastic surfactants as a "water-based" frac fluid. As an example, one or more fluid additives can be included such as, for example, one or more of a scale inhibitor, a pH adjuster, a non-emulsifier, a corrosion inhibitor, a high temperature stabilizer, etc.

Linear gel can be water containing a gelling agent like guar, HPG, CMHPG, or xanthan. Other optional additives can include buffers, biocide, surfactant, breaker, and clay control. As mentioned, one or more types of additives can be included in a fluid, which may include one or more of a scale inhibitor, a pH adjuster, a non-emulsifier, a corrosion inhibitor, a high temperature stabilizer, etc. As an example, a linear gel fluid can have a medium viscosity of 10-30 cP, which can result in improved proppant transport and, for example, wider frac compared to water frac fluid. Medium proppant size like 30/50 may be utilized with such a fluid. Linear gel tends to be more damaging to a proppant pack than water frac; linear gel finds use in both gas and oil wells.

Crosslinked gel is water containing one or more gelling agents as may be used, for example, in linear gel and a crosslinker such as, for example, boron (B), zirconium (Zr), titanium (Ti) or aluminum (Al). Other optional additives can include buffers, biocide, surfactant, breaker, and clay control. A crosslinked gel fluid tends to have a relatively high viscosity of 100-1000 cP, which can result in better proppant transport and, for example, wider fracs compared to linear gel frac fluid. Large proppant sizes like 20/40 and 16/30 may be utilized with such fluid. Crosslinked gel tends to be more damaging to a proppant pack than linear gel. Crosslinked gel can find use in oil and high liquid wells.

The example graphic 510 shows representations of in-situ stresses and hydraulic fracture propagation. The three principal compressive stresses are indicated by arrows and include a vertical stress, a maximum horizontal stress and a minimum horizontal stress ($\sigma_v$, $\sigma_{Hmax}$, and $\sigma_{Hmin}$). Hydraulic fractures tend to open in the direction of the least principal stress and propagate in the plane of the greatest and intermediate stresses.

During a hydraulic fracturing operation (e.g., a job), surface equipment can be utilized to measure one or more pressures. For example, consider equipment illustrated in FIG. 1 as being utilized to perform an operation where the system 200 of FIG. 2 can include various sensors (e.g., transducers, etc.) such as, for example, the well head pressure transducer 214.

As an example, with respect to a pad phase, at the surface, a sudden drop in pressure can be measured that indicates fracture initiation, as pumped uid ows into a fractured formation. To break the rock in the target interval (e.g., targeted reservoir zone), the fracture initiation pressure exceeds the sum of the minimum principal stress plus the tensile strength of the rock. To nd the fracture closure pressure, an operation can allow the pressure to subside until it indicates that the fracture has closed again. An operation can control equipment to nd the fracture reopening pressure by pressurizing the zone until a leveling of pressure indicates the fracture has reopened. The closure and reopening pressures tend to be controlled by the minimum principal compressive stress. Therefore, induced downhole pressures are to exceed the minimum principal stress to extend fracture length. After performing fracture initiation, an operation can include controlling pumping to pressurize the zone for a planned stimulation treatment (e.g., one or more slurry steps of a slurry phase). During this treatment, pumping is utilized to pressurize the zone to the fracture propagation pressure, which is greater than the fracture closure pressure. The difference between these pressures is the net pressure, which represents the sum of the frictional pressure drop inside the fracture and the fracture-tip resistance to propagation.

As shown in the example plot 520, during a pad phase of a job, fluid is pumped into a targeted reservoir zone at a prescribed rate indicated by the boxes where, responsive to pumping of the fluid, pressure builds to a peak at the breakdown pressure, then the pressure drops, indicating that rock has failed (e.g., been disrupted, cracked, fractured, etc.). As shown, pumping can be terminated such that pressure decreases to a pressure that is below a closure pressure. During a subsequent pumping cycle (e.g., a second pumping cycle), the fracture can open again at its reopening pressure, which is higher than the closure pressure. After pumping, the fracture closes and the pressure subsides. The initial pore pressure can be referred to as the ambient pressure in the reservoir zone.

As to keeping fractures open, net pressure drives fracture growth and forces the walls of the fracture apart, creating a width suf cient to allow the entry of the fracturing slurry, which can be a slurry that is formed of various chemicals and proppant, which, as explained, tend to be in the form of solids that hold the fracture open after pumping stops. As to the chemicals, as explained, they can provide for properties that help to suspend the proppant (e.g., density modifiers, viscosity modifiers, etc.). Chemicals can include surface active agents (surfactants), which may be natural and/or synthetic.

As explained, once pumping is halted, the pressures inside a fracture subside as the uids either ow back into the well or leak away into the reservoir rock. Without proppant, this drop in pressure can result in closing of the fracture. Proppant helps to ensure that fractures stay open. Proppant tends to be utilized in sandstone or shale formations; whereas, in carbonate formations, acid may be utilized where, when pumped into the fractures, the acid etches the formation, creating arti cial roughness. As an example, proppant may be utilized in a reservoir that is a carbonate reservoir (e.g., a carbonate reservoir formation).

The stimulation treatment terminates when operators have completed their planned pumping operations or, for example, when a sudden rise in pressure indicates that a screenout has taken place. A screenout is a type of blockage, for example, caused by bridging—accumulation, clumping or lodging—of the proppant across the fracture width that restricts uid ow into the hydraulic fracture.

For various types of jobs, a slurry phase (e.g., a slurry step) is an operational phase that may be performed using a constant rate of fluid injection. For example, a rate of fluid injection (e.g., a pumping rate) may be determined and equipment controlled in an effort to maintain that rate. The volume injected includes the additional volume created during fracturing and the fluid loss to the formation from leakoff through the permeable wall of the fracture. However, the rate of fluid loss at the growing fracture tip can be quite high. As such, initiation of a fracture utilizes fluid without proppant because the high fluid loss would cause the proppant at the fracture tip to reach the consistency of a dry solid, causing bridging and screenout conditions. As explained, a pad phase (e.g., a pad step) can be an operational phase that utilizes fluid without proppant and a slurry phase can be a subsequent operational phase that utilizes proppant.

Design of a hydraulic fracture treatment benefits from establishing a leakoff rate and volume of fluid of a pad phase (e.g., a pad) in relation to the timing of slurry/proppant injection so that when the fracture reaches its desired length, height and width, the rst particle of proppant reaches the fracture tip. Design a hydraulic fracturing job entails understanding how pumping rate and stimulation uid properties affect hydraulic fracture geometry and propagation within the in-situ stress eld to achieve a targeted propped fracture length. As an example, one or more techniques may be utilized for fracture detection or cluster activation. For example, consider one or more of tubewave analysis, one or more fibers mounted with casing for distributed acoustic and/or distributed vibration sensing (DAS/DVS) and/or distributed temperature sensing (DTS).

Operators can design stimulation treatments to control fracture propagation and to ensure that the hydraulic fracture stays within the reservoir and does not grow into an adjacent formation (e.g., another zone, etc.). To reduce risk, monitoring can be performed to monitor fracture growth. As explained, fracturing uid forces the rock to crack and fractures grow, small fragments of rock break, causing microseisms (e.g., release of microseismic energy). Monitoring equipment (e.g., seismic energy receivers) can sense such emissions where sensed data can be analyzed to locate the sources of the microseisms in the subsurface. Such microseisms tend to track growing fractures. With knowledge of the direction of fracture growth, an operation may be able to take action to steer the fracture or to halt the treatment before the fracture grows out of the intended zone. The propagation of hydraulic fractures obeys the laws of physics. In-situ stresses tend to control the pressure and direction of fracture initiation and growth.

As an example, equipment at a wellsite can include monitoring and control equipment (M&C), which may be or include equipment such as the FracCAT equipment (Schlumberger Limited, Houston, Texas). The FracCAT equipment (a fracturing computer-aided treatment system) includes hardware and software for monitoring, controlling, recording and reporting various types of fracturing treatments. Its real-time displays, plots, surface schematics and wellbore animations present information of a treatment as it occurs, which can provide for decision making using real-time detailed job information from the surface to the perforations. As an example, a framework such as the FracCADE framework (Schlumberger Limited, Houston, Texas) may be utilized, which includes various components for fracture design and evaluation.

As an example, the system 200 of FIG. 2 can include or be operatively coupled to equipment such as, for example, the FracCAT equipment, and/or include or be operatively coupled to one or more frameworks such as, for example, the FracCADE framework. As an example, operational equipment can include FracCAT equipment operatively coupled to a Command and Control Center (CCC) computer. As an example, one or more computational frameworks may be utilized such as, for example, one or more of the KINETIX framework (Schlumberger Limited, Houston, Texas) and the FracCADE framework. The KINETIX framework can provide for reservoir-centric stimulation-to-production modeling that can integrate geology, petrophysics, completion engineering, reservoir engineering, and/or geomechanics, for example, for optimizing completion and fracturing designs for a well, a pad, or a whole field. As an example, one or more frameworks can be operatively coupled to or part of a framework such as the PETREL E&P framework (e.g., computational platform). As an example, one or more mechanical and petrophysical models may be utilized, optionally coupled with a reservoir simulator (e.g., ECLIPSE simulator (Schlumberger Limited, Houston, Texas), INTERSECT simulator (Schlumberger Limited, Houston, Texas), a geomechanics simulator (e.g., VISAGE finite-element geomechanics simulator (Schlumberger Limited, Houston, Texas), etc., in combination with the KINETIX framework. As an example, one or more methods can include automated parallel processing in the cloud where, for example, utilization of the KINETIX framework can provide for rapid assessment of well spacing, completion, and treatment design choices, enabling review of thousands of scenarios in a time frame of the order of hours.

As to the example plot 530 of FIG. 5, it shows treating pressure versus pumping rate and can be referred to as a treating pressure versus pumping rate curve (see, e.g., the block 240 of the system 200 of FIG. 2). As shown, the treating pressure increases with respect to the pumping rate.

As an example, the existing pressure versus rate curves for a similar formation can serve as a default starting point for an operation. As the real-time data come in during an actual fracturing job, the pressure-rate model can be updated with actual data (e.g., periodically, continuously, etc.).

Figure 6:
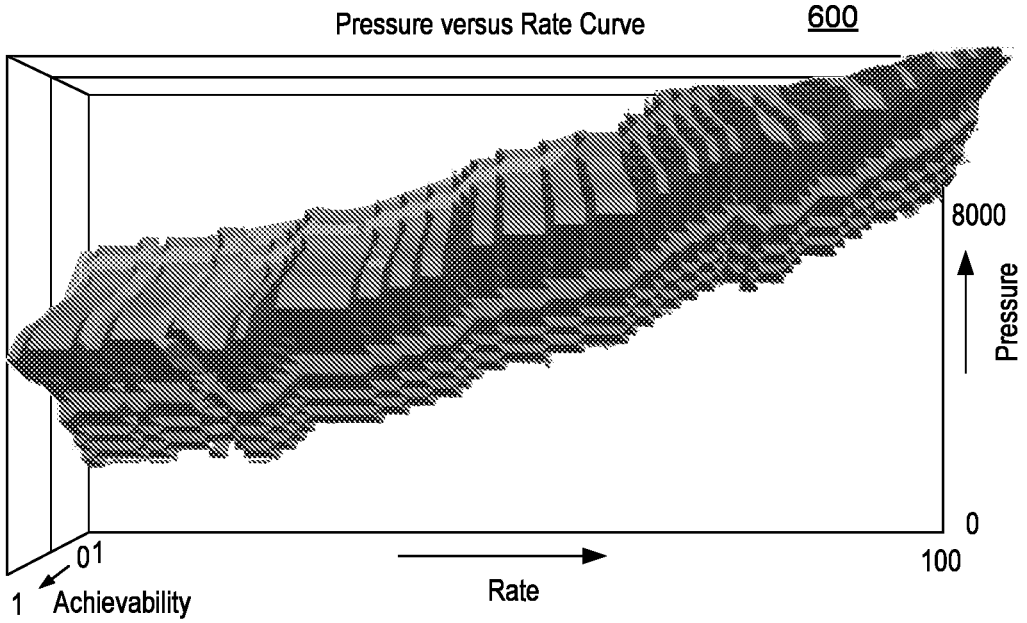
FIG. 6 illustrates an example of a performance belief model.

FIG. 6 shows an example plot 600 of a performance belief model for treating pressure versus pumping rate. As an example, an updated treating pressure versus pumping rate relationship can be represented by such a performance belief model.

The plot 600 can be job specific and may differ from job to job. As mentioned, a performance belief model can commence with a default curve where an algorithm updates it based on real-time feedback from various job parameters. In such an example, as the job progresses, learning can improve the model that helps the algorithm to decide how to respond to a well pressure change by adjusting pumping rate. For example, consider the models block 230, the predicted pressure block 234 of the control system 220 and the pumping rate adjustment block 236 of FIG. 2 as being operatively coupled to a performance belief model such that, for a well pressure change, the pumping rate adjustment block 236 can more appropriately control the one or more pumps 205 to improve performance of a job and/or for a new adjusted pumping rate, a change in pressure can be predicted, which may be utilized as feedback to the control system 220. As to the latter, again, consider the loop from the pumping rate adjustment block 236, to the upload block 242, to the model update block 244, to the upgrade block 246 to the models block 230, to the pressure predicted block 232 and back to the pumping rate adjustment block 236.

As an example, a curve or a series of curves can be generated, stored, etc., and be available to one or more wellsites, one or more planning site, etc. For example, consider the remote resources 290 being utilized for such purpose or purposes. As an example, one or more servers can provide access to equipment, operators, etc., at one or more sites. The location of each operational crew may determine which curve to use and, for example, a control system may intelligently select the best starting point curves.

As mentioned, the performance belief model that describes the relationship between treating pressure and pumping rate can be used to predict the pressure change for the new target rate. At the beginning of the job, the system can use the pressure versus rate curve from real jobs that have been performed, and the system can make adjustments during the process.

As an example, curves from the same basin can be chosen as a starting default (see, e.g., offset wells data 250). Then the possibility of new pressure can be updated during the job execution. In the plot 600, each grid represents the achievability under certain rate and pressure combination, which is scaled to a range between 0 and 1. The rate versus pressure belief model can start with curves from one or more other jobs performed in the same and/or similar basins. The curves can show along the x-axis the rate, y-axis the pressure, and z-axis the likelihood that a pressure will be reached for a desired rate (e.g., from 0 to 1, from 0 percent to 100 percent, etc.; noting that values may not reach 1 or 100 percent). One or more curves can start from default based on previous jobs and then be updated in real-time as new rate and pressure data are acquired for a current job. As mentioned, this can be accomplished using real-time data on pressure and rate, and utilizing such data as input to statistical and/or other equations that are used to create the pressure and rate belief curves.

Figure 7:
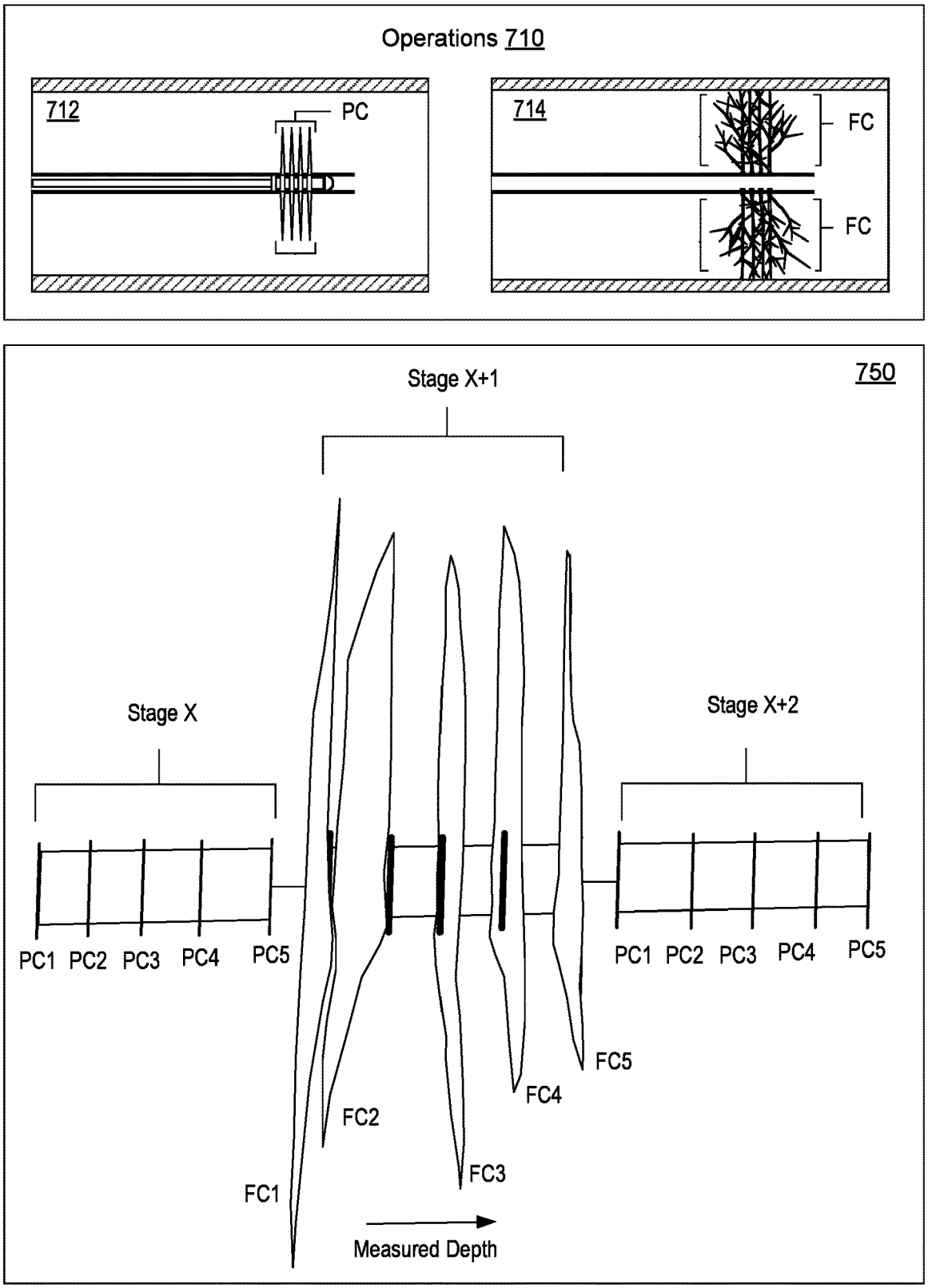
FIG. 7 illustrates examples of graphics of operations and an example of simulation results for a fracturing operation.

FIG. 7 shows example graphics of operations 710 and an example graphic 750 from a frac cluster simulation for fast ramp up. As shown, the operations 710 can include a perforation operation 712 and a fracturing operation 714 where the perforation operation 712 can generate a perforation cluster (PC) and where the fracturing operation 714 can generate a frac cluster (FC). As shown, the perforation cluster can be a cluster of perforations between an inner surface of a casing and a formation and the frac cluster can be a network that extends from one or more of the perforations into the formation. In the perforation operation 712, holes can be effectively shot through casing/cement in a "barber pole" pattern or a helix pattern around a wellbore.

As an example, a perforating gun can be of the order of 30 cm or more where multiple guns may be combined to make a longer perforation interval. In a post-perforating, pre-fracturing phase, a wellbore can include a number of perforation clusters (e.g., consider five as shown in the graphic 750) where each perforation cluster has a number of shots (e.g., holes). For example, consider 5 PCs, with 6 shots per PC, for a total of 30 perforations (e.g., 30 holes). As to fracturing, there can be equal number of FCs and PCs; however, there may be fewer FCs than PCs. As an example, a frac network (e.g., FC) generated from a corresponding PC can be of a particular size, shape, branching, etc., which can differ from others.

As to the graphic 750, it shows three stages of a multi-stage hydraulic fracturing operation where each stage includes a number of perforation clusters. For example, consider a number from one to ten or more. In the example shown, each of the stages includes five perforation clusters (PCs). The graphic 750 shows simulation results for the stage labeled X+1 where each of the five perforation clusters of that stage has a corresponding frac cluster. As shown in the graphic for the operation 714, a frac cluster for a single perforation cluster can be a network where, in the simulation results, the network is represented as a sheet, which can have a corresponding thickness. In the example of FIG. 7, the stage labeled X+1 generated frac clusters labeled FC1, FC2, FC3, FC4 and FC5. The results are from a simulation performed using test well data and an unconventional fracturing model (UFM) with a stacked height growth model, where the effect of stress shadow of a first initiated fracs on later fracs were not included in the breakdown calculation; however, such an approach can be utilized where, for example, determination of a stress shadow can be performed and taken into account for a well and/or an offset well. As an example, one or more simulations may utilize one or more computational frameworks such as, for example, a computational framework with one or more features of the MANGROVE framework, the KINETIX framework, etc. In the example of FIG. 7, the pumping schedule of the simulation used an initial break down at 15 bpm, with a quick ramp up to a treating rate of 90 bpm. The simulation shows that five frac clusters are generated from five corresponding perforation clusters of the stage X+1. The results indicate that each of the five perforation clusters (PC1, PC2, PC3, PC4 and PC5) fractured the formation with the quick ramp up.

Figure 8:
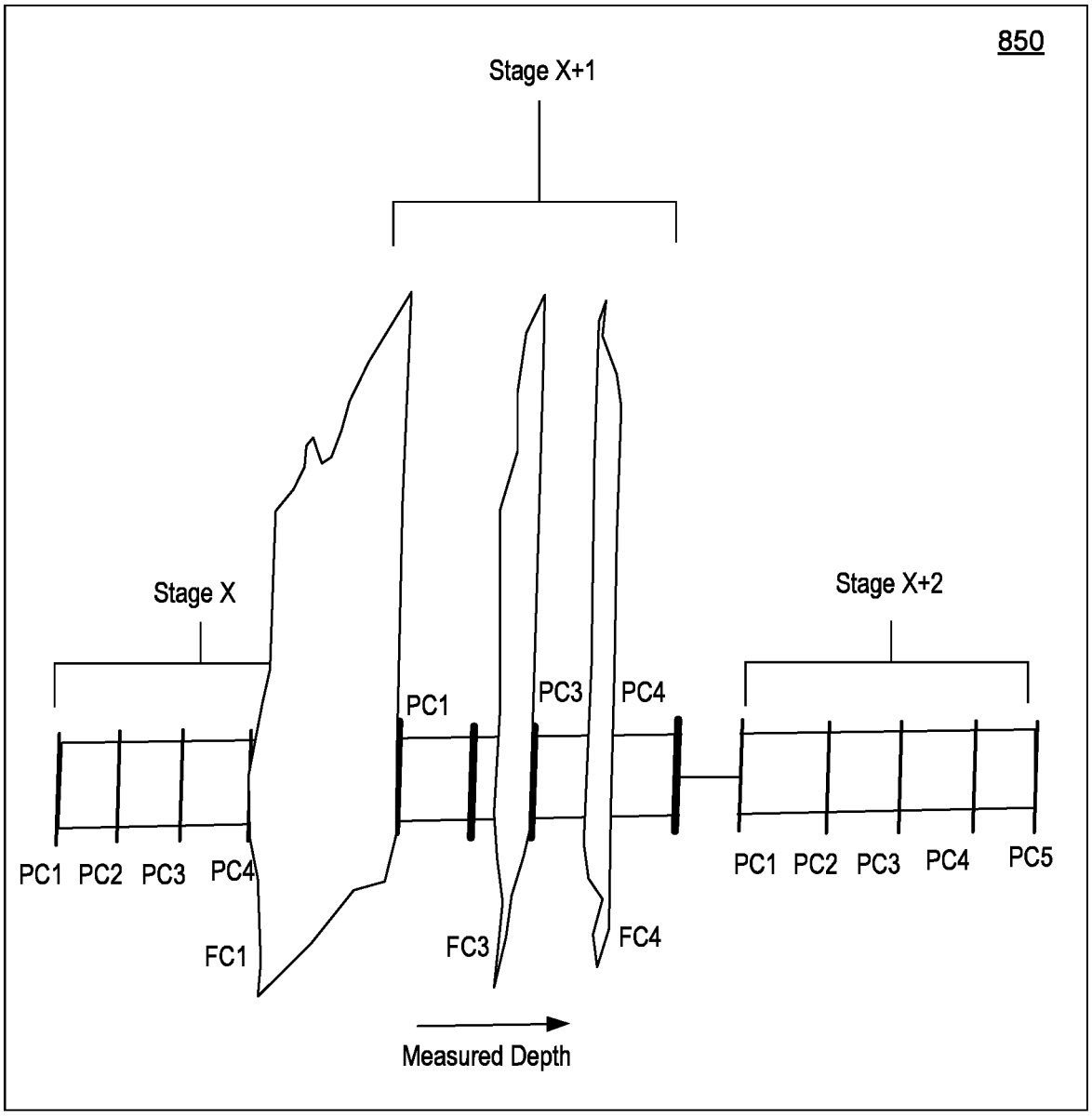
FIG. 8 illustrates an example of simulation results for a fracturing operation.

FIG. 8 shows an example graphic 850 from a frac cluster simulation for the same parameters as in the example of FIG. 7, but using a slow ramp up. The simulation was executed using the same parameters as in the example of FIG. 7, except the ramp up rate was more gentle (e.g., slower in time), and the simulation shows that three frac clusters (FC1, FC3 and FC4) are generated, which correspond to three of the five perforation clusters (PC1, PC3 and PC4). The results of FIG. 7 and FIG. 8 demonstrate how pumping can affect fracturing from perforations in a wellbore. As an example, one or more simulations can be performed where results can inform decision making as to one or more pumping rate adjustments (see, e.g., the block 236 of the system 200 of FIG. 2). In such an example, a pumping rate schedule may be determined to be optimal for generating desired frac clusters from perforation clusters and, for example, such a schedule may be adjusted as appropriate in real-time during a pumping operation to account for various conditions that may occur that can differ from those of one or more simulations. As an example, conditions can include conditions of equipment, conditions as to energy available for operation of equipment (e.g., fuel, etc.), conditions of a formation, conditions of fluid (e.g., injected fluid), conditions of a wellbore (e.g., quality of perforations, debris, etc.), etc.

Referring again to the system 200 of FIG. 2, the loop that includes the upload block 242 can be part of a process that can utilize one or more simulators (e.g., computational simulation frameworks) and other data to refresh one or more of the models of the models block 230. As shown, the loop can be a feedback loop, noting that the pumping rate adjustment block 236 is also in a control loop with the one or more pumps 205. Again, there is a link between pumping rate provided by the one or more pumps and pressure, where the one or more models of the models block 230 can output one or more model-based pressures. The accuracy of such models can be controlled using the loop that can be a partially external loop that utilizes one or more resources that can be external to the control system 220.

Results from one or more simulations as in FIG. 7 and FIG. 8 can be input into a system, a control system, etc. As an example, such simulation result or results can be input to the cluster and/or re-initiation block 280 (e.g., frac cluster generation and/or re-initiation). In such an example, one or more of the cluster and/or re-initiation block 280 and the performance belief model for treating pressure versus pump rate curve (see, e.g., the plot 530 of FIG. 5, the plot 600 of FIG. 6, etc.) can be utilized to determine an optimized ramp up rate to maximize frac clusters (e.g., compare the results in FIG. 7 and FIG. 8). As mentioned, as an example, an optimized ramp up rate can be a schedule, which can be utilized as a base schedule to which one or more adjustments may be made, optionally in real-time during an operation.

In one or more embodiments, a control system can be configured to provide real-time optimization of a fracturing operation using surface pressure measurements.

A limiting factor that can confound reliable use of surface treating pressure (e.g., well head pressure per the transducer 214, etc.) for diagnosis during hydraulic fracturing pumping operation can be uncertainty and inaccuracy of estimated pipe friction, which can result in errors in a computed bottom hole pressure, which, in turn, can result in erroneous interpretation of fracture growth behaviors.

One reason for uncertainty and/or inaccuracy in estimated pipe friction relates to the fact that fracturing fluid includes one or more chemicals that can act as friction reducers, which may be one or more polymers that help to reduce pumping pressure and hydraulic horsepower demand for the treatment, as well as to provide viscosity to help suspend and transport the proppant deep into the induced hydraulic fracture.

The friction characteristics of the fracturing fluid tends to be quite sensitive to composition and amount of chemical additives and, at times, even the batches of the chemicals supplied, as well as the quality and the mineral contents in the water used to mix the fluid. Furthermore, pipe friction may also depend on pipe roughness, especially for slick water that tends to be used in fracturing of unconventional reservoirs. As a result, the pipe friction of a fracturing fluid can vary substantially at the job site for the same specified fluid recipe.

Furthermore, the overall frictional pressure drop when the fluid is pumped into the fracture at a designed rate tends to be greater than the so-called net pressure, defined as the fluid pressure in the fracture (e.g., the bottom hole pressure minus the near-well friction) subtracting the in-situ stress, which is the pressure that tends to be analyzed in various pressure analysis techniques. Therefore, small errors in the friction pressure can overshadow the net pressure changes that such techniques intend to analyze. This can be particularly of interest for fracturing treatment of a multi-clustered completion in an unconventional reservoir as a relatively high pump rate is demanded to propagate multiple fractures from perforation clusters simultaneously, leading to a quite high pipe friction (e.g., consider a scenario where multiple perforation clusters of a stage are to be utilized simultaneously for flow of fluid from a wellbore into a formation).

In addition, direct measurement of bottom hole pressure with downhole pressure gauges tends to be uncommon in horizontal multi-stage fractured wells due to cost and operation complications, and pressure data that can be retrieved after the planned stages are completed; rather than being accessible during the job to aid real-time decisions. In some instances, direct bottom hole pressure measurement can also be obtained where there is a coiled tubing (CT) deployed in the well while hydraulic fracturing is taking place, but that too tends to be uncommon due to higher operating cost of having a coiled tubing unit on location while fracturing. As an example, some wells may include a dead string, which is made of jointed tubulars; however, a dead string is relatively uncommon in unconventional completions.

Figure 9:
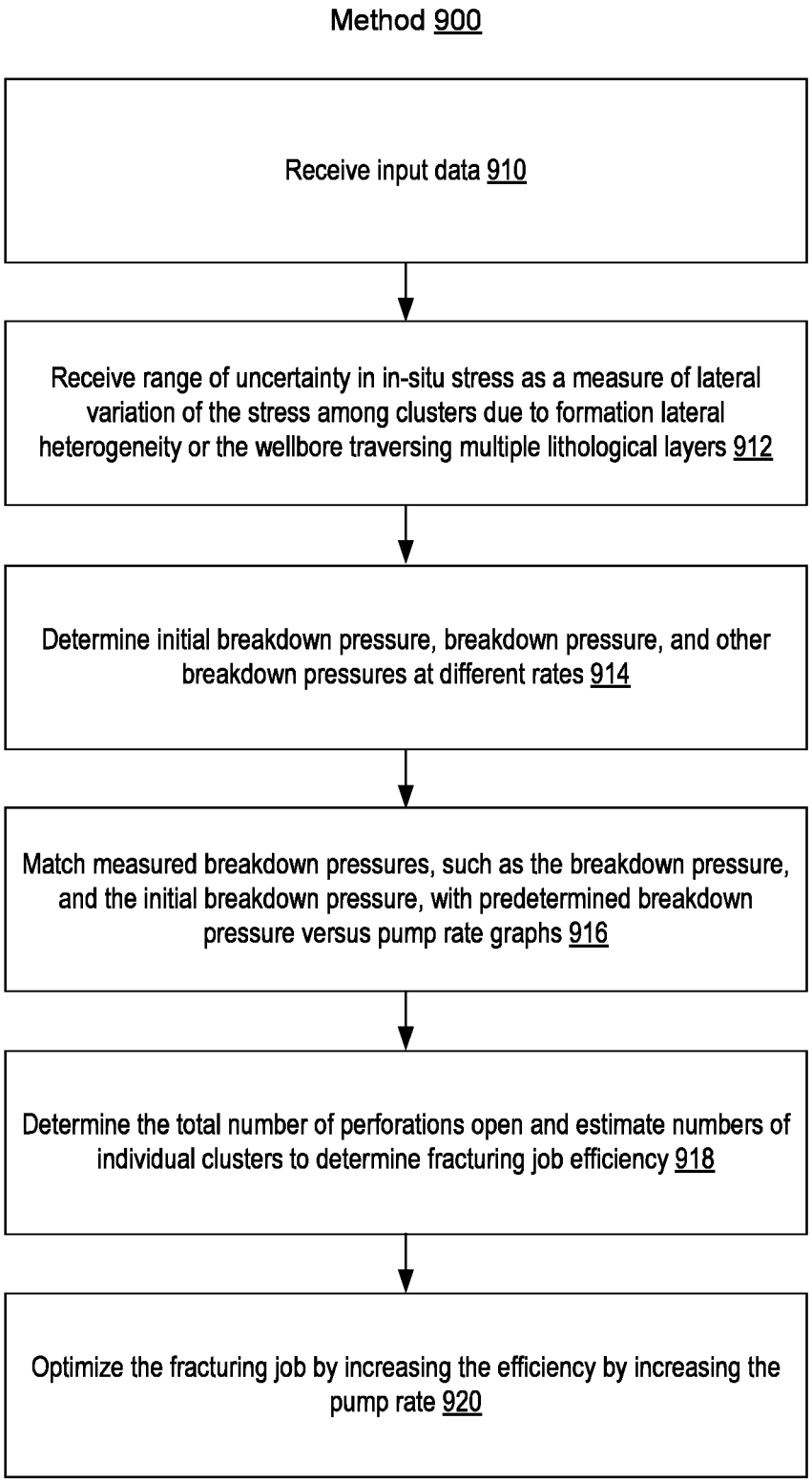
FIG. 9 illustrates an example of a method.

FIG. 9 shows an example of a method 900 that can be utilized to overcome uncertainty in a fracturing fluid's friction characteristics that largely renders calculated bottom hole pressures of little use in real-time diagnosis of fracturing operations. The method 900 can be implemented, for example, by a system such as the system 200 of FIG. 2 (see also, e.g., the system 2800 of FIG. 28). As an example, the control system 220 can include features suitable for execution of the method 900.

As shown, the method 900 can include a reception block 910 for receiving input; a reception block 912 for receiving a range of uncertainty in in-situ stress as a measure of lateral variation of the stress among clusters due to formation lateral heterogeneity or the wellbore traversing multiple lithological layers; a determination block 914 for determining an initial breakdown pressure, breakdown pressure and/or other breakdown pressures at different rates; a match block 916 for matching measured breakdown pressures, such as the breakdown pressure, and the initial breakdown pressure, with predetermined breakdown pressure versus pump rate graphs; a determination block 918 for determining the total number of perforations open and estimating numbers of individual clusters to determine fracturing job efficiency; and an optimization block 920 for optimizing the fracturing job by increasing the efficiency by increasing the pump rate.

The method 900 can allow for calibrating the friction pressure drop during the first few stages of a horizontal well, so the friction pressure can be determined accurately, and then using the calibrated friction pressure characteristics for the subsequent stages of the well to compute reliable bottom hole pressure to allow diagnosis of the fracture propagation behaviors in real-time and adjustment of one or more pumping parameters as appropriate to optimize the job.

Figure 10:
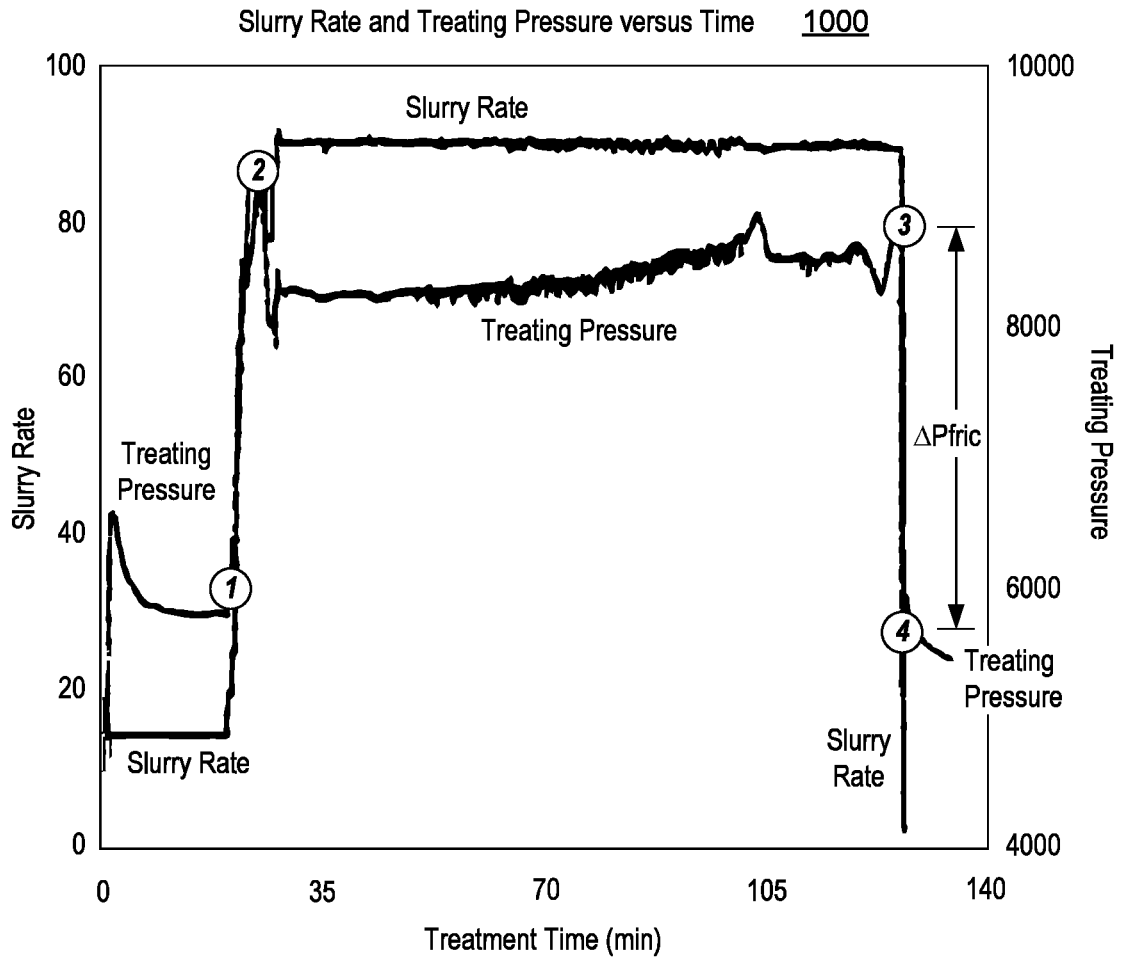
FIG. 10 illustrates an example plot of dynamic pressure and flow data.

FIG. 10 shows an example plot 1000 of slurry pumping rate and treating pressure record versus treatment time for a fracture treatment for one of multiple stages in a horizontal well in an unconventional reservoir.

In plug and perf completion operation, a fracturing operation can involve pumping a ball at a low rate to land the ball at the pump-down isolation plug already placed in the well above a previously fractured stage to isolate the current treatment stage from the one or more previous fractures. Upon the landing of the ball on the plug, a seal can be formed such that fluid has nowhere else to go other than into the perforations in the current stage and initiates one or more fractures from the perforations. An initial breakdown pressure at this low pump rate can be identified from the treating pressure. Once the ball is landed, the pump rate can be ramped up to the treating rate and the breakdown pressure at the treating rate can be identified, as shown in the plot 1000 of FIG. 10. The initial breakdown pressure and breakdown pressure at the main treating rate can be determined when the control system 220 identifies that the peak pressure for each rate that is followed by a decline.

As an example, the ISIP can be determined by extrapolation of a stabilized pressure decline slope to shut-in. As mentioned, data acquisition can occur using one or more sensors and a suitable acquisition system with a sufficiently high data acquisition rate. In the example of FIG. 10, ISIP reflects the instant change of the total friction along the fluid flow path as the rate drops to zero. This includes the pipe friction, perforation friction, and possibly friction pressure loss in the near well region of the fracture (also known as "tortuosity" as illustrated in the plot 1430 of FIG. 14). At the end of hydraulic fracture treatment, assuming no premature near well proppant bridging or screenout, the perforations have been severely eroded by proppant so the perforation friction has substantially reduced from its original values, and so is near well fracture tortuosity. Therefore, the instantaneous pressure drop ($\Delta$Pfric) can be assumed to be attributed to pipe friction; accordingly, the frictional pressure gradient for a given fluid at the given pump rate, can be determined as instantaneous pressure drop ($\Delta$Pfric) divided by the pipe length.

As explained, friction pressure at a given pump rate can be determined from the surface pressure change when the pump is shut down. As shown in the plot 1000 of FIG. 10, at the end of the job when the pump is shut in, the surface treating pressure experiences an instant pressure drop to a pressure that is referred to as "instantaneous shut-in pressure", or ISIP. Oftentimes, immediately after the shut in, the pressure experiences a short period of rapid oscillations referred to as "water hammers" as the pressure wave echoes in the wellbore. In this case, extrapolation of the later stabilized pressure decline slope to the time of shut-in can be determined as the ISIP. As an example, one or more types of data filtering techniques may be applied to address effects of phenomena such as water hammers (e.g., to generate filtered data, etc.). As shown in the plot 1000 of FIG. 10, the difference between the pressure immediately prior to the shut-in and the ISIP reflects the instant change of the total friction along the fluid flow path as the rate drops to zero (see, e.g., labeled points 3 and 4). As mentioned, this can include the pipe friction, perforation friction and possibly frictional pressure loss in the near well region of the fracture (also known as "tortuosity" as illustrated in the plot 1430 of FIG. 14). At the end of hydraulic fracture treatment, assuming no premature near well proppant bridging or screenout, the perforations have been severely eroded by proppant so the perforation friction has substantially reduced from its original values, and so is near well fracture tortuosity. As an example, an instant pressure drop, as indicated as $\Delta$Pfric in FIG. 10, can be reasonably assumed to be attributed to the pipe friction. Therefore, as mentioned, the frictional pressure gradient for the given fluid at the given pump rate, can be determined as instantaneous pressure drop ($\Delta$Pfric) divided by pipe length (see also, e.g., the plot 1230 of FIG. 12).

As an example, a horizontal well can be discreetly stimulated (e.g., subdivided for discretion stimulation operations)

into stages, which can, for example, range in number from a few to nearly 100. As an example, a multi-stage horizontal well may use a common fracturing fluid recipe. Based on this consideration, a method can determine the friction pressure of the fluid accurately from measured pressure responses in early stages (e.g., the first few stages) and use a calibrated friction pressure to compute much more accurate bottom hole pressures for subsequent stages, which may allow operators and/or computation equipment to perform one or more pressure diagnoses to optimize treatments in the subsequent stages in the same well.

Figure 11:
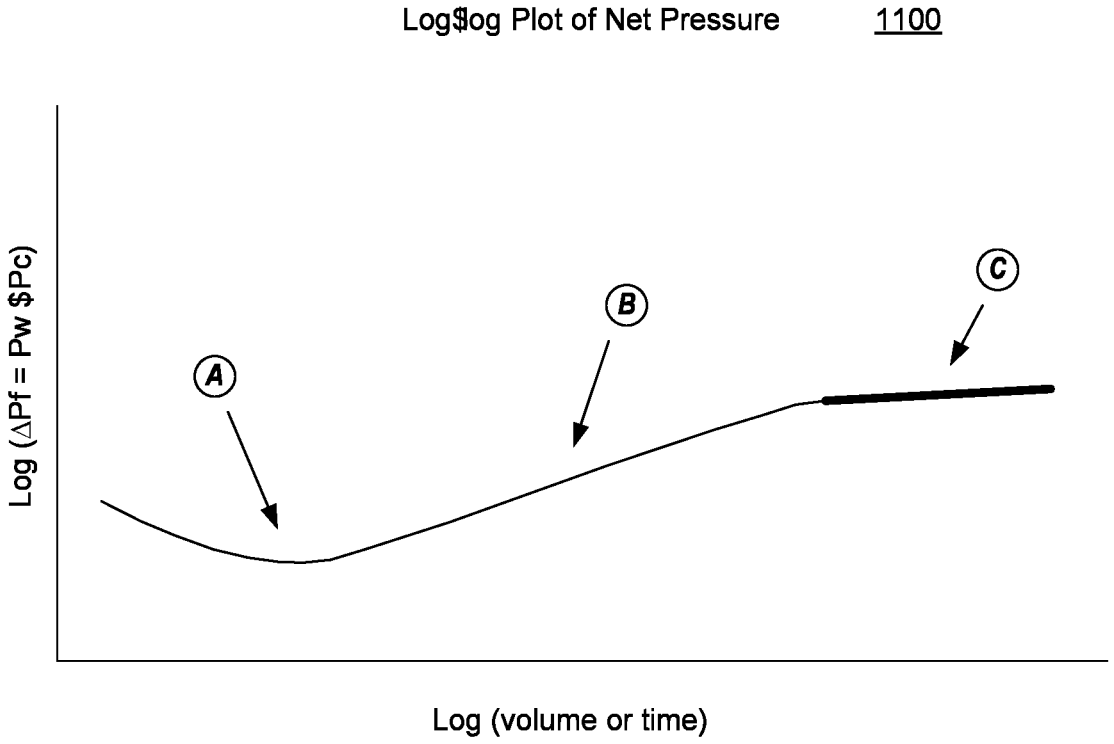
FIG. 11 illustrates an example of an analysis of pressure data for physical phenomena.

FIG. 11 shows an example plot 1100 that is a log-log plot according to a diagnosis technique (Nolte and Smith) based on the slope of net pressure versus time (or volume), which can be used to determine the behaviors of fracture growth.

As mentioned, the plot 1100 of FIG. 11 shows the diagnosis proposed by Nolte and Smith based on the slope of net pressure versus time in a log-log plot, which can be used to determine the behaviors of the fracture growth. For example, a negative slope (marker A in FIG. 11) indicates a radial fracture growth or excessive height growth; a positive slope of approximately 0.2 (marker B in FIG. 11) indicates the fracture height is contained and it is extending its length; a positive slope of 1 or greater indicates screenout; a slope that is nearly flat (marker C in FIG. 11) indicates fracture height growth; and so on.

Further, a comparison may be made for computed bottom hole pressure of the current treatment with a similar treatment in a previous stages in real-time to detect any abnormal pressure trend or deviation from the normal trend. The pressure responses of the previous jobs that screened-out may be analyzed to find one or more common signatures that may indicate imminent job failures. As an example, one or more data science techniques can be used to train a computing system to identify such anomalies and deviations so they can be automatically detected by the computing system to warn a controller and/or an operator of risk of potential screenout or other undesirable events.

Figure 12:
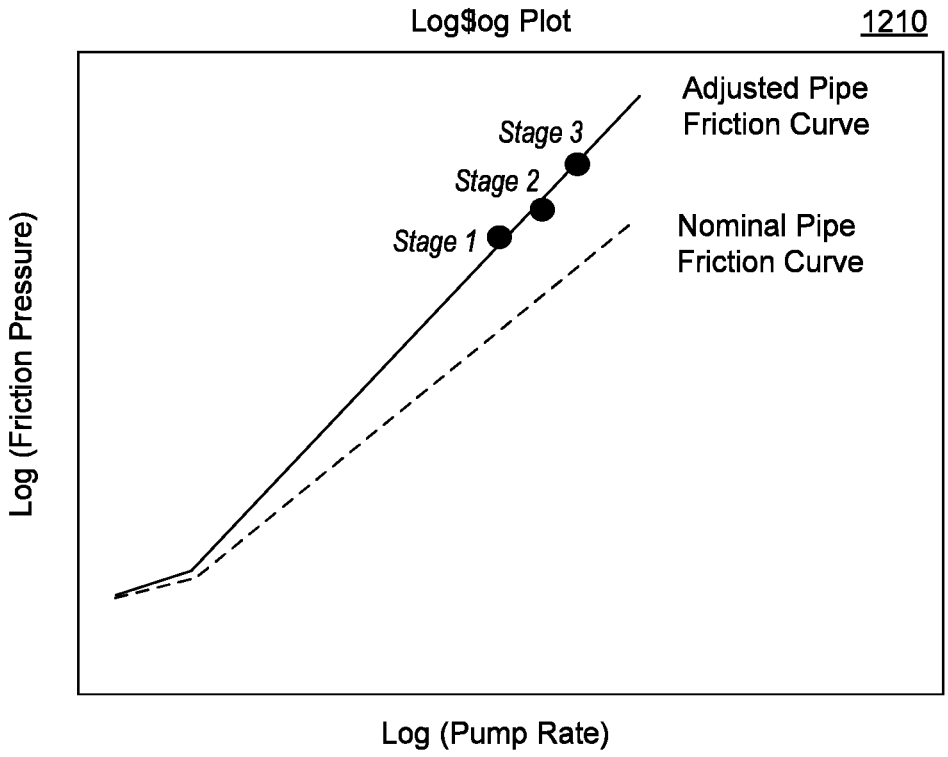
FIG. 12 illustrates examples of plots of data for estimates of friction pressure.
Figure 12:
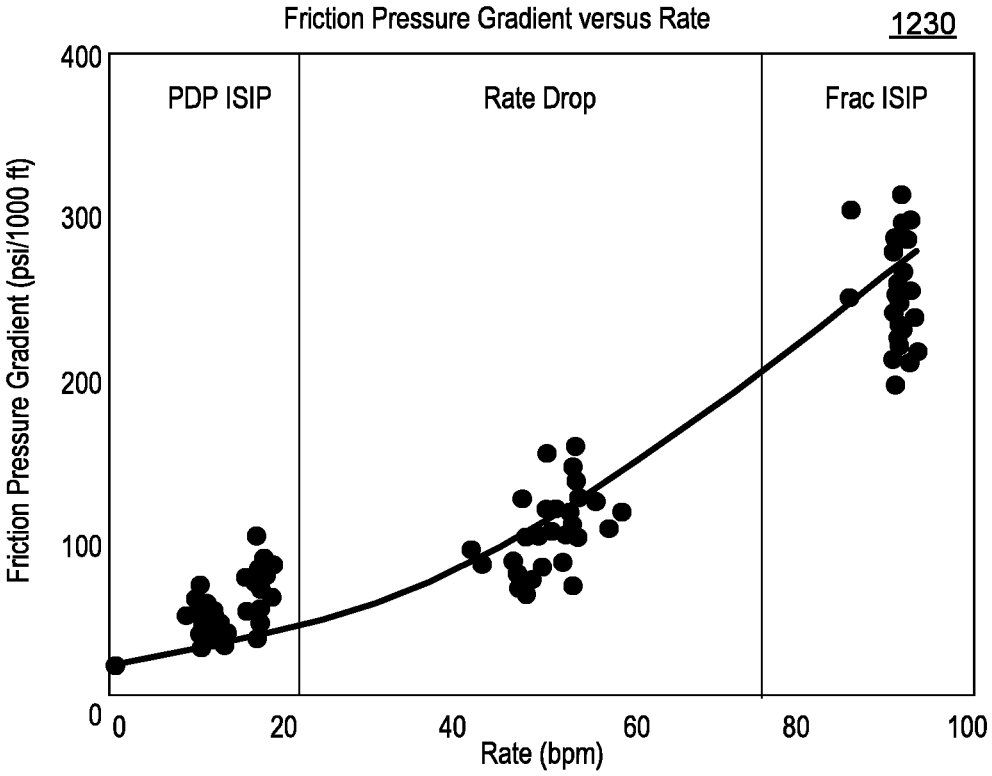

FIG. 12 shows an example plot 1210 and an example plot 1230. As shown, the plot 1210 is a log-log plot of friction pressure points determined from the pressure drop at instantaneous shut-in pressure (ISIP) for the first few stages (stages 1, 2 and 3), which can be used to adjust a friction pressure curve to obtain more accurate friction estimates.

As to the plot 1230, it shows friction pressure data at low pump rates collected from pump down plug operations (e.g., PDP operations) and intermediate pump rates from rate drop at the end of the pumping, and the friction curve over the entire range of pump rate that fits the data points. In the example plot 1230, the friction pressure gradient is given in units of pounds per square inch (psi) per 1000 feet, while the pump rate is given in units of barrels per minute (bpm). As shown, various types of data can be associated with various ranges of pump rate (e.g., pumping rate). As an example, data can be acquired during one or more operations and plotted or otherwise analyzed to determine one or more friction pressure values (e.g., friction pressure, friction pressure gradient, etc.).

As illustrated in FIG. 12, the accuracy of the friction curve shown in the plot 1210 of FIG. 12 can be further improved if there are additional friction pressure data points at lower pump rates. Such data can be obtained from the measured pressure when pumping down, for example, the bridge plug-perforating gun assembly, referred to as Pump-Down Plug (PDP), after the fracture stimulation treatment of each stage is completed, in preparation for the stimulation of the subsequent stage. A PDP can be deployed into a well on a wireline and be pumped using fluid pressure to a target measured depth in a horizontal section at a relatively low pump rate. When the pump is shut down as it reaches the target measured depth, the pressure drop at shut-in can provide an indication as to the friction pressure at the low pump rate.

Furthermore, as illustrated in FIG. 12, additional friction pressure data can be obtained in the mid-pump rate range by taking one or two intermediate rate steps at the end of the pumping for the fracture treatment, as opposed to instant shut down shown in FIG. 10. Combining data points can allow construction of a more accurate and reliable friction curve that more fully covers the entire pumping rate range, as illustrated in the plot 1230 of FIG. 12.

Figure 13:
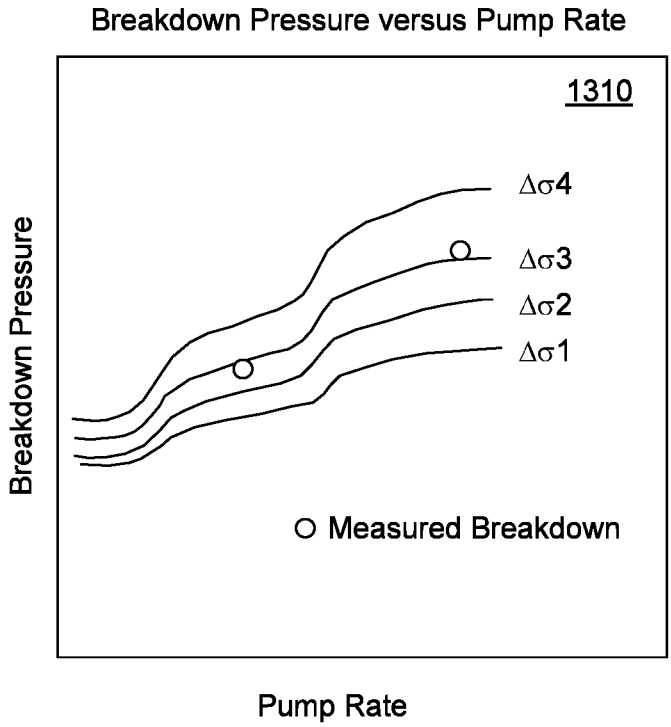
FIG. 13 illustrates examples of plots of a method.
Figure 13:
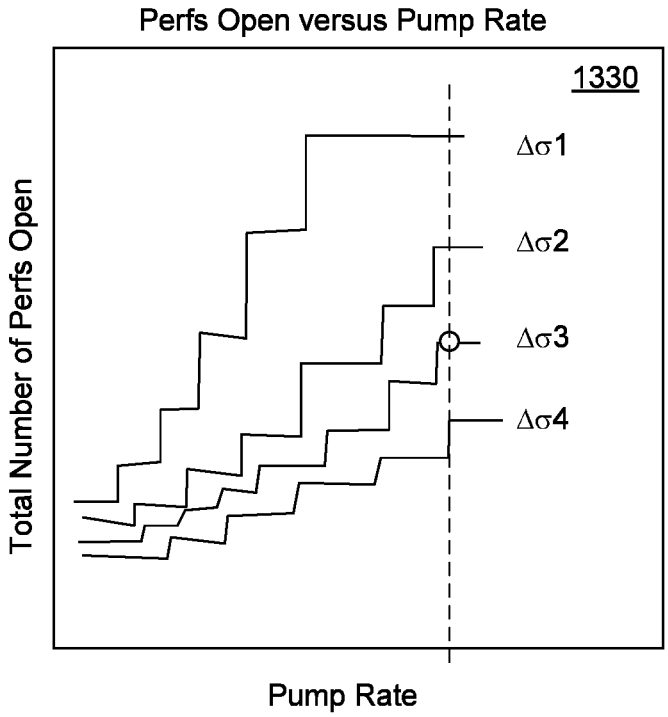

FIG. 13 shows an example plot 1310 and an example plot 1330 as to a method for estimating the number of perforations open from the measured breakdown pressure. The plot 1310 shows multiple breakdown pressure curves generated for different degrees of assumed variation of stresses and the plot 1330 shows the computed number of perforations open corresponding to the curve that best fit the measured breakdown pressure.

As mentioned, FIG. 13 shows plots 1310 and 1330 as illustrating aspects of a method for estimating the number of perforations open from the measured breakdown pressure; (a) multiple breakdown pressure curves generated for different degrees of assumed variation of stresses (indicated by $\Delta\sigma$ values) among the perforation clusters, with overlaid measured breakdown pressure(s); (b) the computed number of perforations broken down corresponding to the curves in (a). Due to the uncertainty in the in-situ stresses and rock properties, the estimated number of perforations broken down also inherit some uncertainties. If an independent estimate using an injection test such as a step down test is available, it can provide additional data points to calibrate/refine the initiation model described above.

As an example, when a well is shut-in, the instantaneous shut-in pressure (ISIP) ($\sigma_{Hmin}$) can be determined from the measured pressure decline curve. The difference between the bottom hole pressure before shut-in and the ISIP is the sum of the pressure losses due to perforation friction and the near wellbore tortuosity. Tortuosity (e.g., a type of near-wellbore pressure loss (NWPL)) can then be obtained by subtracting the perforation friction pressure loss, $\Delta p_{perf}$, from the instantaneous pressure drop.

As mentioned, the plot 1210 of FIG. 12 shows friction pressure versus pump rate on a log-log plot. At high pump rate, the flow in the casing or tubing is turbulent and the pipe friction tends to follow a straight line. The friction pressure gradient at the treating rate determined at the shut-in gives a single point on the plot 1210. Such an approach allows the friction curve to be recalibrated to match the observed friction pressure. As an example, one or more data points can be obtained at one or more subsequent stages, for example, further refining the friction curve. Such an approach can also provide a sense of the uncertainty, as illustrated in FIG. 12. If there are no substantial changes in chemical batches and precise equipment controls are achievable, the friction behavior of the fluid can be repeatable from stage to stage. As already mentioned, the bottom hole pressure can be computed using the following equation:

$$Pw=Pb-Ph+Pf$$

where Pb is the calculated bottom hole pressure, Pw is surface measured treating pressure, Ph is the hydrostatic head of the fluid column, and Pf is the computed friction pressure using the calibrated friction curve shown in FIG. 12.

To obtain a true net pressure response, the perforation friction and near wellbore tortuosity can be excluded from the measured or computed bottom hole pressure. If one can estimate the perforation friction and tortuosity components, they can be excluded from the bottom hole pressure to allow proper pressure diagnosis.

The tortuosity can be used as an indicator for potential near wellbore problems. For example, a high (e.g., >500 psi) tortuosity can indicate some potential near wellbore problems and a risk of premature screen-out.

As tortuosity can be representative of width restriction inside the fracture, separating tortuosity from the perforation friction pressure drop can provide additional information regarding the near wellbore condition. As an example, the perforation friction pressure loss can be proportional to Q squared ($Q^2$), while the NWPL can be approximately proportional to the square root of Q ($Q^{1/2}$).

Figure 14:
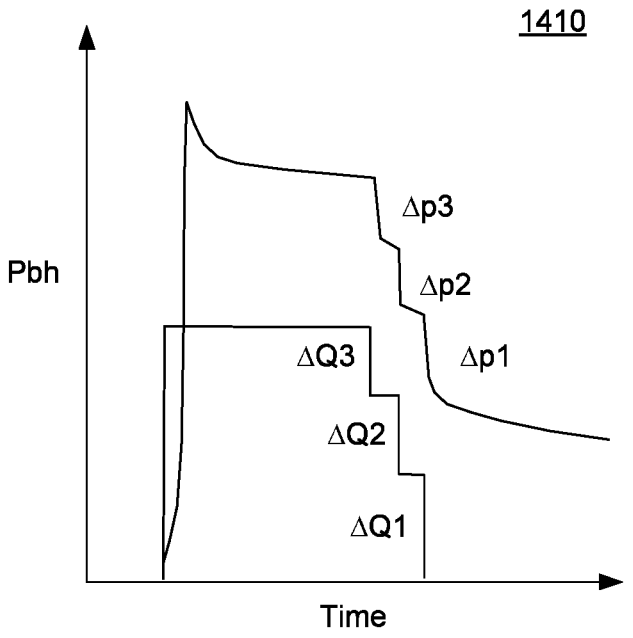
FIG. 14 illustrates examples of plots of a method for a step down test and behavior of a hydraulic fracturing operation.
Figure 14:
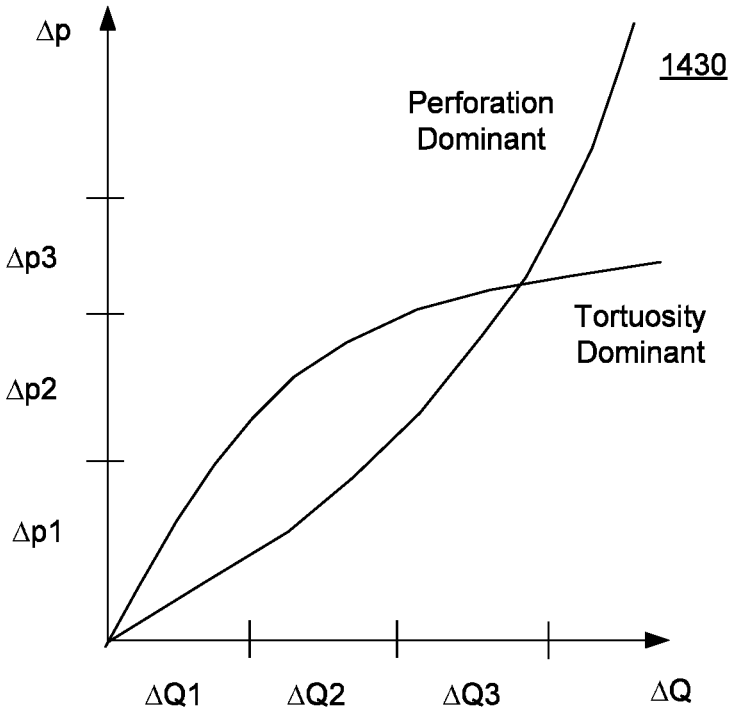

FIG. 14 shows an example plot 1410 and an example plot 1430, which correspond to a step down test. As shown, the plot 1410 includes changes in pressure and changes in flow rate versus time where those changes are plotted in the plot 1430 to determine whether there is perforation dominant behavioral characteristics in the operation as to fluid interactions in the subterranean environment (e.g., reservoir zone) and/or whether there is tortuosity dominant behavioral characteristics in the operation as to fluid interactions in the subterranean environment (e.g., reservoir zone). Therefore, if the instantaneous pressure drop is available at multiple pumping rates, a plot of pumping pressure-drop with flow rate drop as shown in the plots 1410 and 1430 of FIG. 14 (step-down test) may provide an indication as to whether the pressure drop is predominantly by perforation friction or by tortuosity.

As mentioned, FIG. 14 shows the plot 1410 of a pressure response from a step down test, in which the pump rate is decreased in steps (e.g., 1, 2 and 3) until complete shut-in and the corresponding bottom hole pressure response (which can again be more accurately computed from the surface pressure by adjusting the pipe friction using the procedure described earlier in this disclosure). As shown in the plot 1430, by plotting the pressure drop against the rate drop, the response curve can be matched to give an estimate of the number of perforations open and the pressure loss due to near-well fracture tortuosity. As explained, physical phenomena can be proportional to flow rate such as may be represented by $Q^n$, where n is a factor that can be less than unity or greater than unity (e.g., possibly negative). As explained, for perforation dominant behavior, n can be approximately 2 (e.g., greater than 1), and, for tortuosity dominant behavior, n can be approximately 0.5 (e.g., less than 1).

To construct the curves shown in the plot 1430 of FIG. 14, an engineer may pick a point with stabilized pressure corresponding to each pump rate step on the pressure curve shown in the plot 1410 of FIG. 14. Such a manual approach can make the process time consuming and subject to human error.

As an example, the system 200 can include one or more blocks that can perform a step rate test and/or a step rate test analysis, which can optionally be automated, for example, where computational resource(s) pick the pressure-rate step points. In such an example, one or more step rate tests can be integrated into a pumping treatment plan without adding a substantial amount of time to the fracture operation. Such an approach can, for example, provide the benefit of additional data points to calibrate/compliment an estimate from a method using breakdown pressures as described.

As an example, an operation can take one or more actions to mitigate near wellbore issues, for example, by pumping proppant slugs to erode near wellbore areas. Such an approach can widens the flow path and reduce tortuosity. As an example, in scenarios where multiple fractures are created, proppant slugs may also help plugging some of the minor fractures and thereby help to allow a desired main fracture to propagate.

Referring again to the method 900 of FIG. 9, as explained, various actions can be performed for determining the number of perforations and clusters contributing to flow. Such actions can include one or more actions as described with respect to FIGS. 10, 11, 12, 13 and 14. For example, consider uncertainty in in-situ stress and determining one or more breakdown pressures at one or more rates.

As explained, the perforation friction pressure loss can be proportional to Q squared ($Q^2$) (see the plot 1430 where perforation dominant curves upwardly toward a vertical asymptote (e.g., concave)) while the tortuosity can be approximately proportional to the square root of Q ($Q^{1/2}$) (see the plot 1430 where tortuosity dominant curves toward a horizontal asymptote (e.g., convex)).

Referring again to the control system 220 of FIG. 2, the models block 230 includes Pb (e.g., bottom hole pressure or Pbh) and includes Pf (e.g., friction pressure caused by the flow of the fluid). As an example, one or more of the actions described with respect to FIGS. 10, 11, 12, 13 and 14 may be utilized to inform, update, upgrade, etc., one or more of the models of the models block 230.

With reference to FIGS. 10, 11, 12, 13 and 14, during initiation of a job the control system 220 can be configured to generate data such as data for a graph of pressure to fracture initiation in a stage of the fracturing operation. The control system 220 can, for example, graph, and in some embodiments display the graph on a user interface, the pressure during the first stage and determine initial breakdown pressure at a lower rate, the breakdown pressure at the treating rate, the instant pressure drop (ΔPfric), and, instantaneous shut-in pressure (ISIP).

In an actual pumping schedule, proppant can be added to the fracturing fluid at increasing concentrations. As added proppant travels in a long wellbore, the proppant concentration varies at different well depths. To properly track fluid and slurry movement and proppant concentration in the well, the control system 220 can include a hydraulics algorithm (e.g., a hydraulics block, a hydraulics framework, etc.) to accurately compute the above pressure components.

The bottom hole pressure during fracture propagation can be expressed as follows:

$$Pbh=\sigma h+P\text{net}+\Delta P\text{perf}+\Delta P\text{tort}$$

where σh is the in-situ minimum horizontal stress (e.g., $\sigma_{Hmin}$), ΔPperf is the pressure drop through the perforations, and ΔPtort is the pressure loss in the near well region due to fracture tortuosity, and Pnet is net fracturing pressure that is dependent on formation properties and pumping rate and exhibits different time evolution for different growth patterns.

Another method that can be conducted using the control system can include computing a pre-stage ISIP (low rate of approximately 12 bbl/min), and computing a post-stage ISIP. The fracturing operation can be optimized by correlating or comparing the pre-stage ISIP for each stage of the job with previous ones. If a current pre-stage ISIP is higher than the pre-stage ISIPs from the stages (e.g., according to a threshold, a percentage, etc.), it may indicate perforation placement in a higher stress zone and has a higher risk of screenout that warrants changes in pumping parameters such as increasing fluid viscosity, reducing proppant concentration, or other measures, to reduce the likelihood of screenout. As another example, if the pre-stage ISIP is lower than the previous stages (e.g., according to a threshold, a percentage, etc.), it may indicate that a new zone has been penetrated. Depending on the reservoir settings, this may also lead to possible near well restrictions and higher risk of screenout, or undesirable fracture height growth. As an example, one or more appropriate adjustments to the pump parameters may be conducted accordingly.

As an example, a treatment may or may not start with a lower pump rate to initiate the fracture, to "breakdown" the formation. The breakdown pressure tends to refer to the peak pressure in the initial stage of the pumping, followed by a pressure decline once fracture(s) are created and start propagating. During the treatment, the treating pressure moves up and down, resulting from changes in pump rate, fluid changes, increase in slurry density and its friction as proppant is added to the fluid, decrease in density and friction as the job goes to flush, decrease in perforation friction (pressure drop through perforations) due to erosion by proppant, and lastly the pressure changes associated with fracture propagation. Often times, it is the pressure change in the fracture that an operator may be interested in deciphering to get an understanding of how a fracture behaves, for example, to make decisions in real-time to change pump rate or go to flush when premature screenout is occurring, change the job parameters to reduce fracture height growth or to extend the length, or pump diversion slugs, etc.

Referring again to the method 900 of FIG. 9, the method 900 can include entering input data to the control system 220 per the block 910 where the input data can include, for example, formation properties, wellbore deviation, orientation and sizes, pumping information, and estimated in-situ stresses. The data can be provided to the control system 220 optionally using a cloud server or the like (see, e.g., the remote resources 290) that has the parameters installed therein, from an operator, or other technique.

The method 900 can also include providing a range of uncertainty in the in-situ stress as a measure of lateral variation of the stress among the clusters due to formation lateral heterogeneity or the wellbore traversing multiple lithological layers, as shown in the block 912. As an example, uncertainty in the in-situ stress as a measure of lateral variation of the stress among the clusters due to formation lateral heterogeneity or the wellbore traversing multiple lithological layers can be determined using one or more techniques.

The method 900 can also include determining the initial breakdown pressure, breakdown pressure, and other breakdown pressures at different rates, as shown in the block 914. As an example, the breakdown pressures can be determined as discussed with respect to FIG. 10 (see also, e.g., FIG. 5).

The method 900 can also include matching measured breakdown pressures, such as the breakdown pressure, and initial breakdown pressure, with predetermined breakdown pressure versus pump rate graphs, for example, per the block 916. In FIG. 13, the plot 1310 depicts the predetermined breakdown pressure versus pump rate graphs with measured breakdown pressures plotted thereon. As an example, a system may generate one or more predetermined graphs of breakdown pressure versus pump rate by using data from the same and/or similar formations, physics models, logs, and formation properties and uncertainties.

The method 900 can include determining the total number of perforations open and the estimate numbers of individual clusters to determine fracturing job efficiency per the block 918. For example, the control system 220 can do this by using the curve on the predetermined graph of breakdown pressure versus pump rate that matches the measured breakdown pressure and matching it to the total number of perfs open that corresponds to the matched breakdown pressure curve (see, e.g., the plots 1410 and 1430 of FIG. 14). A predetermined graph of total number of perfs open versus pump rate can be determined, for example, using a fracture initiation model, data from the same and/or similar formations, logs, and formation properties.

The method 900 can optimizing the particular fracturing job by increasing the efficiency by increasing the pump rate per the block 920 (see also, e.g., the pumping rate adjustment block 236 of the control system 220 of FIG. 2).

As an example, in one or more embodiments, the control system 220 can also be in communication with a hopper having diversion pills and can adjust a valve to allow diversion pills to be provided to the fracturing fluid to be pumped into the formation and and/or an operator may be instructed by the control system 220 (e.g., output therefrom) to add diversion pills.

The control system 220 can also use the estimated number of open perforations and associated perforation friction to adjust the bottom hole pressure for pressure diagnosis to allow further optimization of the treatment during the job.

As an example, the control system 220 of FIG. 2 may be calibrated using one or more outputs of an analysis such as the analysis shown in FIG. 14 (e.g., as to step down testing).

As an example, a system can provide for automated fracturing by managing a pump fleet to increase asset utilization and identify pumps that are not operating at an optimal level. Such a system may be utilized to implement various methods, which may, for example, involve various types of control of one or more pumps, other equipment, etc.

Fracturing pumps tend to be operated in harsh environments and demand maintenance. Regularly scheduled pump maintenance may not keep each pump in its intended operation condition (e.g., according to manufacturer specifications). In a fracturing job, a pump operator may monitor pump conditions using sensor readings and pump reactions to gear/throttle commands where the operator may put a pump in a degraded mode or take it offline for appropriate maintenance if a pump is underperforming. Such a manual approach to decision making by the operator relies on the expertise and attention of the operator. As an example, a system may provide for automated pump operation that is able to automatically handle pumps in degraded mode (e.g., predict via one or more models, real-time data, historical data, etc.) and control the pumping rate according to available horse power, which can improve efficiency of a fracturing job and, for example, help to ensure that various assets are not prematurely damaged.

As an example, a method of controlling a flow rate of a pump fleet can include using one or more processors in communication with at least one memory including a desired fleet pump rate. As an example, near real-time information can be communicated to one or more processors, which may determine pump health of each pump in the pump fleet using a pump risk profile (PRP) model, a PHM model, or both. In such an example, the PRP model, the PHM model, or both may be stored in memory and in communication with one or more processors. As an example, a method can include obtaining a health score from at least one of a PRP model and a PHM model. As an example, a system can provide for determining from one or more health scores, one or more pumps that can be removed from operation or given a reduced pump rate. Such an approach may be relative and/or utilizing one or more types of fixed criteria, which may be associated with a high risk of failure, degradation, damage, etc., to equipment. For example, a relative approach may assess health scores of an entire fleet whereas a fixed criterion approach may utilize information about a specific pump to pull it offline or otherwise reduce its output in an effort to preserve the pump (e.g., from damage beyond repair, extensive maintenance, etc.).

As an example, one or more processors can determine, from a health score and operational specifications of each pump, the pumps that have available pump rate (e.g. capacity). In such an example, the one or more processors can determine the reduction on a pump fleet due to one or more pumps being removed from operation or given a reduced pump rate. In such an example, the one or more processors can also determine the amount of increase pump rate demanded from the pumps that have available pump rate (e.g., available capacity). As an example, a method can include one or more processors issuing commands to take appropriate action on one or more identified pumps to maintain a desired fleet pump rate.

As an example, a pump fleet control system can include at least one processor. The at least one processor can be in communication with a plurality of pumps and a plurality of sensors. In such an example, the sensors can be in communication with the plurality of pumps to acquire data on the operation of each of the plurality of the pumps. Such a system can also include at least one memory in communication with the at least one processor. For example, consider at least one memory that can include at least one model concerning pump risk, pump health, etc. (e.g., a PRP model, a PHM model, etc.). As an example, at least one memory can also include computer instructions to instruct at least one processor to provide acquired data (e.g., degradation data) to a model or models, for example, to determine a health score for each pump of a pump fleet. In such an example, memory can include computer instructions to determine pumps that are recommended to be taken offline or given a reduced pump rate based on one or more health scores. Such instructions can include instructions to determine pumps that have available pump rate (e.g., capacity) based on one or in ore health scores and, for example, one or more operation parameters for each of the pumps in the fleet. As an example, memory can include computer instructions to determine a pump fleet pump rate after one or more identified pumps are taken offline or given a reduced pump rate where, for example, pumps to be given an increased pump rate can be given settings based on a determination of available pump rate (e.g., available capacity). As an example, memory can include computer instructions to issue commands to take appropriate action on one or more identified pumps to maintain a desired fleet pump rate, which can be less than a hypothetical "new" pump rate as a safety margin can be utilized and/or degradation can be taken into account (e.g., which may consider maintenance schedule, repairs, etc.). As an example, a new fleet of pumps may have a new maximum capacity according to manufacturer specifications, however, as one or more pumps can degrade, demand maintenance, etc., a pump rate can be set to a value that is less than that new maximum capacity. As an example, a system can manage a fleet of pumps given data indicative of degradation, etc., and data as to pump rate(s) for performing one or more operations where the system can optimize use of various pumps in the fleet of pumps to achieve one or more operational goals.

As an example, a pump fleet control system can include at least one processor and a set of computer instructions that upon receipt of a signal cause the processor to maintain a rate as low as possible by configuring the processor to: identify gear-changing pumps; automatically decide future rate of gear-changing pumps; automatically select compensating pumps; and set a future rate of each compensating pump.

Figure 15:
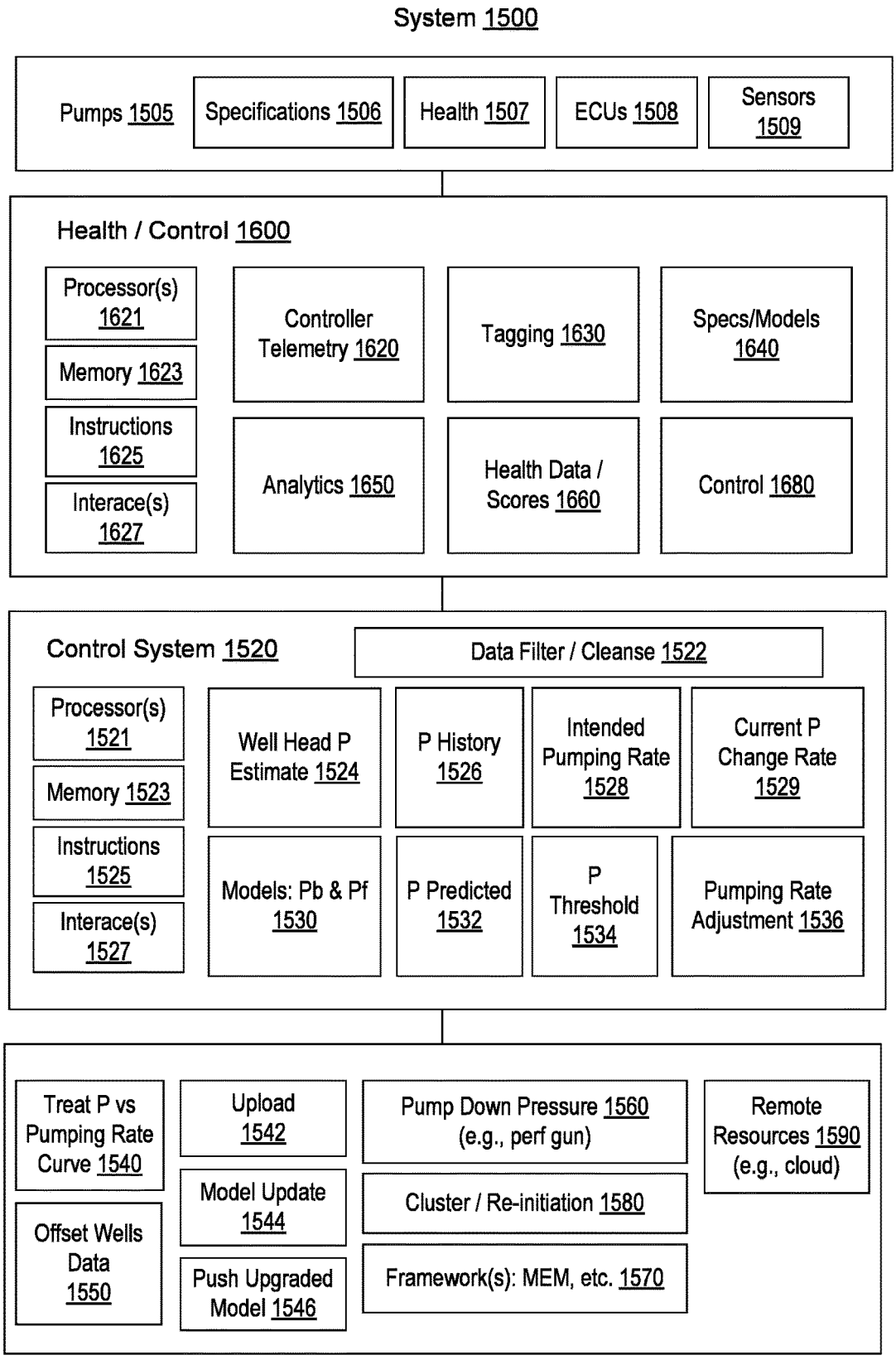
FIG. 15 illustrates an example of a system.

FIG. 15 shows an example of a system 1500 that includes pumps 1505 that include specifications 1506, health data 1507, ECUs 1508 (e.g., and other control units), and sensors 1509.

As shown, the system 1500 includes a health and control system 1600 that includes one or more processors 1621, memory 1623, instructions 1625 and one or more interfaces 1627, a controller telemetry block 1620, a tagging block 1630, a specifications and models block 1640, an analytics block 1650, a health data and health scores block 1660 and a control block 1680.

As shown, the system 1500 includes a control system 1520, which can include various features of the control system 220 of FIG. 2. For example, as shown in the example of FIG. 15, the control system 1520 includes one or more processors 1521, memory 1523, instructions 1525 and one or more interfaces 1527 along with a data filtering and cleansing block 1522, a well head pressure estimation block 1524, a pressure history block 1526, an intended pumping rate block 1528, a current pressure change rate block 1529, a models block 1530, a predicted pressure block 1532, a pressure threshold block 1534 and a pumping rate adjustment block 1536.

As shown, the system 1500 includes various other blocks such as, for example, a treating pressure versus pumping rate curve block 1540, an upload block 1542, a model update block 1544, a push upgraded model block 1546 (e.g., to the models block 1530, to the specifications and models block 1640, etc.), an offset wells data block 1550, a pump down pressure block 1560, a frameworks block 1570, a cluster/re-initiation block 1580 (e.g., as to frac clusters, re-initiation of frac clusters, etc.; see, e.g., FIGS. 7 and 8, etc.), and a remote resources block 1590. One or more of such blocks may be operatively coupled to or included in the control system 1520 and/or the health and control system 1600.

As shown in FIG. 15, the system 1500 includes features additional to the system 200 of FIG. 2 such that various health-related aspects of one or more pumps in a fleet of pumps can be taken into account for purposes of control. Such control can include, for example, load balancing in a manner that can control individual pumps in different manners for a particular pumping rate and/or for a particular pumping rate schedule. Such an approach can aim to optimize one or more aspects of hydraulic fracturing operations.

Figure 16:
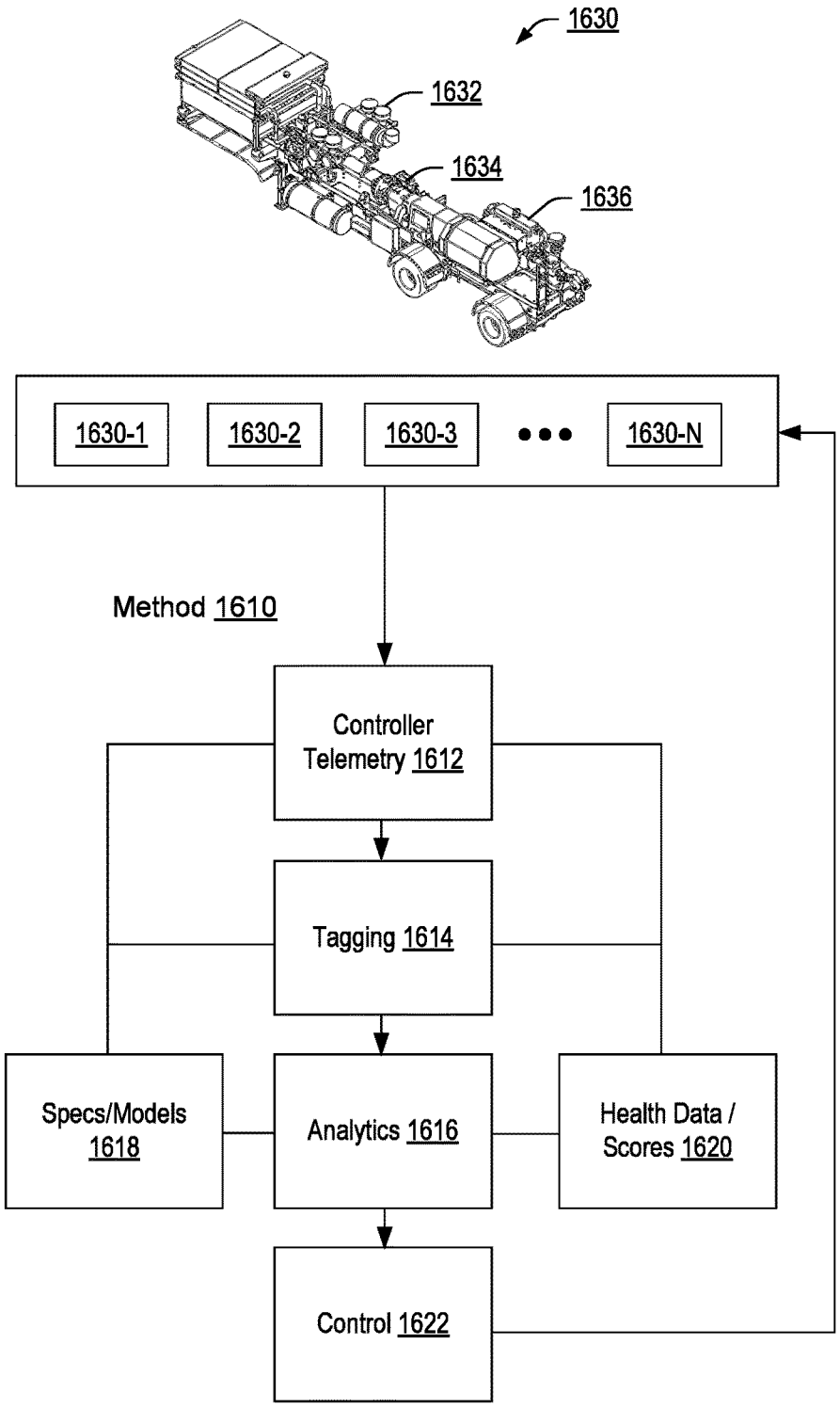
FIG. 16 illustrates an example of a system.

FIG. 16 shows an example of a fleet of hydraulic fracturing pumps 1630-1, 1630-2, to 1630-N, which may be skid mounted, trailer mounted, etc. (see also, e.g., FIG. 1). As shown, the fleet can be controlled using one or more components (e.g., blocks, etc.) of the system 1500 of FIG. 15, where particular blocks can, for example, correspond to those of the health and control system 1600.

An example of a trailer mounted pump 1630 is shown in FIG. 16, which includes an engine 1632, a transmission 1634 and a pump unit 1636. As an example, the engine 1632 can be capable of delivering in excess of 2,000 BHP at its flywheel at SAE conditions where the pump unit 1636 is operatively coupled to the engine 1632 via the transmission 1634. In such an arrangement, the pump unit 1636 can deliver a slightly lesser amount of hydraulic horsepower HHP (e.g., approximately 2,000 HHP).

HHP can be defined as the product of gallons per minute and pressure in psi divided by a factor of 1715. HHP is the horsepower equivalent of "lifting" a continuous volume rate of fluid to the height in feet represented by the pressure involved (as if a tall, open overflowing stand-pipe were connected to measure the pressure). The weight of fluid directly controls the pressure in a standpipe: 520 psi is the bottom pressure of a 1,000-ft column of 10 lb/gal (ppg) fluid. To pump in a gallon at the bottom and move a gallon out the top is equivalent to lifting 10 pounds through 1,000 ft, or 10,000 ft-lb. A volume of 3.3 gal/min (gpm) at these conditions is 33,000 ft-lb/min, or 1 horsepower (hp). Because it is the calculation of fluid relations, it is referred to as hydraulic horsepower. It can be calculated for a part or parts of a system according to pressure relations. Thus, 3.3 gpm and 520 psi, or 1,715 gpm and 1 psi means 1 horsepower. For other properties of fluid pumped, 520 psi represents a different height but is the same ft-lb/gal pumped.

As an example, the engine 1632 can include features of a diesel engine such as, for example, the Detroit Diesel 12V4000, four-cycle diesel engine. As an example, the transmission 1634 can include features of a transmission such as, for example, an Allison S9820 powershift transmission. As an example, the pump unit 1636 can include features of a pump unit such as, for example, a SPM QWS-2500SD quintuplex pump unit.

As explained, pumping can be controlled via engine throttle and transmission gear. For a diesel engine, engine throttle controls power output through regulation of quantity of diesel fuel that is injected into engine cylinders. As an example, a transmission can have a range of gears with corresponding gear ratios. For example, consider the following gears and gear ratio: 1st, 3.75:1; 2nd, 2.69:1; 3rd, 2.20:1; 4th, 1.77:1; 5th, 1.58:1; 6th, 1.27:1; 7th, 1.00:1; and 8th, 0.742:1. As such, a controller that aims to control power output of an engine operatively coupled to a pump unit via a transmission (e.g., a "pump", pump system or pumping system), the controller can output one or more signals that can result directly and/or indirectly in one or more of a throttle change and a gear change.

As an example, the engine 1632 can include a variety of sensors, which can include, for example, sensors for camshaft speed, intake air temperature, exhaust temperature, cylinder exhaust temperature, oil pressure downstream of filter, lube oil pressure, oil pressure upstream of filter, coolant temperature, oil temperature, charge-air temperature, charge-air pressure, crankshaft speed, coolant pressure, raw water pump pressure, fuel temperature, fuel pressure downstream of filter, fuel pressure upstream of filter, fuel pressure upstream of external filter, rotation speed of one or more turbochargers, high pressure fuel pressure, charge air before recirculation, crankcase pressure, replenishment pump pressure, coolant level, coolant level adaptation, coolant level, outer skin cooling, fuel overflow level, fuel pump, etc.

As an example, the engine 1632 can include an engine control unit (ECU) that can provide various types of data including, for example, fault codes.

As to fault codes consider "Idle Speed too High" (e.g., "idle speed of one of the secondary turbochargers is too high", "Speed Deviation" (e.g., "speeds of one of the secondary turbochargers deviates from primary turbocharger speed"), "Rail Leakage" (e.g., "pressure gradient in rail is too low during starting or too high during stopping (HP system leaky or air in the system)"), "Counter Defect" (e.g., "consumption meter faulty"), "Eng Hours Counter Defect" (e.g., "hourmeter faulty"), "Power too high" (e.g., "this alarm occurs if the average value of power over the last 24 hours exceeded the maximum value specified"), etc.

Fault codes can be determined by an ECU (or ECUs) based on signals received from one or more sensors and, for example, values that may be set at time of manufacture, ECU upgrade, by operation history, etc.

An ECU (or ECUs) may provide indications as to one or more maintenance tasks. As to maintenance tasks, consider as some examples: check engine oil level, visually inspect engine for leaks and general condition, check intercooler drain(s), check service indicator of air filter, check relief bores of the high pressure fuel pump, check relief bores of water pump(s), check engine for abnormal running noises, exhaust color and vibrations, drain water and contaminants from fuel prefilter, check reading on differential pressure gage of fuel prefilter, replace fuel filter or fuel filter element, replace air filter, replace injection valves/injectors, replace engine oil filter when changing engine oil, or when the interval (years) is reached, at the latest, check layer thickness of the oil residue, clean out and replace filter sleeve, together with each oil change, at the latest, perform endoscopic examination, check condition of coupling, inspect for tightness and damage of air duct between air filter and exhaust turbocharger, replace coolant filter, clean compressor wheel, check valve clearance, adjust if appropriate (e.g., first adjustment after 1,000 operating hours), check function of rod electrode, check alarm function of differential pressure gauge, check pump capacity, check general condition of engine mounting (visual inspection), replace filter element of fuel prefilter and sealing ring depending on degree of contamination, when the limit (time) is reached, at the latest, replace intermediate fuel filter or filter element, injector—reset drift compensation parameters (CDC), check and clean oil indicator filter, etc.

FIG. 16 shows an example of a method 1610 that includes a controller telemetry block 1612 for receiving data from the fleet of pumps 1630-1 to 1630-N; a tagging block 1614 for tagging received data; an analytics block 1616 for analyzing tagged data, optionally using specification data and one or more models of a specification and models block 1618 and/or using health data and/or health scores of a health data and scores block 1620; and a control block 1622 for outputting one or more control signals based on the analyzing of the analytics block 1616. In the example method 1610, one or more features of the system 200 of FIG. 2 may be utilized. For example, the control system 220 can be operatively coupled to the analytics block 1616 and/or the control block 1622 such that a pumping rate adjustment of the pumping rate adjustment block 236 can be tailored in a manner that accounts for condition of one or more of the pumps in the fleet of pumps 1630-1 to 1630-N.

As an example, consider a fleet of pumps that includes ten pumps, where each pump has a specified rating of 2,000 HHP when new given corresponding diesel engines, each with a specified rating of more than 2,000 BHP when new. Such a fleet can have an overall rating of 20,000 HHP that can be available for performing one or more hydraulic fracturing operations.

In the foregoing example, consider three of the ten pumps, denoted P2, P7 and P9, as having histories as to sensor values, fault codes and maintenance. In such an example, health scores for each of the pumps can be determined based at least in part on such data. For example, P2 can have a health score that is 13 on a scale of 0 to 100; P7 can have a health score that is 31 on the scale; and P9 can have a health score of 95 on the scale. As to P2, it can have a history of fault codes as to rail leakage, which may be associated with maintenance history. Such issues may be associated with how the engine of P2 operates, its environment, etc. For example, P2 may be subjected to vibration that tends to degrade one or more rail components. In such an example, the vibration may be detected using one or more sensors where vibration can be correlated with one or more parameters such as engine speed (e.g., RPM), engine throttle, transmission gear, etc. Thus, P2 may have a low health score because its "healthy" operating range is constrained due to vibration issues that can impact rail leakage. As to P7, it may be approaching a maintenance deadline and therefore have a health score that is lower because a risk of faulting is increased as the maintenance deadline approaches. As to P9, it may be a relatively new pump without a history of fault codes and with a relatively long period of time before scheduled maintenance, for example, where the period of time is greater than the time of a hydraulic fracturing operation (e.g., a pad phase, a slurry phase, one or more slurry steps, etc.).

In the foregoing example, the control block 1622 can issue control instructions (e.g., control signals) that can individually control one or more of the pumps 1630-1 to 1630-N in the fleet of pumps, where N is 10. For example, the control block 1622 can balance the load using one or more of throttle and gear to achieve a desired pumping rate, which may be an existing pumping rate or an adjusted pumping rate.

As to control of the fleet of pumps 1630-1 to 1630-10 at an existing pumping rate, the method 1610 can operate dynamically responsive to data received by the controller telemetry block 1612; for example, control can be responsive to sensor data, fault codes and maintenance of one or more of the pumps 1630-1 to 1630-10.

As to control of the fleet of pumps 1630-1 to 1630-10 for an adjusted pumping rate, the method 1610 can similarly balance load based on conditions, which may be quantified, for example, using health scores. In such an example, the adjusted pumping rate may include a schedule that calls for ramping up and/or maintaining the adjusted pumping rate for a period of time. In such an example, the method 1610 can intelligently control individual pumps of the fleet of pumps 1630-1 to 1630-10 to meet the schedule while balancing load in a manner that can differ for one or more of the pumps of the fleet of pumps 1630-1 to 1630-10. For example, one pump may be set to a particular output that remains steady while other pumps are ramped up and/or ramped down to achieve the adjusted pumping rate. In such an approach, the pump that is set steady may have a low health score such that its contribution to the overall pump rate involves not changing throttle and/or gear to not disturb the pump from its current steady-state of operation, which may cause stress and increased risk of failure; whereas, a pump with a high health score can be operated dynamically for a period that moves its operation through unsteady states to meet the adjusted pumping rate, which may change according to the schedule. Such an approach aims to reduce risk of failures in a manner that can account for condition of a pump (e.g., an engine, a transmission, a pump unit, etc.). Such an approach may aim to make the best use of "healthier" equipment, which may be newer equipment while making conservative use of less healthy equipment, which may be older equipment.

As an example, the method 1610 can account for overall fleet dynamics, which can be characteristic of a particular fleet and that can vary with respect to time and operational demands. As an example, a fleet may be very reliable as to performing at a particular overall pumping rate and be less reliable in a predictable manner as to higher overall pumping rates.

As an example, the method 1610 can include analytics that can inform a control system such as the control system 220 of FIG. 2. For example, consider overall power of the fleet of pumps 1630-1 to 1630-N, which can change over time. In such an example, the analytics block 1616 can compute an overall maximum power output value, which may be in break horsepower (BHP) and/or in hydraulic horsepower (HHP). That value can be utilized by the control system 220 to make determinations as to pumping rate and, for example, pumping rate adjustments. As an example, where the overall maximum power output value decreases to a value that is less than a threshold, one or more notifications may be issued, which may call for action or actions (e.g., replanning of one or more hydraulic fracturing operations, etc.).

As an example, the method 1610 of FIG. 16 can utilize one or more machine learning techniques. For example, consider a machine learning approach that trains a machine learning model (ML model) using one or more inputs and one or more outputs of the method 1610. Such an approach may tie specifications of one or more components of a pump with a health model such that a health score can be predicted in a forward looking manner for a given operational demand, a given operational schedule, etc. Such an approach can facilitate control of individual pumps in a fleet of pumps to maintain a pumping rate and/or to adjust a pumping rate, which may optionally be tied to larger scale scenarios such as, for example, pad phase, a slurry phase, one or more slurry steps, one or more other wells, etc. As an example, the method 1610 may aim to account for a number of jobs at a number of wells to be performed using the fleet of pumps. Where such wells are remote from facilities that can provide spare parts, service, maintenance, etc., such an approach can help to assure that the jobs at the wells are performed with lesser risk of non-productive time (NPT). Such an approach can optimize each individual job while optimizing the goal of performing a number of jobs.

In various examples, systems and/or methods can use real-time pump sensor data, such as engine load, transmission converter temperature, engine oil temperature, coolant temperature, air filter pressure, engine boost pressure etc., in combination with general pump risk profiles obtained from a central processing component, which can be a centralized server or a centralized cloud platform, to deduce the pump health condition during pump operations. If the condition passes the certain established threshold, the pump can be put in a degraded mode to avoid disrupting the operation. The real-time health information can be used to predict/initiate appropriate onsite maintenance to bring the pump back to its intended working condition.

As an example, an automated control system can be configured to distribute a pumping rate optimally accordingly to manufacturing specifications of one or more pumps of a fleet of pumps. As explained, pumps can degrade during operation, where various types of system components can detect when pumps degrade and cause a controller to reallocate load and/or place the degraded pump offline for maintenance.

As an example, a system and/or a method can utilize pump parameters (e.g., engine load, temperature, engine boost pressure, etc.) gathered from sensors in real-time to identify and classify the pump condition or its health. Such an approach can include utilizing output of one or more ECUs, for example, as to fault codes.

In one or more embodiments, real-time data are provided to a central processing component to update a pump's risk profile (e.g., a health score, etc.), which can be further feedback to an onsite controller, gateway, or combinations thereof to refine the pump condition/health status, and to make predictive onsite maintenance planning.

In one or more embodiments, a controller can be configured to use a control algorithm to take the pump condition/health as an input and automatically re-distribute a pumping rate to optimize degraded pump operation matching to its health condition. Such an approach can be assisted by the concept of pump achievability by gear and engine speed (e.g., throttle, etc.), meaning that for given external conditions (e.g., pressure, etc.) and the pumps internal health, certain operations states specified by gear and engine speeds are marked as achievable and others not achievable.

The benefit of fully automated condition-based operation allows better pump management/maintenance and optimized utilization of available equipment/horsepower at location.

As an example, degraded pump conditions can be reflected by one or more pump parameters measured by sensors, output by an ECU (or ECUs), etc. When one or more of such parameters exceed certain thresholds, indicate a change rate that is too rapid, or combinations thereof, a controller can be configured to automatically shift the pump to one or more lower gears (e.g., hence with a lowered rate). Depending on whether the rest of the available pumps have more capacity, and the treating pressure allows, the controller can decide to compensate the lowered rate in degraded pump with one or more other pumps. As an example, a change rate can be determined by taking a first order derivative of the measured parameters with respect to time.

As an example, engine oil temperature for a pump can be acquired using a sensor in communication with a pump, and the acquired engine oil temperature can be compared to a threshold engine oil temperature. In such an example, if the engine oil temperature is greater than the threshold for a predetermined period of time, a controller can be configured to reduce the load and rate on that pump and make up the rate by increasing the rate on other pumps.

In one or more embodiments, a pump can have a transmission control unit (TCU), and engine control unit (ECU), or combinations thereof. The TCU and ECU can be provided by a manufacturer of the pump, the engine, the transmission, etc. The TCU and ECU can be programmed by a manufacture to detect certain failures in the transmission of the pump and the engine of the pump, using a plurality of sensors on the pump. As mentioned, an ECU may determine and output fault codes. As an example, a TCU can determine and output fault codes. A TCU, an ECU, or combinations thereof can send alert signals to a controller, which may include particular data, information, etc. (e.g., fault codes, remedial measures, etc.). As an example, a controller can then use the alert signals alone or in combination with other acquired data. For example, a TCU can send an alert that the transmission is losing lockup, and a controller can then use that information to reduce the rate on the pump rate for that pump and increase the pump rate for one or more other pumps.

In another example, one or more sensors in communication with a pump can be used to acquire a transmission converter temperature and compare that to a predetermined threshold, where, if the acquired transmission converter temperature exceeds the threshold temperature, the system can be configured to downshift gear or idle the pump and make up rate on other pumps.

In another example, one or more sensors in communication with a pump can be used to acquire the engine coolant temperature and the engine coolant temperature can be compared to a predetermined threshold, where, if the acquired engine coolant temperature exceeds the threshold temperature, the system is configured to downshift gear or idle the pump and make up rate on one or more other pumps.

In another example, one or more sensors in communication with a pump can be used to acquire data on engine load and compare the engine load to a predetermined threshold, where, if the acquired engine load data exceeds the threshold load, the system is configured to reduce rate accordingly on the pump and make up rate on one or more other pumps. In one or more embodiments, control can go mark that pump for continuous monitoring, and if the load falls below the engine load threshold automatically remove the rate limitation on the pump and take appropriate action to reduce the rate of other pumps to maintain the desired overall pump fleet rate.

As an example, a system can utilize one or more data-based risk models (e.g., consider a pump risk profile (PRP) model and PHM model) executable using onsite and/or remote resources to predict the health of a pump and identify a health score using pump operation and maintenance data. In a two-model approach, PRP and PHM, both models can produce risk scores for each individual asset/pump to indicate its likelihood of failure. Risk scores can cover a pump as a whole and a pump's major components (engine, transmission, power end, and fluid end, the latter two being sub-assemblies of a pump unit such as the pump unit 1636 of FIG. 16).

A PRP model can be a risk model based on pump usage history (e.g., operation hours, oil samples, number of strokes, pressure history, number of total shifts, etc.) and can be supplemented and updated using real-time data. A PHM model can be a data analytics-model based on pump physical sensor measurements (e.g., temperatures, pressures, voltages, etc.). As an example, risk scores generated by these risk models can be used in real-time by a controller. Real-time can be defined as near instantaneous (e.g., consider sampling rates, etc.) and can include latency in communication (e.g., telemetry, etc.). For example, real-time can be instantaneous if communication between a controller and models are of zero latency. However, if the communication between a controller and models has as latency of 1 minute then real-time can be instantaneous plus 1 minute. In general, real-time means instantaneous plus latency or other system delay time. Other system delay time can include transmission time delay, acquisition time delay, processing time delay, or other system delays. As an example, a controller can then use the risk scores as an input to optimize the rate allocation and run the pumps accordingly based on their risks of failure. For example, if a pump is assigned a high-risk score, the controller can be configured to lower that pumps rate.

As an example, various types of control may be distributed throughout a system that can perform controlled or controllable hydraulic fracturing operations. For example, a ECU can be local to an engine, a TCU can be local to a transmission, a pump unit control unit (PUCU) can be local to a pump unit where each of these types of localized control units can manage localized features (e.g., consider thermostat of a cooling system of a diesel engine, a fuel pump set point regulator that regulates fuel pressure, fuel flow, etc., about a set point, etc.). Such units can be of relatively low latency. Such units can include one or more interfaces such that they can be operatively coupled to interfaces of one or more control systems, etc., which provide for control of pumping rate and/or loading balancing of pumping rate amongst a fleet of pumps.

Figure 17:
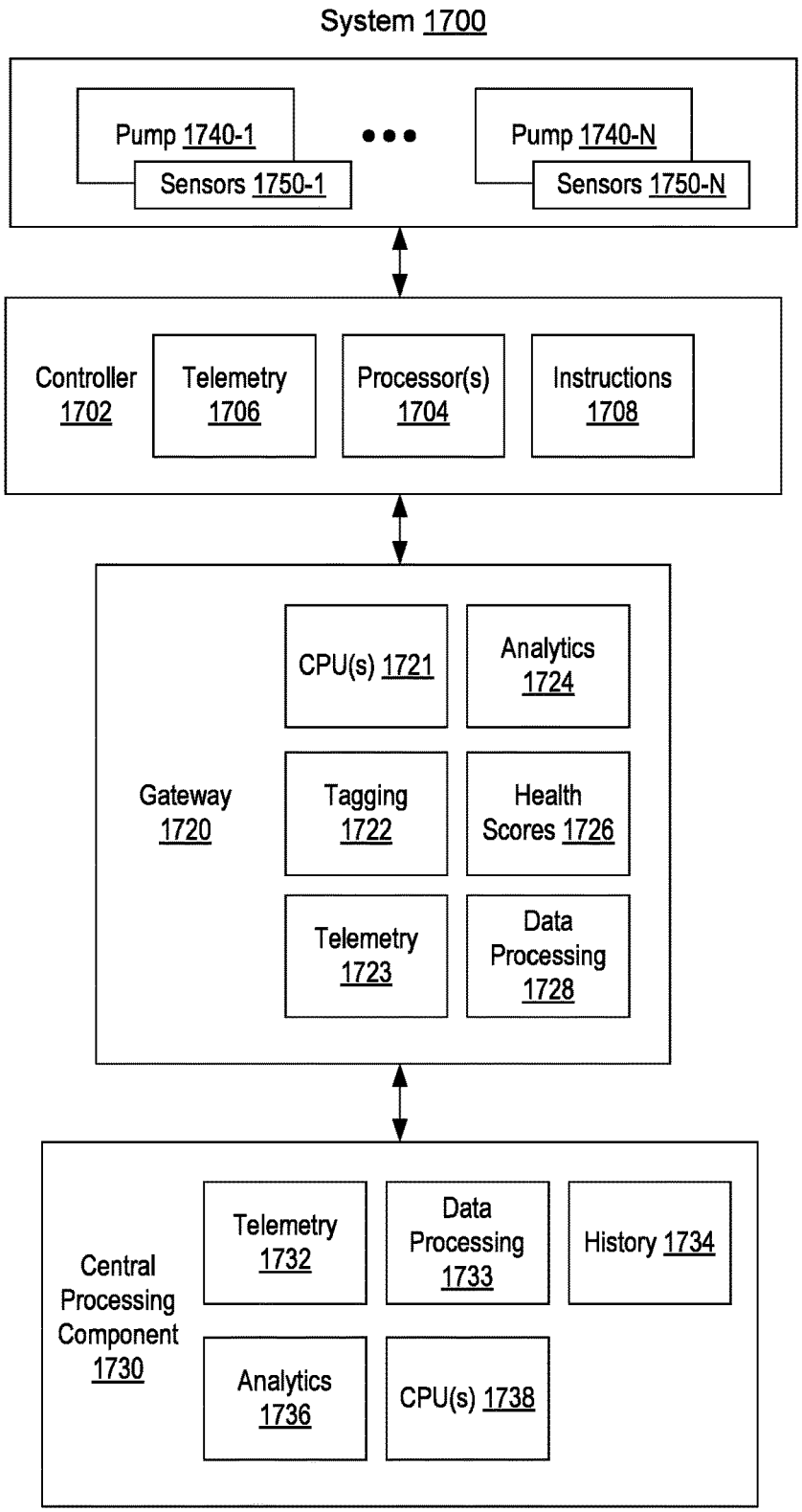
FIG. 17 illustrates an example of a system.

FIG. 17 shows an example system 1700 that is configured to perform health monitoring and control of a fracturing pump fleet. As an example, the system 1700 can include various features of the system 1500 of FIG. 15 or vice versa. As shown, the system 1700 can include a controller 1702, a plurality of pumps 1740, a gateway 1720, and a central processing component 1730.

The controller 1702 can include a controller processor 1704, a controller telemetry block 1706, and control instructions 1708. The controller processor 1704 can be in communication with the pumps 1740 via the controller telemetry block 1706, and the gateway 1720 can also be in communication with the controller telemetry block 1706. The controller telemetry module 1706 can implement one or more types of data transmission protocols including Modbus, message queuing telemetry transport, TCP/IP, SNMP, or the like.

The controller processor 1704 can also be in communication with control instructions 1708. The control instructions 1708 can be stored on a non-transitory computer readable storage medium (CRM). The control instructions 1708 can configure the controller processor 1704 to control the pumps 1740 based on health status (e.g., health score, etc.), real-time data, manufacturing specifications, job set parameters, instructions and/or information provided by the gateway 1720, instructions and/or information central processing component 1730, or combinations thereof.

Each pump of the plurality of pumps 1740 can include one or more sensors 1750. The sensors can be used to acquire pressure data, temperature data, load data, or the like for the associated pump. For example, each pump can have a plurality of sensors that can acquire transmission converter pressure, transmission converter temperature, engine coolant temperature, and engine load for the associate pump, other engine and performance data can be acquired using sensors.

The gateway 1720 can include a data tagging block 1722, an analytics block 1724, a health score data storage 1726, data processing block 1728, a gateway processor 1721, and a gateway telemetry block 1723. The gateway telemetry block 1723 can be used to communicate with the controller telemetry block 1706 and the central processing component 1730.

The data tagging block 1722 can be a set of computer instructions on a CRM that configures the gateway processor 1721 to apply identification tags to data sets. The identification tags can identify the asset (e.g., and location) of the pump associated with the data. The data tagging block 1722, for example, can have an index of identification parameters associated with metadata and the data tagging block 1722 can instruct the processor to match metadata of acquired data with metadata in the index to identify and provide proper tagging for the associated pump, enabling tagging and association of the data with the appropriate pump (e.g., using device information in the metadata that is associated with the identification parameters in the index).

The analytics block 1724 can include one or more sets of computer instructions on one or more CRM. The analytics block 1724 can include computer instructions to instruct the gateway processor 1721 to compare acquired tagged data to one or more thresholds to determine the operation status of each of the pumps, a PHM model that uses historical data in the health data module, current real-time data, and performance analytics to update the health score of each of the pumps and to take appropriate action based on the health score of each of the pumps, a PRP model that uses the real-time data and historical data from the central processing component to determine a risk profile for each of the pumps and issue a command to a controller to place pumps with a high risk score in degrade mode for maintenance, reduce the load on the high risk score pumps, or combinations thereof.

The health score data storage 1726 can receive a determined health score for each of the pumps from the central processing component and store the health score for each pump. The data processing module 1728 can be configured to receive the health score data from the central processing component 1730, determine from tag identification the pump associated with the health score, and store the data in the health score data storage in an table that allows the gateway processor 1721 to associate the health score, real-time data, the like, or combinations thereof with the appropriate pump.

The central processing component 1730 can have a central processing component telemetry component 1732, a data processing component 1733, a pump history component 1734, an analytics block 1736, and one or more central processing processors 1738. The central processing component 1730 can be arranged as a cloud service, distributed processing system, a central server, or combinations thereof.

The central processing component telemetry component 1732 can be configured to allow communication with the gateway 1720. The central processing component telemetry component 1732 can provide the data to the central processing component data processing component 1733, and the central processing component data processing component 1733 can use tag information to place the acquired data in the appropriate organization and structure to ensure the data is associated with the appropriate pump.

The central data processing component 1730 includes computer instructions to instruct the central processing component processor 1738 to send the real-time data to the pump history component 1734. The pump history component 1734 can be a data base organized by tag number and the appropriate pump. The pump history component 1734, which is in communication with the other components of the central processing component 1730 including the central processing component processors 1738, can store information such as time stamped temperature data, pressure data, number of shifts, operations hours, and other data provided by the sensors and or a user. The other data can include maintenance records, oil sample data, the like, or combinations thereof.

The analytics block 1736 can be in communication with the one or more central processing processors 1738 and can include instructions to have the central processing processors 1738 run one or more models, stored in the analytics module, to predict the health of each pump, provide a health ranking based on a pump risk profile, or other models to predict the operation of the pumps. The models to predict the health of each pump can include a PHM model that uses the data analytics that incorporates historical data and real-time data of each pump to provide a health score to each pump. A PRP model that uses pump history data and real-time data to determine the risk to each pump and assign or determine a maintenance plan for each of the pumps. Other models can also be included.

In one example of the operation, the controller, using the controller processor in communication with computer instructions and user inputted information, can set the desired pump rate by controlling each of the pumps to achieve the fleet pump rate per a fracturing operational plan. For example, a user can input the fracturing operational plan, and the specification for each of the pumps in the fracturing pump fleet (e.g., horse power rating, max pumping rate, and the like), and the computer instructions can then run the available pumps to achieve the fleet pump rate per the fracturing operational plan and can automatically adjust the rate based on pressure measurements at a well head (see, e.g., the system 200 of FIG. 2). The fracturing operational plan can be created independent of the controller. The fracturing operational plan can be generated, for example, using various techniques described in US Patent Publication Application No. 2012/0179444, entitled: "System and Method for Performing Downhole Stimulation Operations", filed on Jan. 29, 2007, which is incorporated by reference herein.

The controller 1702 can be in communication with the sensors 1750-1 to 1750-N. The sensors can send back acquired data to the controller with associated metadata. The metadata can include time information, device information, etc. The communication with the sensors can be via the TCU, ECU, direct communication, the like, or combinations thereof.

The acquired data and associated metadata can then be transmitted to the gateway 1720 via the controller. For example, the controller telemetry block 1706 can include the proper protocol and computer instructions that when executed cause the data to be sent to the gateway 1720.

The gateway processor 1721 can use the stored index and associated computer instructions in the data tagging module to match identification information in the metadata of the acquired data with pump identification information in the stored index to provide an identification tag to the acquired data that can be used to ensure the data is associated with the appropriate pump, the data tagging information can also provide or identify a time stamp for the acquired data using the metadata. The appropriately tagged data can then be stored and/or communicated to the analytics module, the central processing component via the gateway telemetry module, or combinations thereof.

In one or more embodiments, edge computing can be performed by the gateway processor via the analytics module. The analytics module can have one or more models. The models can include PHM model, a PRP model, or other similar data driven, physics driven, or hybrid driven models. One of the models can be an analytics model that uses the real-time acquired data to provide a health risk score for each of the pumps. The health risk score for each of the pumps can be compared to a threshold value, and if it is offset from the threshold value by a predetermined value for one or more of the pumps, then the processor can be instructed to send instructions back to the controller to reduce the load on the associated pumps, remove the pumps from the operation and reallocate power to maintain the desired pump rate, or the like. The analytics module can also include prestored thresholds for transmission converter pressure, transmission converter temperature, engine coolant temperature, and engine load value, and can instruct the processor to compare the acquired data for each of the operation parameters to the threshold and if the threshold is exceeded or being approached, the processor can be instructed, via computer instructions in the analytics module, to send a signal to the controller processor to remove the pumps that have acquired data that exceed the threshold and adjust the remaining pumps to maintain the desired pumping rate.

The real-time data that is properly tagged can also be sent to the central processing component, via the gateway telemetry module. The central processing component can use the computer instructions in the central processing component data processing module to instruct the processor to deposit the tagged data into proper organization via the associated pump, time stamp, or the like.

The central processing component can also include a central processing component analytics module that can be similar to the analytics module described with regards to the gateway analytics module. The central processing component analytics module can also include a pump risk profile model that is updated with the acquired data and uses historical data on pump usage stored in the pump history component 1734 to determine a risk score for each pump.

The calculated risk score for each pump can be sent back to the gateway, and the data processing module can instruct the gateway processor to place the risk score in the health score data storage using identification information associated with each pump. The gateway processor can also be instructed to determine if the provided risk score for each pump is offset from a predetermine threshold, and if the threshold is met the gateway processor can be instructed to send a signal to the controller processor to instruct the controller processor to take appropriate action.

The analytics module in the central processing component, the gateway, the controller, or combinations thereof can include one or more of PHM model, Pump Risk Profile model, predetermined thresholds for performance parameters, and other computer instructions to allow for determination of each pump's health.

Various features of the system 1700 of FIG. 17 can be included in a system such as the system 1500 of FIG. 15. For example, the health and control system 1600 can include various features of the system 1700 of FIG. 17.

Figure 18:
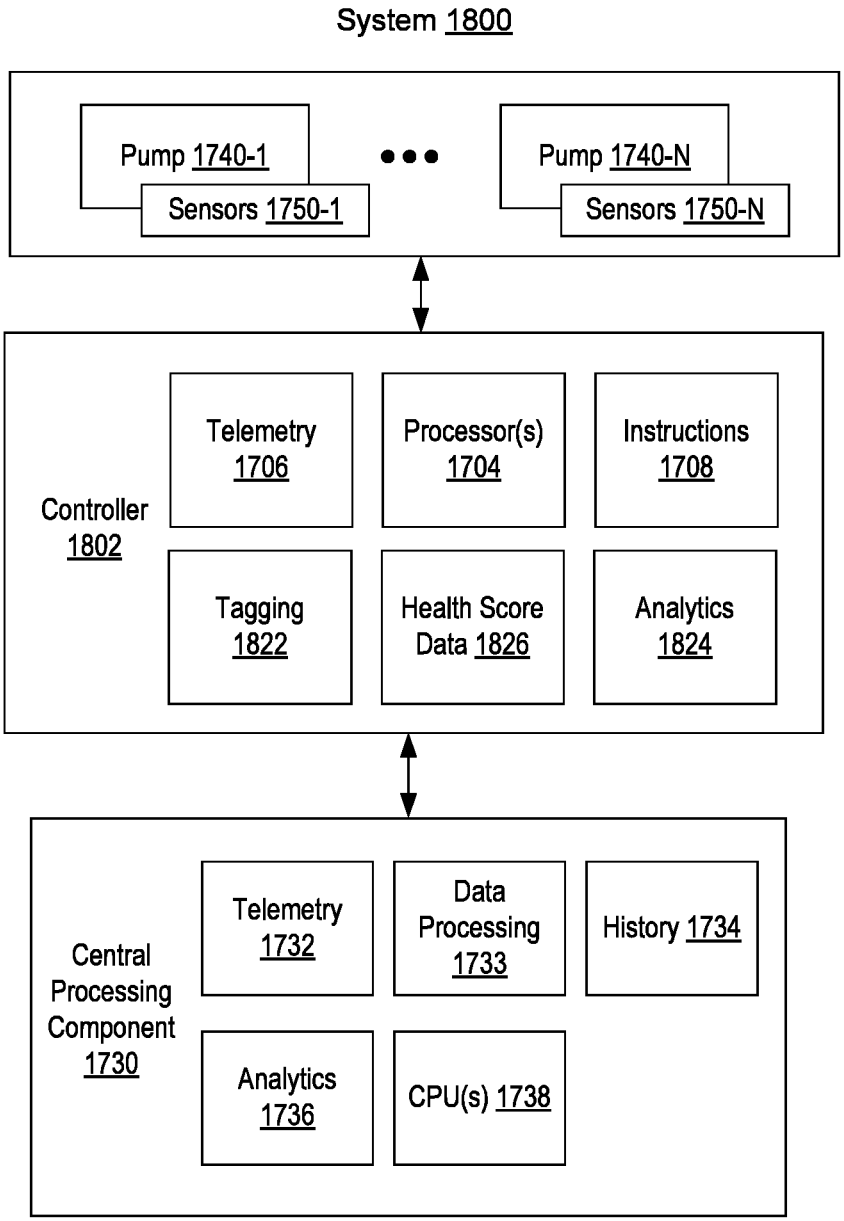
FIG. 18 illustrates an example of a system.

FIG. 18 depicts another example system 1800 that is configured to perform health monitoring and control of a fracturing pump fleet (see, e.g., the pumps 1740-1 to 1740-N).

The system 1800 includes the pumps 1740-1 to 1740-N, the sensors 1750-1 to 1750-N, a controller 1802, and the central processing component 1730.

The controller 1802 can include the controller telemetry block 1706, an analytics block 1824, the control instructions 1708, a tagging block 1822, the controller processor 1704, and a health score data block 1826. The controller telemetry block 1706 can be in communication with the central processing component 1730, the pumps 1740-1 to 1740-N, and the sensors 1750-1 to 1750-N.

The control instructions 1708 can configure the controller processor 1704 to control the pumps 1740-1 to 1740-N based on health status, real-time data, manufacturing specifications, job set parameters, instructions and/or information central processing component 1730, or combinations thereof.

The tagging block 1822 can be a set of computer instructions on one or more CRM, and the set of computer instructions configure the controller processor to apply identification tags to data sets that identifies the asset and location of the pump associated with the data (e.g., consider use of a mark-up language, a data structure, a SQL database or databases, etc.). The data tagging block 1822, for example, can have an index of identification parameters and match the identification parameters to metadata of the acquired data thereby, enabling tagging and association of the data with the appropriate pump (e.g., using device information in the metadata that is associated with the identification parameters in the index). The tagging block 1822 can be the same or similar to those described herein above or below.

The analytics block 1824 can include one or more sets of computer instructions on one or more CRM. The analytics block 1824 324 can have computer instructions to use received data and compare the data to one or more thresholds to determine the operations status of each of the pumps, computer instructions to use historical data in the health score data block 1826, current real-time data, and performance analytics to update the health score of each of the pumps and to take appropriate action based on the health score of each of the pumps, a PHM Model, a PRP model that uses the real-time data and historical data from the central processing component 1730 to determine a risk profile for each of the pumps and issue a command to the controller to place pumps with a high risk score in degraded mode for maintenance, reduce the load on the high risk score pumps, or combinations thereof.

The health score data block 1826 can generate and/or receive a determined health score for each of the pumps 1740-1 to 1740-N from the central processing component 1730 and store the health score for each pump. As an example, a method can include using tag identification data, determining a pump associated with a health score, and storing data in a health score data storage, for example, in a table format that allows a gateway processor to associate the health score and real-time data with the appropriate pump.

The central processing component analytics block 1736 can also include a PRP model that is updated with the acquired data and uses historical data on pump usage stored in the pump history component 1734 to determine a risk score for each pump. The central processing component analytics block 1736 can also include a PHM model that uses analytics with real-time data to determine a health score. The central processing component analytics block 1736 can include the PRP model, the PHM model, and one or more other models that are physics driven models, data driven, or hybrid models, or combinations thereof.

As an example, a calculated risk score for each pump can be generated by and/or received by the controller 1802, and a data processing block of the controller 1802 can instruct the controller processor 1704 to place the risk score in a health score data storage using identification information associated with each pump. The controller processor 1704 can also be instructed to determine if the provided risk score for each pump is offset from a predetermine threshold such that the controller processor 1704 can be instructed to take appropriate action.

In operation, the controller 1802 can be in communication with the pumps 1740-1 to 1740-N and the central processing component 1730 via the telemetry block 1706. The controller processor 1704, using controller and/or user inputs on desired rate and available horsepower and pump specifications, can be configured by the instructions 1708 to operate one or more of the pumps 1740-1 to 1740-N to achieve a desired pressure with load distributed to the pumps according to each pump's specification and/or health status to ensure that optimal performance is started. As an example, load balancing can include evenly or unevenly balancing load according to particulars of a pump or pumps.

As a fracturing operation continues, the controller 1802 can receive acquired data on pump performance parameters and associated metadata that include identification data.

As an example, the data tagging block 1822 can include instructions to configure the processor to identify device identification information and provide appropriate tagging information to the data to properly associate the data with the appropriate pump (e.g., an optionally its location). As an example, tagged data can be sent to the analytics block 1824, stored in a database that is organized to receive the properly tagged data in a way to enable identification of matched data to the appropriate pump, or combinations thereof.

The analytics blocks 1824 can use the tagged data to compare one or more performance parameters to predetermined thresholds. If the data have passed a predetermined threshold, the analytics block 1824 can send information to the controller processor 1704 instructing the processor 1704 to take appropriate action to optimize the operation of the fleet of pumps 1740-1 to 1740-N while maintaining the desired pump rate.

The analytics block 1824, in one or more embodiments, can include computer instructions to use historical data in the health score data block 1826, current real-time data, and performance analytics to update the health score of each of the pumps and to take appropriate action based on the health score of each of the pumps, a risk profile model that uses the real-time data and historical data from the central processing component 1730 to determine a risk profile for each of the pumps and issue a command to the controller 1802 to place pumps with a high risk score in degraded mode for maintenance, reduce the load on the high risk score pumps, or combinations thereof.

The updated risk profile and real-time data can be sent to the central processing component 1730 to update the central processing analytics block 1736 with risk scores calculated by the controller analytics block 1824 and real-time data.

In one or more embodiments, the controller telemetry block 1706 can communicate tagged data to the central processing component 1730, and the central processing component analytics block 1736 can calculate the health score and send the score back to the controller 1802, and the controller 1820 can be configured to take appropriate action. As mentioned, the controller 1802 can be configured to generate (e.g., calculate, etc.) one or more health scores. As an example, health score determinations may be distributed and based on determinations made via one or more components, systems, control units, etc.

Figure 19:
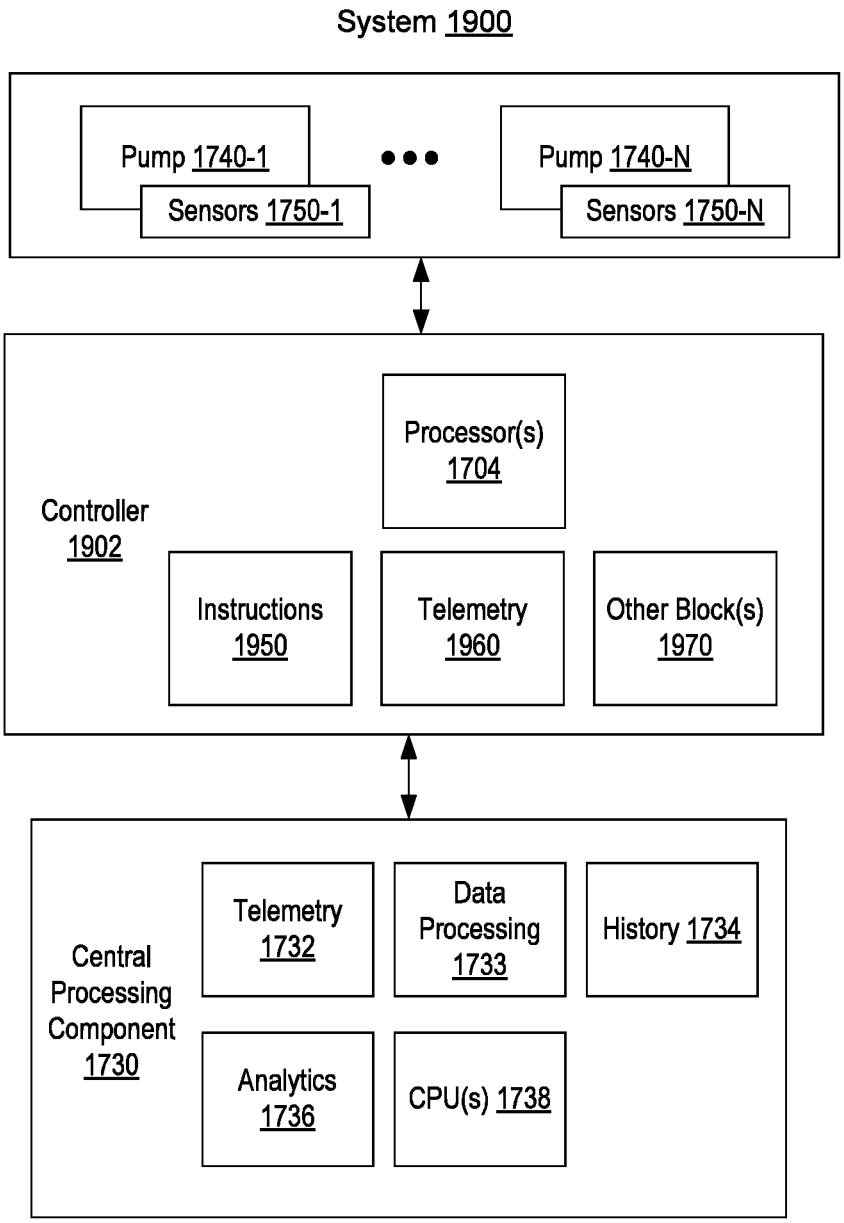
FIG. 19 illustrates an example of a system.

FIG. 19 depicts another example system 1900 that is configured to perform health monitoring and control of a fracturing pump fleet.

The system 1900 can include a controller 1902 that is in communication with a central processing component 1730, the pumps 1740-1 to 1740-N, and the sensors 1750-1 to 1750-N. As shown, the controller 1902 can be configured, via special computer instructions 1950, that instruct the controller processor 1704 to communicate with the central processing component 1730 upon commissioning at a field location. The controller 1902 can include a telemetry block 1960. The telemetry block 1960 can be the same or similar to those described herein above or below.

The computer instructions 1950 can instruct the controller processor 1704 to request from the central processing component analytic block 1736 models for the pump fleet, historical data for the pump fleet, and use input information for the pump fleet. For example, the computer instructions 1950 can instruct the controller processor 1704 to send a request for the information by sending the controller identification number and requesting an update, the central processing component 1730 can include an index that can identify the controller identification information in a data table. The data table can include information that is provided by a user (e.g., or computing system) that identifies the pumps associated with the controller 1902, the location of the controller 1902, and other operational information.

The central processing component 1730 can acquire models for the associated pumps 1740-1 to 1740-N and the sensors 1750-1 to 1750-N, historical data for the associated pumps, specifications for the associated pumps, and the like and send the associated information to the controller 1902, and the controller 1902 can store the information in the appropriate plurality of blocks 1970. For example, one or more blocks described herein can be included in the plurality of blocks 1970. For example, the plurality of blocks 1970 can include the data tagging block 1722, the analytics block 1724, the health score data block 1726, the data processing block 1728, user input information storage, other herein described data storage or blocks. In one or more embodiments, the information can be stored in an analytics block of the plurality of blocks 1970, a health history block of the plurality of blocks 1970, other block or blocks of the plurality of modules 1970, or combinations thereof.

After, the updated information is stored on the controller 1902, the controller 1902 can be configured by the computer instructions 1950 to automatically or upon input from an operator to start the fracturing operation. To start the fracturing operation the controller processor 1704 can be instructed, via computer instructions 1950 stored in the controller 1902, to identify inputted or received rate targets, pump fleet information including specifications of each pump of the pumps 1740-1 to 1740-N, and then optimally distribute load to the plurality of pumps 1740-1 to 1740-N of the pump fleet to reach (e.g., and/or maintain) the target pumping rate. As mentioned, a schedule may be provided that calls for dynamically adjusting a pumping rate with respect to time, for example, to ramp up or ramp down a rate.

As a fracturing operation is conducted, the controller 1902 can receive acquired data from the sensors 1750-1 to 1750-N that are obtaining data on performance conditions of the pumps 1750-1 to 1750-N. The acquired data can be similar to the acquired data described herein before or below. The acquired data can include metadata that include identification information for a corresponding individual associated pump. The controller 1902 can be configured to via computer instructions 1950 to use the metadata to provide a proper identification tag to the data and store the real-time acquired date in appropriate data table and link it with the associated pump and time stamp. The properly tagged acquired data can also be provided to an analytics block of the plurality of blocks 1970.

An analytics block of the plurality of blocks 1970 can instruct the controller 1704 to compare the acquired data to predetermined thresholds, and instruct the controller processor 1704 to take appropriate action depending on if the thresholds are exceeded or being approached, as described herein. Such an analytics block of the plurality of blocks 1970 can also use one or more analytic models to assign health risk numbers to each of the pumps and the controller processor 1704 can be instructed to take appropriate action.

The controller 1902 can periodically send the tagged acquired data, updated health information, update analytic models to the central processing component 1730 for storage and use at a new location.

Figure 20:
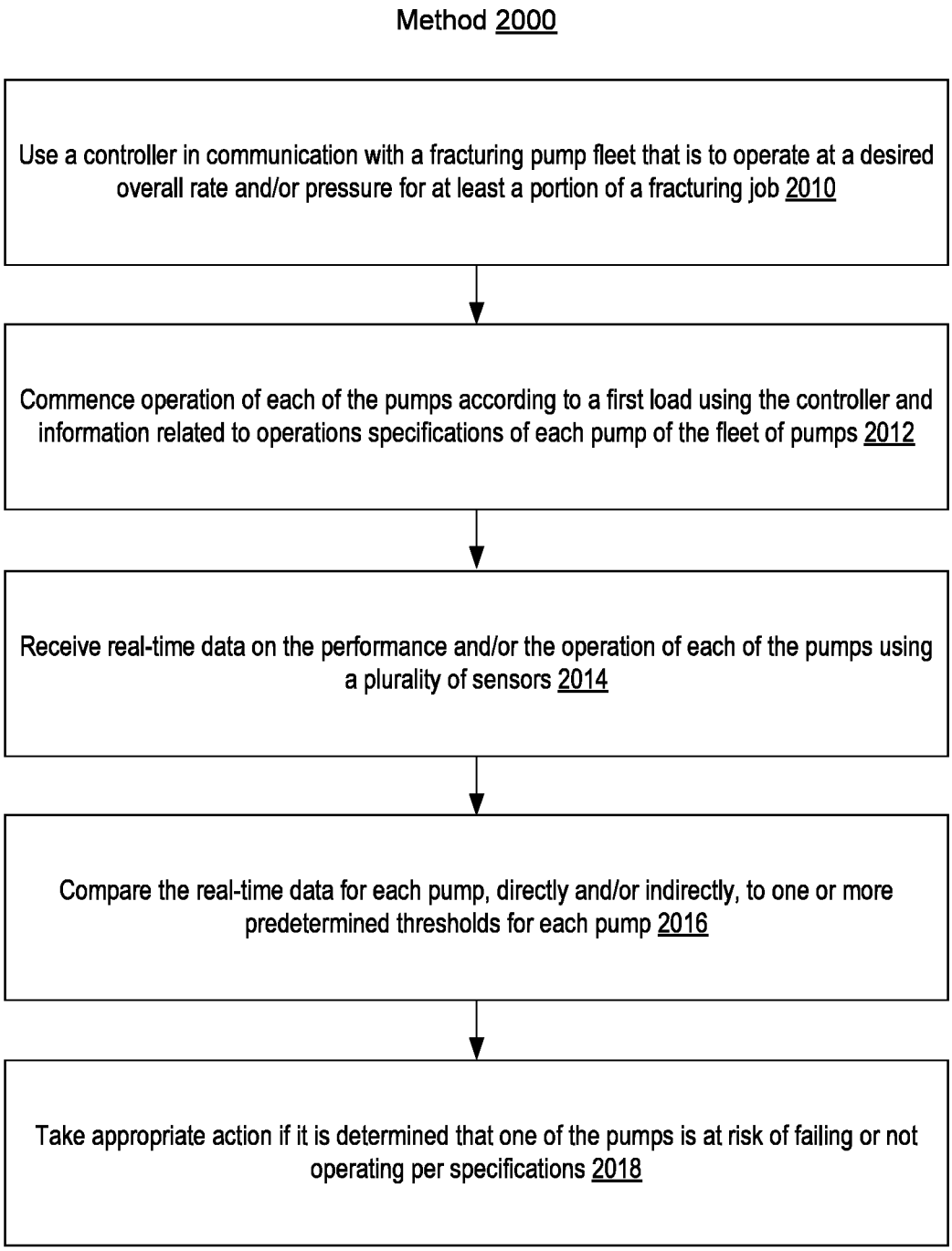
FIG. 20 illustrates an example of a method.

FIG. 20 shows an example of a method 2000 for controlling a fracturing pump fleet to account for an indication of one or more pumps of the pump fleet being degraded.

As shown, the method 2000 includes a utilization block 2010 for utilizing a controller in communication with a fracturing pump fleet that is to operate at a desired overall rate and/or pressure for at least a portion of a fracturing job; a commencement block 2012 for commencing operation of each of the pumps according to a first load using the controller and information related to operations specifications of each pump of the fleet of pumps; a reception block 2014 for receiving real-time data on the performance and/or the operation of each of the pumps using a plurality of sensors; a comparison block 2016 for comparing the real-time data for each pump, directly and/or indirectly, to one or more predetermined thresholds for each pump; an action block 2018 for taking appropriate action if it is determined that one of the pumps is at risk of failing or not operating per specifications.

The method 2000 can include using a controller in communication with a fracturing pump fleet that has a desired overall pump rate for a fracturing job. The desired overall rate and/or pressure for a fracturing job can be input to the controller using one or more techniques. For example, a pump rate may be input manually via a graphical user interface rendered to a display that is part of or operatively coupled to a computing device or, for example, a pump rate may be received via a system such as the control system 220 of FIG. 2 (see, e.g., the pumping rate adjustment block 236).

As an example, a desired overall rate for a fracturing pump fleet can be input to a data storage in communication with a processor of a controller by a user inputting the information to the controller, a download from a central processing center that had information inputted thereto, from a job planner in communication with the controller via the central processing component, a job planner in communication with the controller, another type of controller, etc. Such communication can be wired, wireless, or using another type or types of telemetry. In one or more embodiments, a portion can be entered using the central processing component and other portions can be entered locally by an operator inputting the information using a user interface.

The method 2000 can include having the controller processor using information related to operation specifications of each pump of the pump fleet to start each of the pumps and set each pump's load at a first load. For example, the controller processor can receive a start command from an operator, and computer instructions in communication with the controller processor can instruct the processor to apply a load to each pump using the operation specification and desired rate and/or pressure. The specifications can include max pump rate, max horsepower, pump performance curves, optimal operating curve, or the like. In one example, the controller processor can do this by retrieving an overall desired pump rate, the total number of pumps, the optimal operating rate for each pump, and summing the pump rate provided by each pump being operated in the optimal range, comparing the sum to the desired pump rate, and removing one or pumps from operation if the pump rate sum is too large, or if the sum is less than the desired rate, identifying the pumps with specifications on a max operation load rating that can be increased and still stay below a max operation load rating and increasing the rate of each pump until the sum of pump rate provided by each pump equals the desired fleet pump rate. Once the number of pumps is determined and the load for each pump is determined, the controller processor can start the pumps to the determined rate.

The method 2000 can include receiving real-time data on the performance and/or operation of each of the pumps using a plurality of sensors. The method 2000 can then include comparing the real-time data with each pump to a predetermined threshold for each individual pump. Such comparing can be performed by the controller processor, a gateway processor in communication with the controller, or a central processing component in communication with the controller via direct or indirect communication. An example of direct communication of the central processing component with the controller can be a cellular or satellite communication between a modem on the controller and a modem in communication with the central processing component. An example of indirect communication can include a controller telemetry module communicating with a gateway telemetry module on the gateway, and the gateway telemetry module or another modem communicating with a modem or telemetry module of the central processing component.

The method 2000 can include instructing the controller processor to take appropriate action if it is determined that one of the pumps is at risk of failing or not operating per specifications. For example, if the pump fleet has ten pumps, the real-time data can include engine oil temperature for a first pump and engine oil temperature for a second pump, and so forth for each pump in the pump fleet. As an example, an analytics block of the controller, in a gateway, in the central processing component, or combinations thereof can compare the real-time data related to the first pump to an engine oil temperature threshold for engine oil temperature of the first pump and the real-time data related to the second pump to an engine oil temperature threshold for the engine oil temperature of the second pump, and so forth. If pumps in the fleet have engine oil temperatures that are not near or above the threshold, the controller can maintain the operation in steady state, however, for example, if it is determined that the real-time engine oil temperature of the pump is above the threshold for the engine oil temperature of the first pump, the controller can be instructed to reduce the load of the first pump as much as possible and increase the other pump rates of the other nine pumps within specifications to maintain the desired operation pump rate while reducing the load and wear on the first pump. For example, if the remaining pumps can have their pump rates increased to provide an additional 10 percent of the desired pump rate and still be within specifications then the load on the first pump will be reduced 10 percent.

In another example, an analytics block on the controller, in a gateway, in the central processing component, or combinations thereof can input the real-time data into a PHM model and a PRP model, the PHM can use the real-time data to determine a health score using data analytics, and the PRP model can use historical data preinstalled and in communication with the analytics module, the real-time data, and a data analytics model to calculate a health score, and if the individual health scores or an average of the health scores are below a predetermined value, the controller can remove the pump from operation or reduce the load to prevent failure to the pump while increasing load on other pumps to maintain the desired pressure. To further illustrate, the pump fleet can include ten pumps, and real-time data related to run hours, oil pressure, coolant temperature, load conditions, and the like can be acquired for the each of the pumps. The data analytics module can include a pump PHM model for each of the ten pumps and a PRP model for each of the ten pumps. The real-time data for each pump can be inputted into the associated PHM models and the associated PRP models. Each of the models can generate a health score for the associated pump, and if the scores are above a predetermined score, the controller will maintain the fleet at a steady state operation; however, if a score or average associated with one of the pumps is lower than an acceptable health score, appropriate action can be taken. For example, if the first pump has one health score that is low and one that is high then an average can be taken and if the average is below the predetermined score, the first pump can be degraded or taken off line, if both scores are low for the first pump the first pump can be degraded or taken offline, if a health score for the first pump is low and the other health score for the first pump is high and average is above the predetermined score then the first pump can be maintained in steady state. The same process can be performed for the other nine pumps as well. In another example, the health score for a second pump and first pump can be below a predetermined value, and the first pump and second pump can be taken offline and the remaining eight pumps can have their rates increased to a maximum allowable rate or as much as appropriate to maintain the operation fleet pump rate at the desired level. In various examples, pump rate can be referred to as capacity, for example, a capacity to meet a specified pump rate. As an example, a fleet of pumps can have a dynamic capacity that can be tracked utilizing a system or systems. Such an approach can include assessing a demand capacity for an operation and balancing that demand capacity, if achievable, amongst at least some individual pumps in a fleet of pumps. As mentioned, a system can control a fleet of pumps utilizing particular operational knowledge of the fleet of pumps, which can include knowledge as to gears, current gear, prospective gear changes to meet demand, etc. As such, a system can implement a dynamic control process that can account for changes in various conditions within a fleet of pumps where, for example, a demand (e.g., as to a pump rate for an operation) can be dynamic (see, e.g., the system 200 of FIG. 2).

The analytics block can compare specific performance data to thresholds and may calculate health scores and then make a determination based on the results. For example, the health scores can be high and where one of the specific performance data can be below the threshold, but one of the specific performance data can exceed the threshold, therefore, the controller can adjust to reduce the load on the pump with the specific performance data that exceeds the threshold. In another example, the health scores can be good, and the specific performance data can be below the thresholds, therefore the controller processor can be sent to predetermined rules that can determine if the operation should be maintained in steady state or if adjustment is appropriate. The amount of reduction if a threshold is exceeded or health score is low can be predetermined and installed in computer instructions for the controller processor or in the analytics model. As an example, using outcomes of an analytics block, desired operation pressure and/or rate, the max allowable load on each pump, to determine how to adjust the loads about the pump fleet to maintain optimal operation and reduce wear or unexpected failure of one or more of the pumps.

Figure 21:
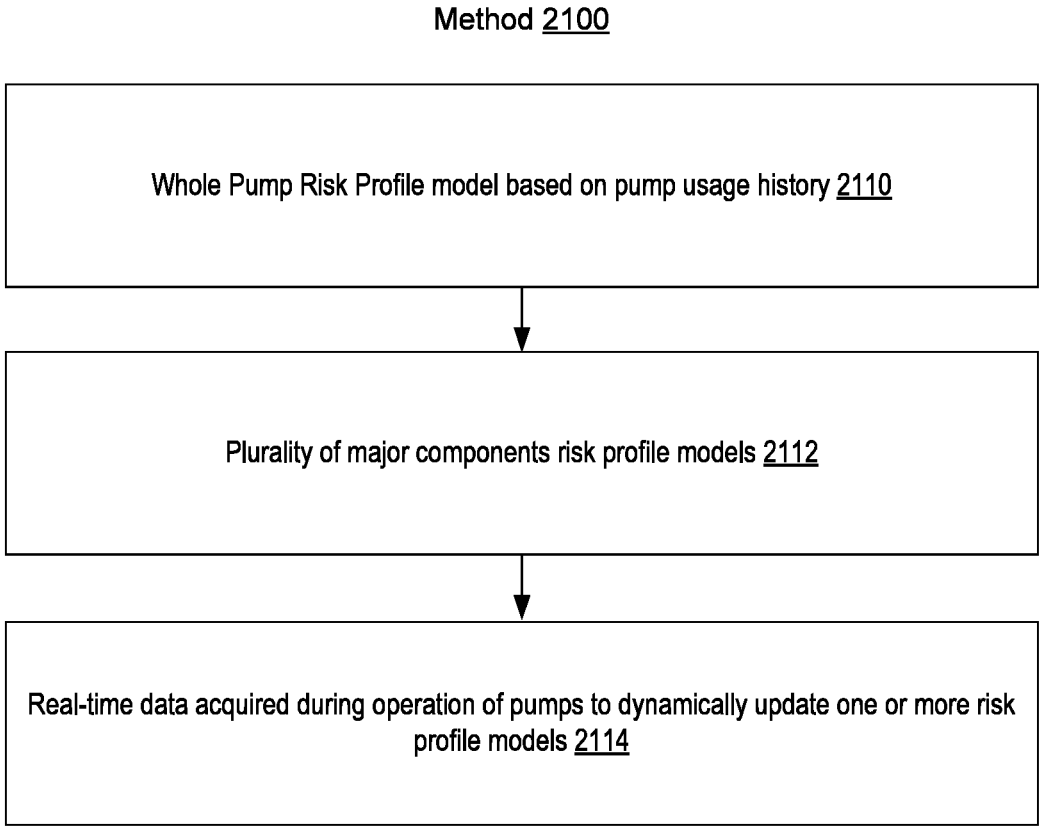
FIG. 21 illustrates an example of a method.

FIG. 21 shows a method 2100 that can include utilizing one or more block such as, for example, a whole Pump Risk Profile (PRP) model based on pump usage history block 2110, a plurality of major components risk profile models block 2112, and a real-time data acquired during operation of pumps to dynamically update one or more risk profile models block 2114. Such blocks can be utilized in a method that includes assigning a health score to one or more pumps.

As an example, a method can include using a whole PRP model based on pump usage history for computing a health score. A model can use historical data related to operation hours, equipment oil samples taken during routine maintenance, number of strokes performed, pressure history, number of shifts, previous maintenance, and the like for computing a health score. Such data can be acquired in conjunction with data collected during fracturing jobs, inputted by users, or combinations thereof.

As an example, a method can include using a plurality of major component risk profile models. For example, consider using major components risk profile models can include risk profile models for an engine, a transmission, a power end, and a fluid end. In such an example, the risk profile models can include historical information for each of the associated major components.

As an example, a method can include using real-time data acquired during operations of pumps to dynamically update one or more risk profile models. As an example, a health score for a whole pump and each of the major components can be calculated. As an example, a health score for a whole pump and each of the major components can be average to provide a system health score for a pump system (see, e.g., the pump 1630 of FIG. 16).

Figure 22:
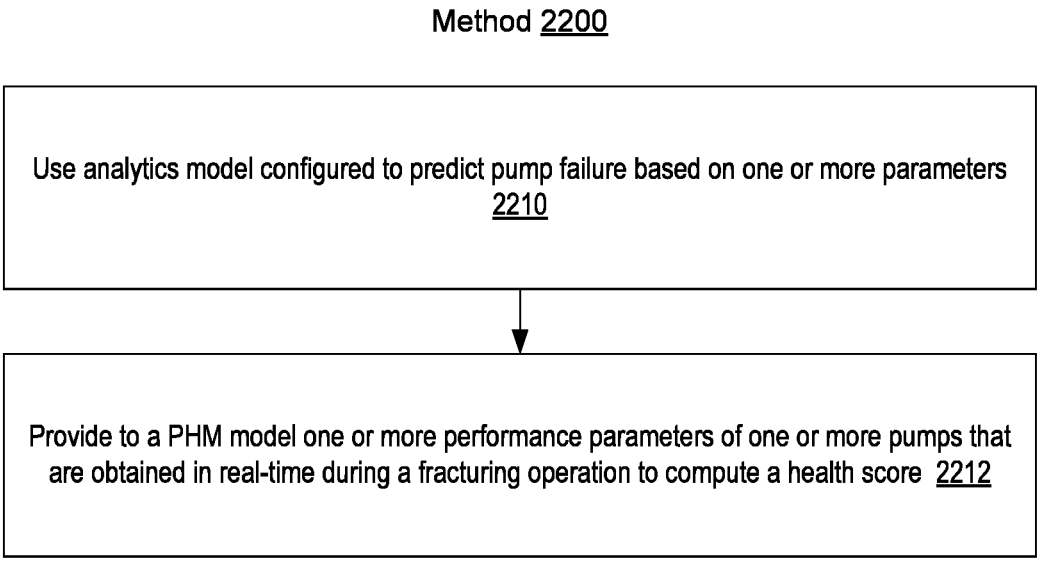
FIG. 22 illustrates an example of a method.

FIG. 22 shows an example of a method 2200 that includes a utilization block 2210 for using an analytics model configured to predict pump failure based on one or more parameters and a provision block 2212 for providing to a PHM model one or more performance parameters of one or more pumps that are obtained in real-time during a fracturing operation to compute a health score.

As an example, a method can include using an analytics model configured to predict pump failure based on one or more performance parameters where, for example, the performance parameters can include temperature, pressure, voltage, and the like. In such an example, the model can use statistical and other analytics to detect that likelihood that a pump will fail when the performance parameters are detected.

As an example, a method can include providing such one or more performance parameters of one or more pumps that are obtained in real-time during a fracturing operation to a PHM model where the PHM model uses the provided real-time performance parameters to calculate a health score.

Figure 23:
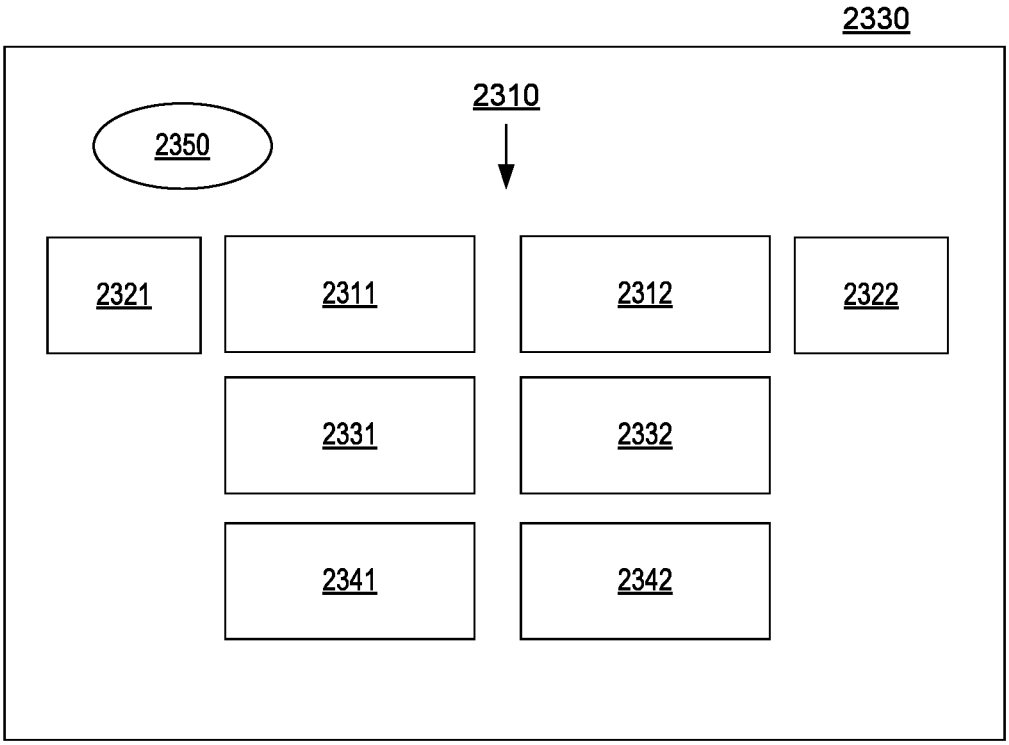
FIG. 23 illustrates an example of a system.

FIG. 23 shows an example of a system 2330 that includes using digital avatars to manage pumps in a fracturing pump fleet. In one or more embodiments, a plurality of digital avatars 2310 associated with the plurality of pumps can be in communication with the controller, gateway, or central processing component. Each digital avatar of the plurality of digital avatars 2310 is a digital representation of a unique one of the plurality of physical pumps. For example, a first digital avatar 2311 includes a first set of pump models that are linked to manufacturing information, operation specifications, prior operation information, maintenance information, and other information unique to the first pump, and a second digital avatar 2312 includes a second set of pump models linked to manufacturing information, operation specifications, prior operation information, maintenance information, and other information unique to the second pump, and can extend for any number of digital avatars associated with any number pumps. Accordingly, the number of digital avatars can be equal to the number of pumps and each avatar can be unique to a specific pump. The pump model can be physics or data driven or hybrid.

The plurality of digital avatars 2310 can also include life cycle models, analytics models, predictive forecast models, and display the run time, and real time parameters such as coolant temperature, transmission converter pressure, transmission converter temperature, load, rate, location of the pump, and other perimeters of the associated pump as well as any other data associated with a pump.

The digital avatars can be automatically updated in real-time to reflect the current status of the associated pump through sensor data, maintenance records, and frac job configuration data. The digital avatar can have the ability to assess the quality of the sensor data in real-time. The digital avatar models can automatically update upon receipt of sensor data, changes to maintenance records, or job configuration.

The digital avatars outputs can be sent to any one or the controller, gateway, or central processing component and can be displayed on a user interface. Digital avatar outputs can be stored locally or at the central control unit, or offsite on local servers or the cloud.

The digital avatars of each individual pump can be digitally combined to create a digital avatar of the pump fleet. Each pump avatar can share model data, inputs, and outputs for each of the types of models including the digital avatar with other pump digital avatars that are part of the fleet. Each pump fleet digital avatar can be created when the pumps are assigned to a fleet. The data output by the pump fleet digital avatar can be stored and can continue to exist after the fleet no longer exists.

The digital avatars can also have simulation models, allowing for an operator to simulate the operation of the individual pump or the entire pump fleet system forward in time from the current starting condition by adjusting the rate of one or more of the pumps, changing the proppant type, adjust wellhead information, or the like. From the simulation models, the operator can determine if the pump fleet should be manually adjusted to achieve a different fracturing result, operation rate, or to further optimize the system. The operator can also induce one or more failure into the simulation models to detect how one or more pumps going offline or other condition occurring will affect the entire pump fleet.

As shown in FIG. 23, a graphical user interface (UI) 2330 shows a digital avatar for each of the pumps in the pump fleet, two are shown but any number can be used. The UI also shows real-time operation parameters 2321, 2322, an indication of the remaining useful life 2331, 2332, and due date for maintenance for each pump 2341, 2342. The UI also has a graphical control (e.g., a button) 2350 to select the simulation mode where an operator can run simulations on an upcoming job or a current job. The simulation button can be linked with computer instructions that configure a processor in communication with the UI and digital avatars to run simulations using prestored models and user defined inputs, desired outputs, or combinations thereof. For example, a simulation can be done on an upcoming job with the planned deployment of pumps, and the simulation can determine if the planned pumps for the fleet will be sufficient to provide the appropriate pressure and/or rate, are likely to run without failure during the job, and how certain failure will affect the pump fleet. Accordingly, a frac job planner can determine if additional pumps, or different individual pumps, are to be added to the pump fleet to ensure optimal fracturing job performance. The frac job planner can also run simulations on the pump frac fleet, associate a digital avatar or dynamic model of the reservoir and formation, and run differing job parameters to determine the appropriate pump rate to achieve the desired fracture clusters. The simulation can use unique pump specifications and operating parameters that are stored in and assigned to the Digital Avatar associated with the pump. Therefore, the simulation can account for and be able to use real-time specifications of each pump via the digital avatar.

In one or more embodiments, one or more of the controller, the gateway, the central processing component, or combinations thereof can include a rate suspension algorithm that instructs a processor to freeze total pump rate under different fracturing job scenarios. The rate suspension algorithm can be configured to maintain the rate at a measured rate value when receiving a suspension command or keep the rate as low as possible without any additional gear change.

This rate suspension algorithm has four main functions. The functions include identifying gear-changing pumps, automatically deciding future rate of gear-changing pumps, automatically selecting of compensating pumps, and automatically deciding future rate of compensating pump.

The rate suspension algorithm can be configured to cause the processor to execute actions to automatically identify gear-changing pumps.

The rate suspension algorithm can use different methods to decide if a pump is in the middle of gear-changing process. For example, the rate suspension algorithm can instruct the processor to: compare a desired rate with a rate from a current acquisition cycle, check pump lockup status from a current acquisition cycle, check desired gear with pump gear from a current acquisition cycle, or combinations thereof.

The rate suspension algorithm can also configure the controller to keep a list of previous gear-changing pumps.

The rate suspension algorithm can configure the processor to perform multiple checks to decide if previous gear changing pumps have finished the gear changing process upon receipt of a rate suspension command.

The rate suspension algorithm can also configure the processor to return a list of current gear-changing pumps to the controller.

The rate suspension algorithm can also configure the controller processor to automatically decide future rate of gear-changing pumps. To do this the rate suspension algorithm instructs the controller processor to inquire the current automation status of gear-changing pumps and decide what the future rate is to be based on the automation status.

For example, the rate suspension algorithm configures the processor to inquire the current status of gear-changing pumps, decides the future rate based on current status and does one of the following: keep previous rate if gear hasn't change, keep previous rate if gear has been changed; or leave the pump un-touched if previous two conditions are not met.

The rate suspension algorithm can also configure the controller to automatically select compensating pumps. The rate suspension algorithm maintains an order of pumps to be engaged, and selects the compensating pumps based on the order.

The rate suspension algorithm also causes the controller processor to exclude gear-changing pumps from the total pump list, identify available compensating pumps by checking for compensating pumps that are in communication, not in instant idle, and are assigned, and selecting the remaining compensating pumps.

The rate suspension algorithm configures the controller to decide the future rate of the selected compensating pumps. The rate suspension algorithm instructs the controller processor to put the compensating pumps at an optimal rate if it is enough to compensate rate increase from gear-shifting pumps. The rate suspension algorithm can place the compensating pumps in their gear minimal rate if the optimal rate does not provide sufficient rate.

For example, the rate suspension algorithm can instruct the controller processor to loop through the pumps; calculate current gear based on previous target rate on the pump, calculate the optimal rate which is when throttle to from about 1550 rpm to about 1750 rpm, for example, the optimal rate can be when the pumps is throttled to about 1650 rpm.

The rate suspension algorithm then sets the pump to optimal rate and end if the rate increase can be compensated.

However, if having the pumps at optimal rate is not enough to compensate the rate increase, the rate suspension algorithm can instruct the controller processor to loop through the pumps, for each pump, calculate current gear based on previous target rate on the pump, calculate the minimal rate which is when throttle around from about 1350 rpm to about 1600 rpm, for example, the minimal rate can be when the pumps is throttled to about 1550 rpm. The rate suspension algorithm can then instruct the controller processor to set the pump to minimal rate and stop if the rate increase can be compensated.

Figure 24:
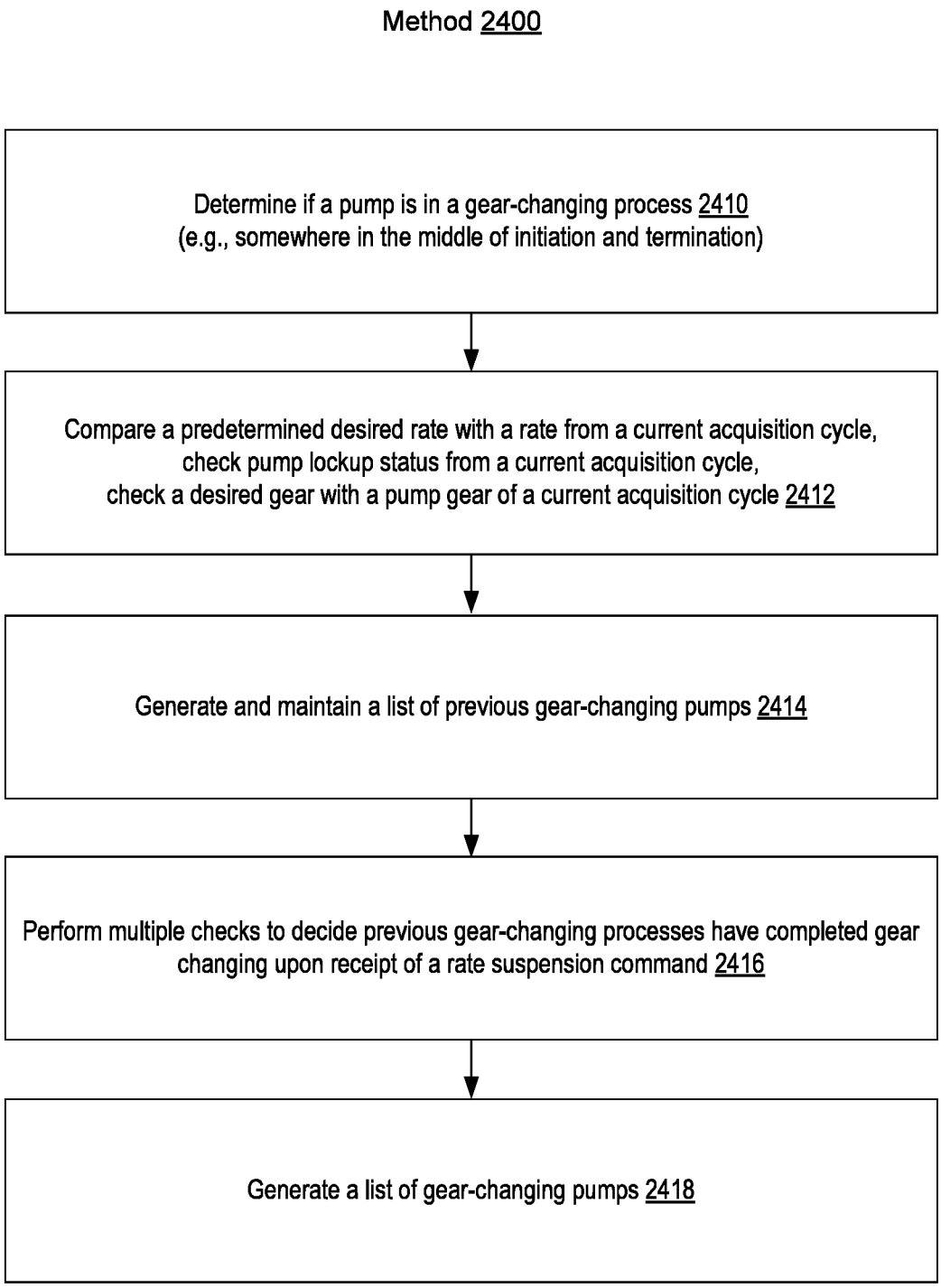
FIG. 24 illustrates an example of a method.

FIG. 24 shows an example of a method 2400 of instructing a processor to identify gear-changing pumps. As shown, the method 2400 can include instructing the processor, such as a controller processor, to determine if a pump is in the middle of a gear-changing process per a determination block 2410. The method 2400 can also include instructing the processor to compare a predetermined desired rate with a rate from a current acquisition cycle, check pump lockup status from a current acquisition cycle, and/or check a desired gear with a pump gear of a current acquisition cycle per a comparison block 2412. For example, the processor can be configured to compare a predetermined desired rate of pumps that may be above or below the rate limits of the current pump gear, indicating a gear shift would be demanded to achieve the desired rate. In another example, the processor can determine the lockup status of the pump to determine if a gear transition is currently in progress. In another example, the processor can check the desired gear which may be different from the current gear, indicating a gear shift is planned.

The method 2400 can also include instructing the processor to generate and keep a list of previous gear-changing pumps per a generation block 2414 (e.g., a history of gear changes, a gear state table, etc.). For example, when a new rate is selected by the operator, the processor plans how to achieve this rate. Achieving the new rate may demand that some pumps are to change gear. A list of pumps that will change gear is created and stored. During the execution process, the method for rate suspension can access this list to determine which pumps are shifting gears.

The method 2400 can also include instructing the controller processor to perform a multiple check to decide previous gear-changing operations have finished gear changing process upon receipt of a rate suspension command per a performance block 2416. The rate suspension command can be generated by checking the current gear against the desired gear. Once the current gear has changed to the desired gear, the gear shift is considered complete. The method 2400 may also include a generation block 2418 for generating a list of gear-changing pumps.

Figure 25:
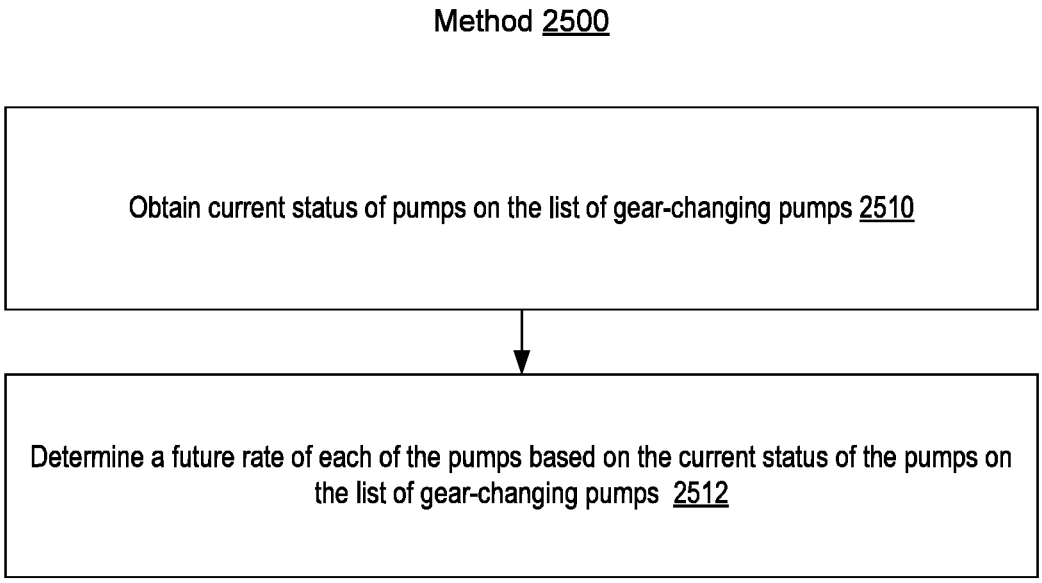
FIG. 25 illustrates an example of a method.

FIG. 25 shows an example of a method 2500 of instructing a processor to identify future rate of gear-changing pumps. As shown, the method 2500 can include instructing the processor, such as a controller processor, to obtain current status of pumps on the list of gear-changing pumps per a status block 2510 (e.g., obtain current status). The status of the pumps can include the current gear, rate, and lockup status, as well as desired rate and gear. As shown, the method 2500 can also include determining a future rate of each pump based on the current status of the pumps on the list of gear-changing pumps per a determination block 2512.

As an example, the controller processor can be instructed to keep the previous rate if a gear has not changed, keep the new rate if the gear has changed, or leave the pump un-touched if neither has occurred.

Figure 26:
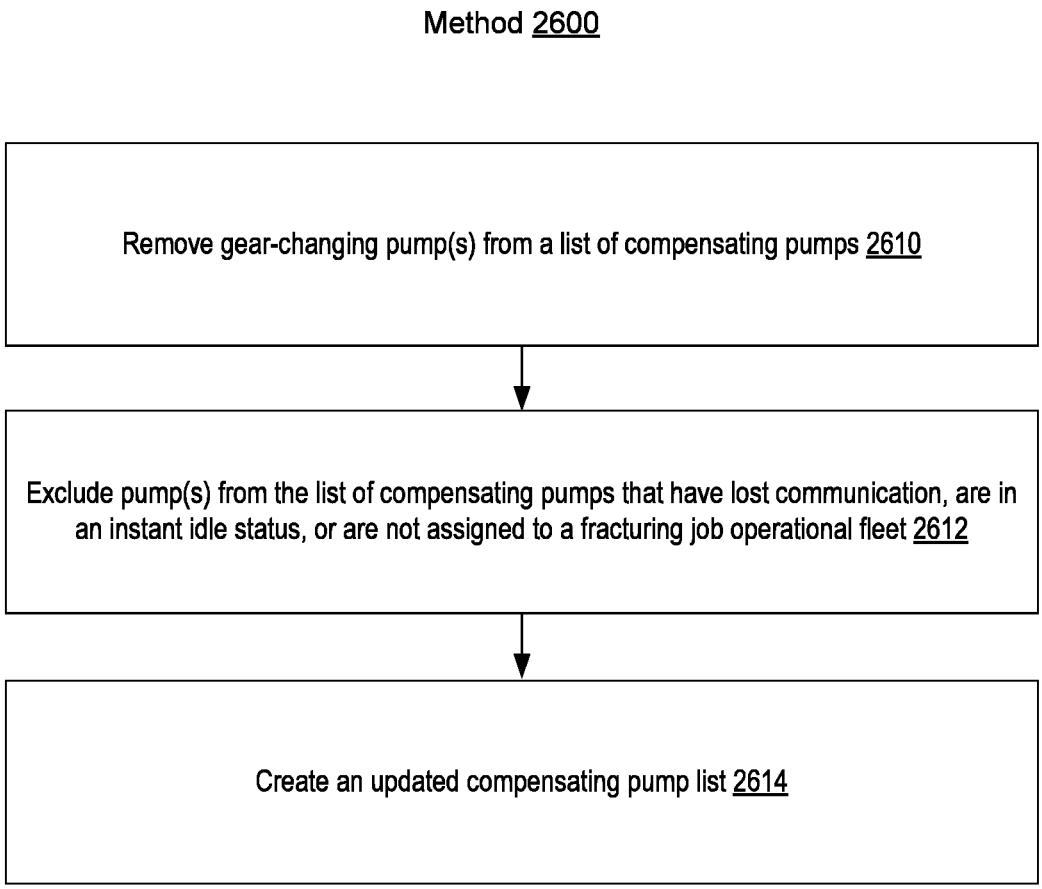
FIG. 26 illustrates an example of a method.

FIG. 26 shows an example of a method 2600 of instructing a controller processor to select compensating pumps. As shown, the method 2600 can include instructing the processor to remove gear-changing pumps from a list of compensating pumps per a removal block 2610. As shown, the method 2600 can also include excluding pumps from a list of compensating pumps that have lost communication, are in an instant idle status, or are not assigned to the fracturing job fleet per an exclusion block 2612. As shown, the method 2600 can include instructing the processor to create an updated compensating pump list per a creation block 2614.

Figure 27:
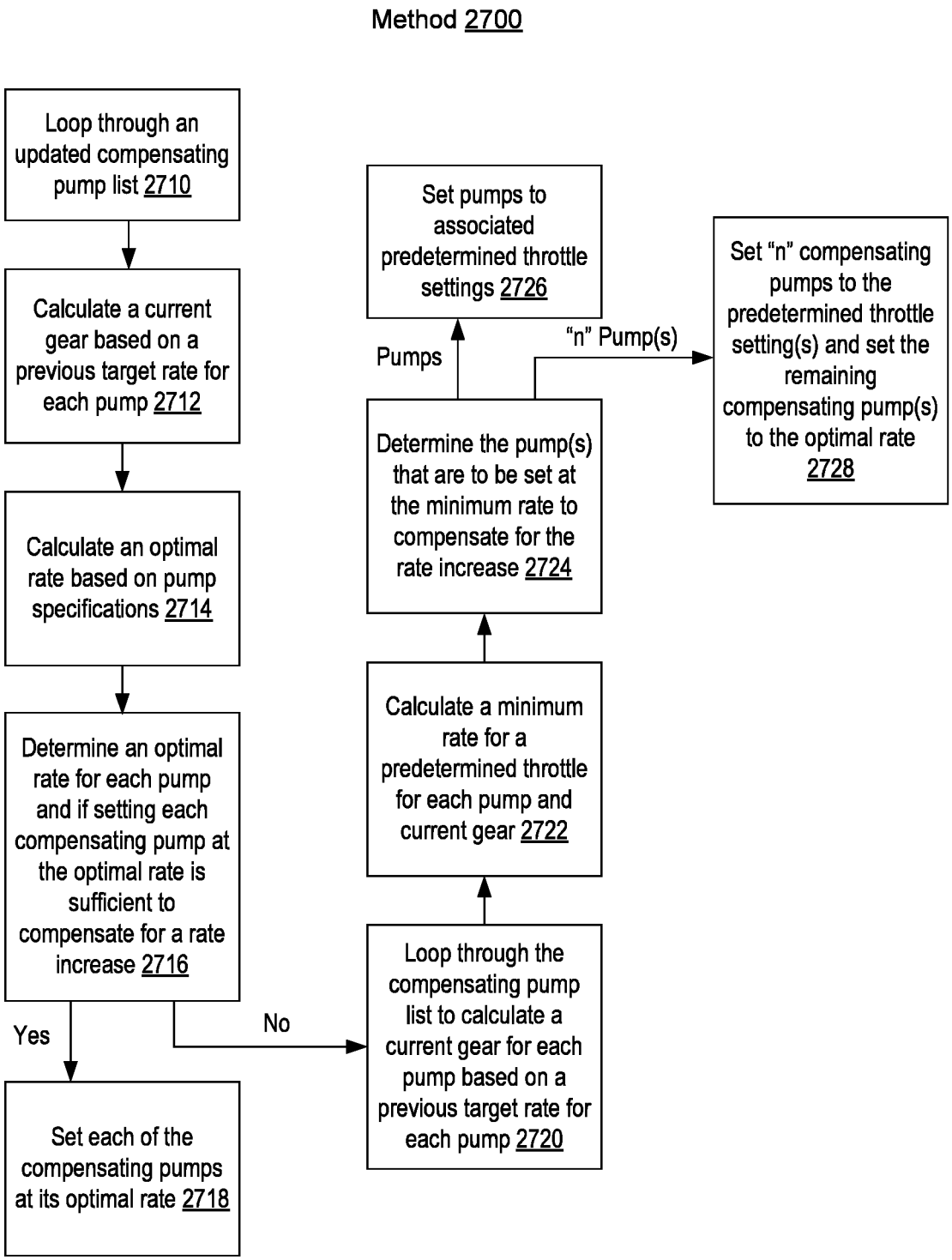
FIG. 27 illustrates an example of a method.

FIG. 27 shows an example of a method 2700 of instructing a processor to decide a future rate of compensating pumps. As shown, the method 2700 includes instructing the processor to loop through an updated compensating pump list per a loop block 2710. In such an example, the updated pumping list can be generated as described above as in the method 2600 of FIG. 26. In FIG. 27, the method 2700 can also include instructing the processor to calculate a current gear based on a previous target rate for each pump per a calculation block 2712. For example, based on the previous target rate, the possible gears which include this rate can be determined. The gear which will achieve the previous target rate at a throttle closest to optimum throttle can be chosen if the rate is achievable in multiple gears.

As shown, the method 2700 can also include instructing the processor to calculate the optimal rate based on the pump specifications per a calculation block 2714. For example, based upon the pump specifications, an optimal rate which optimizes fuel efficiency for power delivered can be determined (e.g., gasoline, diesel, natural gas, single fuel, bi-fuel, etc.).

As shown, the method 2700 can also include instructing the processor to determine the optimal rate for each pump and if setting each compensating pump at the optimal rate is sufficient to compensate for the rate increase per a determination block 2716; noting that, if setting each compensating pump at the optimal rate is sufficient to compensate for the rate increase, the method 2700 can include instructing the processor to set the compensating pumps at the associated optimal rate per a set block 2718 (see, e.g., "yes" branch, as the block 2716 can be a decision block). As indicated, where a rate increase cannot be compensated for with compensating pumps at the optimal rate, the method 2700 can include instructing the processor to loop through the compensating pump list and for each pump to calculate a current gear for each pump based on previous target rate for each pump per a calculation block 2720 (see, e.g., "no" branch, as the block 2716 can be a decision block). The method 2700 can also include instructing the processor to calculate the minimum rate for a predetermined throttle for each pump and current gear per a calculation block 2722, which can follow the block 2720.

As shown in the example of FIG. 27, the method 2700 can include determining the pumps that are to be set at minimum rate to compensate for rate increase per a determination block 2724. In such an example, where compensating pumps are to be set at a minimum rate to compensate for a rate increase, the method 2700 can include instructing the processor to set the pumps to the associated predetermined throttle per a set block 2726 (see, e.g., the branch "pumps"). As an example, where an n number of compensating pumps are to be set at the minimum rate with the remaining pumps set at the optimal rate, the method 2700 can include instructing the processor to set n compensating pumps to the predetermined throttle and to set the remaining compensating pumps to the optimal rate per a set block 2728 (see, e.g., the branch "'n' pump(s)").

Figure 28:
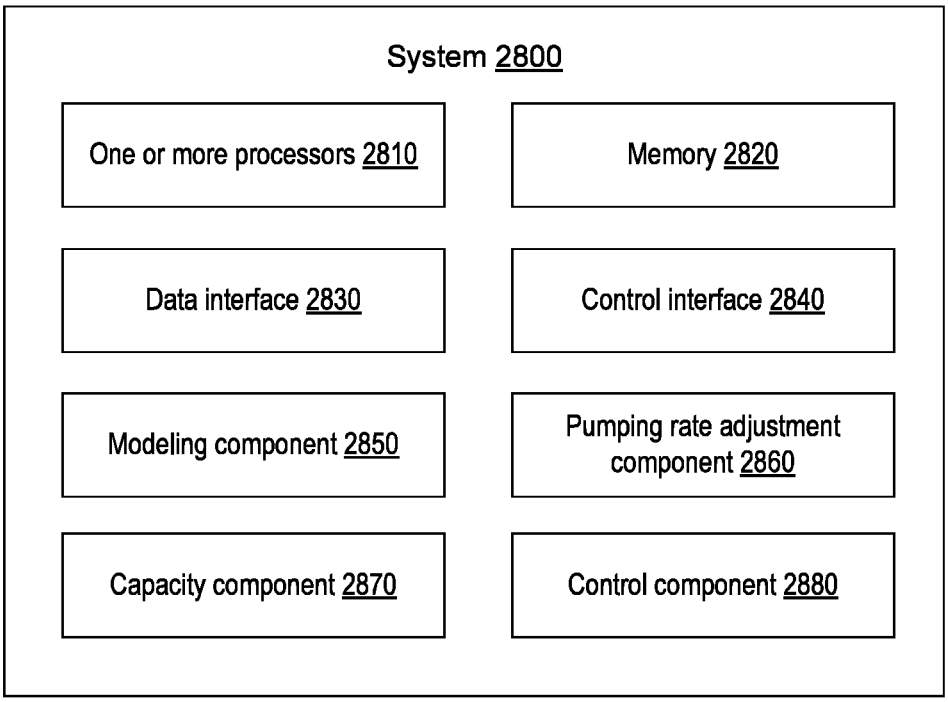
FIG. 28 illustrates an example of a system and example methods.
Figure 28:
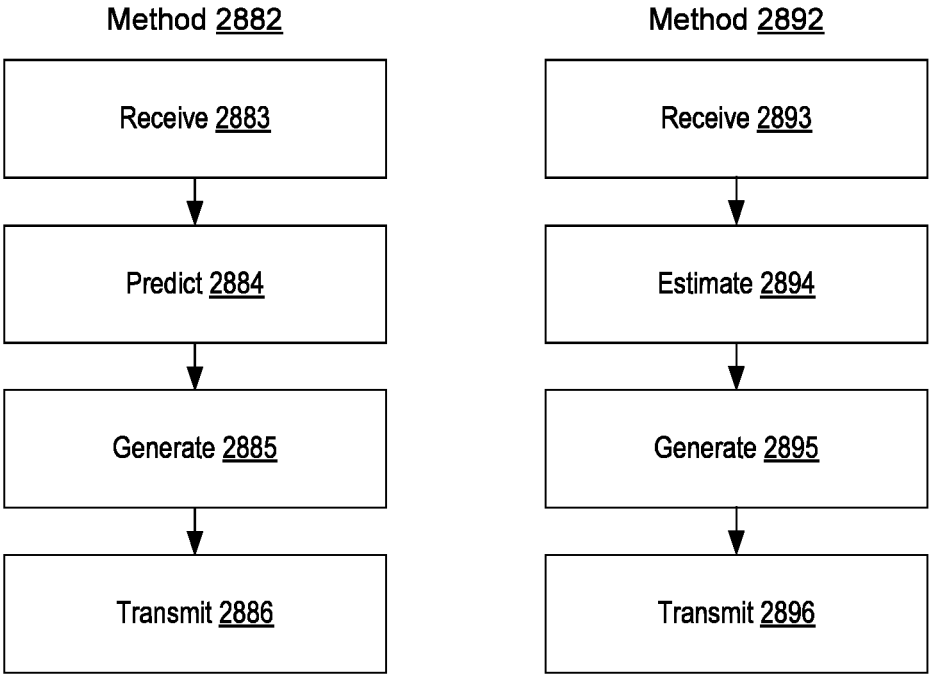

FIG. 28 shows an example of a system 2800 that includes one or more processors 2810; memory 2820 accessible to at least one of the one or more processors 2810; a data interface 2830 that receives data acquired by one or more sensors operatively coupled to one or more pumps, where the one or more sensors can include a pump discharge pressure transducer and a pumping rate sensor; a control interface 2840 that transmits control signals to at least one of the one or more pumps; a modeling component 2850 (see, e.g., the block 230 of FIG. 2), operatively coupled to at least one of the one or more processors 2810, that predicts pressure in a well using a model, an intended pumping rate, and at least a portion of the data indicative of an actual pumping rate and a well head pressure estimate, where the well is fluidly coupled to at least one of the one or more pumps; and a pumping rate adjustment component 2860 (see, e.g., the block 236 of FIG. 2), operatively coupled to at least one of the one or more processors 2810, that, in a predicted pressure mode, generates, using a predicted pressure of the modeling component and a pressure threshold, a pumping rate control signal for transmission via the control interface 2840.

As shown the system 2800 of FIG. 28 can include the data interface 2830 that can receive real-time data for individual pumps in a fleet of pumps during a hydraulic fracturing operation; the control interface 2840 that can transmit control signals for control of each of the individual pumps in the fleet of pumps during the hydraulic fracturing operation; a capacity component 2870, operatively coupled to at least one of the one or more processors 2810, that estimates a real-time pumping capacity for each of the individual pumps in the fleet of pumps using at least a portion of the real-time data, where an estimated real-time pumping capacity for the fleet of pumps computed using the estimates is less than a maximum specified pumping capacity for the fleet of pumps due to operational degradation of at least one of the individual pumps; and a control component 2880, operatively coupled to at least one of the one or more processors 2810, that, for a target pumping rate for the fleet of pumps during the hydraulic fracturing operation, generates at least one of engine throttle and transmission gear settings for each of the individual pumps using the estimated real-time pumping capacity for each of the individual pumps, where the settings are transmissible via the control interface 2840 as one or more of the control signals.

As an example, the system 2800 can include the blocks 2810, 2820, 2830, 2840, 2850 and 2860 and optionally the blocks 2870 and 2880. As an example, the system 2800 can include the blocks 2810, 2820, 2830, 2840, 2870 and 2880 and optionally the blocks 2850 and 2860.

In FIG. 28, an example method 2882 includes a reception block 2883 for receiving data acquired by one or more sensors operatively coupled to one or more pumps, where the one or more sensors include a pump discharge pressure transducer and a pumping rate sensor; a prediction block 2884 for predicting pressure in a well using a model, an intended pumping rate, and at least a portion of data indicative of an actual pumping rate and a well head pressure estimate, where the well is fluidly coupled to the one or more pumps; a generation block 2885 for generating, in a predicted pressure mode, a pumping rate control signal using the predicted pressure and a pressure threshold; and a transmission block 2886 for transmitting the pumping rate control signal via a control interface to control operation of the at least one of the one or more pumps.

In FIG. 28, an example method 2892 includes a reception block 2893 for receiving real-time data for individual pumps in a fleet of pumps during a hydraulic fracturing operation; an estimation block 2894 for estimating a real-time pumping capacity for each of the individual pumps in the fleet of pumps using at least a portion of the real-time data, where an estimated real-time pumping capacity for the fleet of pumps computed using the estimates is less than a maximum specified pumping capacity for the fleet of pumps due to operational degradation of at least one of the individual pumps; a generation block 2895 for generating, for a target pumping rate for the fleet of pumps during the hydraulic fracturing operation, at least one of engine throttle and transmission gear settings for each of the individual pumps using the estimated real-time pumping capacity for each of the individual pumps; and a transmission block 2896 for transmitting the settings via a control interface as one or more control signals that control each of the individual pumps in the fleet of pumps during the hydraulic fracturing operation.

As an example, the system 2800 can be utilized at least in part to perform one or more methods such as, for example, one or more of the methods described with reference to FIGS. 1 to 28.

As an example, the system 2800 can provide for reservoir aware optimization that can involve optimizing for production efficiency (e.g., over time) and, for example, one or more of cost of drilling, completion/frac treatment as well as minimizing risk of frac hits, screenouts, and other losses (e.g., fluid loss, etc.), equipment utilization optimization (e.g., efficiency, maintenance, health, etc.), etc.

As an example, a pump fleet control system can include at least one processor; and a set of computer instructions that upon receipt of a signal cause the processor to maintain a pumping rate as low as possible by configuring the processor to: identify gear-changing pumps; automatically decide future rate of gear-changing pumps; automatically select compensating pumps; and set a future rate of each compensating pump.

As an example, computer instructions can configure a processor to set a future rate of each compensating pump, by instructing the processor to: loop through an updated compensating pump list; calculate a current gear based on a previous target rate for each compensating pump; calculate an optimal rate for each compensating pump based on the compensating pumps specifications; determine the optimal rate for each compensating pump and determine if the setting each compensating pump at the optimal rate is sufficient to maintain the pump rate as low as possible by compensating for a determined rate increase do to pumps in gear change; and, if yes, then set the compensating pumps at the optimal rate; whereas, if no, then cause the processor to: loop though the compensating pump list and for each pump calculate a current gear for each pump based on previous target rate for each pump; calculate the minimum rate for a predetermined throttle for each pump and current gear; and determine the compensating pumps that are to be set at a minimum rate to compensate for the rate increase, and if that involves each of the compensating pumps then setting the compensating pumps at the minimum rate; and, if that involves a portion of the compensating pumps, set the portion at the minimum rate and set the remain portion of compensating pumps at the optimal rate.

As an example, a method of controlling a flow rate of a pump fleet can include using one or more processors in communication with at least one memory having a preinstalled desired fleet pump rate; communicating near real-time information to the one or more processors; where the one or more processors determine pump health of each pump in the pump fleet with one or more of the processors using a PRP model, a PHM model, or both stored in memory and in communication with the one or more of the processors; obtaining a health score from the PRP, the PHM model, or both; the one or more processors determining from the health score, pumps that are to be removed from operation or given a reduced pump rate; the one or more processors determining from the health score and operational specifications of each pump, the pumps that have available pump rate; the one or more processors determining the reduction on pump fleet due to pumps being removed from operation or given a reduced pump rate, and determining the amount of increase pump rate demand from the pumps that have available pump rate; the one or more processors issuing commands to take appropriate action on the identified pumps to maintain the desired fleet pump rate. As an example, various actions can be performed using a controller processor, for example, to perform the determining and issuing. In such an example, a gateway processor may perform the determining and a controller processor may perform the issuing.

As an example, a system can include a controller processor, a gateway processor, and at least one cloud processor, where the processors are in communication with each other, and where the gateway processor provides structured data and commands to the controller processor and the at least one cloud processors, and where the at least one cloud processor does the determining and the controller processor does the issuing.

As an example, a pump fleet control system can include at least one processor; a plurality of pumps, and a plurality of sensors, where the sensors are in communication with the plurality of pumps to acquire data on the operation of each of the plurality of the pumps, and where the sensors are in communication with the at least one processor; at least one memory in communication with the at least one processor, where the at least one memory includes: a PRP model, a PHM model, or both; computer instructions to instruct the at least one processor to provide the acquired data to the PRP model, the PHM model, or both and determine a health score for each pump of the plurality of pumps; computer instructions to determine pumps that are to be taken offline or given a reduced pump rate based on the health score; computer instructions to determine pumps that have available pump rate based on the health score and operation parameters for each of the pumps of the plurality of the pumps; computer instructions to determine the pump fleet pump rate after the identified pumps are taken offline or given a reduced pump rate, and the pumps to be given an increased pump rate based on the determination of available pump rate, computer instructions to issue commands to take appropriate action on the identified pumps to maintain the desired fleet pump rate.

As an example, a pump fleet control system can include a plurality of digital avatars associated with pumps of the pump fleet, where each digital avatar can be specialized to and associated with a specific one of the pumps of the pump fleet.

As an example, a system can include a user interface that depicts an indication of remaining useful life for each pump of a pump fleet via use of one or more digital avatars. In such an example, a system can include instructions linked to a simulation button on the user interface that allows a user, to run a simulation on an upcoming or current job, by adjusting desired rates of each pump in the pump fleet. As an example, a system can include a first digital avatar associated with a first pump, and a second digital avatar associated with a second pump, where the first digital avatar includes information specific to the first pump and the second digital avatar differs as it includes information specific to the second pump.

As an example, a pump fleet control system can include at least one processor; and a set of computer instructions that upon receipt of a signal cause the processor to maintain the rate as low as possible by configuring the processor to: identify gear-changing pumps; automatically decide future rate of gear-changing pumps; automatically select compensating pumps; and set a future rate of each compensating pump. In such an example, instructions can be included to set a future rate of each compensating pump, by instructing the processor to: loop through an updated compensating pump list; calculate a current gear based on a previous target rate for each compensating pump; calculate an optimal rate for each compensating pump based on the compensating pumps specifications; determine the optimal rate for each compensating pump and determine if the setting each compensating pump at the optimal rate is sufficient to maintain the pump rate as low as possible by compensating for a determined rate increase do to pumps in gear change; and, if yes, then set the compensating pumps at the optimal rate; whereas, if no, then cause the processor to: loop though the compensating pump list and for each pump calculate a current gear for each pump based on previous target rate for each pump; calculate the minimum rate for a predetermined throttle for each pump and current gear; and determine the compensating pumps that are to be set at a minimum rate to compensate for the rate increase, and if it is the entire fleet of compensating pumps then setting those compensating pumps at the minimum rate; and, if it is a portion of the compensating pumps, then setting that portion at the minimum rate and setting the remain portion of compensating pumps at the optimal rate.

As an example, a method of controlling a flow rate of a pump fleet can include using one or more processors in communication with at least one memory having a preinstalled desired fleet pump rate and communicating near real-time information to the one or more processors. The one or more processors can then provide for determining the pump health of each pump using a PRP model and PHM model in memory and in communication with one or more of the processors. A health score may be obtained from at least one of the PRP model or PHM model, and the one or more processors can include determining from the health score pumps that are to be removed from operation or given a reduced pump rate.

As an example, a system can include one or more processors; memory accessible to at least one of the one or more processors; a data interface that receives data acquired by one or more sensors operatively coupled to one or more pumps, where the one or more sensors include a pump discharge pressure transducer and a pumping rate sensor; a control interface that transmits control signals to at least one of the one or more pumps; a modeling component, operatively coupled to at least one of the one or more processors, that predicts pressure in a well using a model, an intended pumping rate, and at least a portion of the data indicative of an actual pumping rate and a well head pressure estimate, where the well is fluidly coupled to at least one of the one or more pumps; and a pumping rate adjustment component, operatively coupled to at least one of the one or more processors, that, in a predicted pressure mode, generates, using a predicted pressure of the modeling component and a pressure threshold, a pumping rate control signal for transmission via the control interface. In such an example, the at least a portion of the data indicative of an actual pumping rate includes data acquired by the pumping rate sensor.

As an example, a system can include a well head pressure estimation component, operatively coupled to at least one processor, that receives, via a data interface, data acquired by a pump discharge pressure transducer to generate a well head pressure estimate. In such an example, a data filtering component, operatively coupled to at least one processor, can filter the data acquired by the pump discharge pressure transducer to generate filtered data where the well head pressure estimation component receives the filtered data. As to filtering of data, it can include various operations, which can include outlier removal, exclusion of partial data, exclusion of data outside of one or more time and/or other limit(s), etc.

As an example, a system can include an interface that receives treating pressure versus pumping rate data, where a pumping rate adjustment component, in an alternative mode (e.g., alternative to a predicted pressure mode), generates a pumping rate control signal using the treating pressure versus pumping rate data without using a predicted pressure (e.g., of a predicted pressure mode).

As an example, a system can include an interface that receives an upgraded model that is an upgrade to a model of a pumping rate adjustment component. In such an example, a model update component can receives one or more inputs to a modeling component, that receives the pumping rate control signal, that utilizes the one or more inputs to a modeling component and a pumping rate control signal to determine accuracy of the pumping rate control signal, and that updates the model based at least in part on the determined accuracy.

As an example, a modeling component can include a pressure friction model that predicts a friction pressure that is a function of pumping rate and a fluid friction property. For example, consider a system that includes a pressure friction model update component that receives pump down pressure data and that updates the pressure friction model using at least a portion of the pump down pressure data. In such an example, the pump down pressure data can include pressure data from an operation that pumps down a perforation unit into a subterranean tubular (e.g. a wellbore, etc.). As an example, a pressure friction model may utilize one or more instantaneous shut-in pressures (ISIPs) and one or more pressures prior to a shut-in for one or more stages of hydraulic fracturing to determine one or more friction pressures. In such an example, a system can utilize the one or more friction pressures to adjust a friction pressure curve and utilize the adjusted friction pressure curve to estimate a friction pressure for a subsequent stage of hydraulic fracturing. In such an example, the system can utilize the adjusted friction pressure curve to estimate a bottom hole pressure. As an example, a system can include a component that analyzes the estimated bottom hole pressure to determine one or more treatment abnormalities and indicia of a screenout. In such an example, the system can include a component that utilizes the indicia of a screenout to generate a pumping rate control signal to generate a pumping rate control signal for transmission via a control interface to change a pumping rate.

As an example, a system can include a pressure change rate component, operatively coupled to at least one processor, that generates a pressure change rate using a well head pressure estimate and historical pressure data and that outputs the pressure change rate to a modeling component, where the modeling component generates a predicted pressure using the pressure change rate.

As an example, a system can include a cluster component that generates estimates of fracture coverage that depend on one or more operational parameters. In such an example, a pumping rate control signal generated by a pumping rate adjustment component can be implemented in a manner dependent on one or more of the estimates of fracture coverage. As an example, a cluster component can generate estimates of fracture coverage that depend on step down test data. Such an approach can include utilizing step down test equipment to perform a step down test or step down tests to acquire step down test data.

As an example, a system can include a cluster component that analyzes pressure and flow rate to estimate at least one of perforation dominance and tortuosity dominance of a fracturing operation. In such an example, the cluster component may utilize step down test data.

As an example, a system can include a cluster component that estimates fracture coverage as estimates based on delivery of fluid via perforations of a stage of a multi-stage hydraulic fracturing operation. Such a component may include features of one or more computational frameworks.

As an example, a pumping rate adjustment component can generate a pumping rate control signal to optimize fracture coverage.

As an example, a method can include receiving data acquired by one or more sensors operatively coupled to one or more pumps, where the one or more sensors include a pump discharge pressure transducer and a pumping rate sensor; predicting pressure in a well using a model, an intended pumping rate, and at least a portion of data indicative of an actual pumping rate and a well head pressure estimate, where the well is fluidly coupled to the one or more pumps; generating, in a predicted pressure mode, a pumping rate control signal using the predicted pressure and a pressure threshold; and transmitting the pumping rate control signal via a control interface to control operation of the at least one of the one or more pumps. As an example, such a method can include operating in an alternative mode where generating generates the pumping rate control signal using treating pressure versus pumping rate data without using the predicted pressure. As an example, a method may include mode switching, which may occur via input from a graphical user interface, via one or more signals, via data analysis, etc. As an example, a method can include determining a mode and implementing the determined mode for purposes of pumping rate control.

As an example, a method can include generating a pumping rate control signal by utilizing a pressure friction model that predicts a friction pressure that is a function of pumping rate and a fluid friction property. In such an example, the pressure friction model can, for example, depend on pump down pressure data from an operation that pumps down a perforation unit into a subterranean tubular and/or depend on one or more instantaneous shut-in pressures (ISIPs) and one or more pressures prior to a shut-in for one or more stages of hydraulic fracturing (see, e.g., the plot 1000 of FIG. 10, the plot 1230 of FIG. 12, etc.).

As an example, a method can include utilizing a friction pressure curve to estimate a bottom hole pressure and, where the bottom hole pressure is indicative of screenout (e.g., an elevated a risk, a high probability, etc.), generating an adjusted pumping rate control signal for reducing risk of screenout and transmitting the adjusted pumping rate control signal via the control interface to control operation of the at least one of the one or more pumps.

As an example, a method can include generating estimates of fracture coverage that depend on one or more operational parameters, where the generating the pumping rate control signal depends on one or more of the estimates of fracture coverage. As an example, one or more simulations, one or more step down tests, etc., may be performed for generating one or more estimates of fracture coverage (see, e.g., FIGS. 7, 8, 14, etc.).

As an example, a system can include one or more processors; memory accessible to at least one of the one or more processors; a data interface that receives real-time data for individual pumps in a fleet of pumps during a hydraulic fracturing operation; a control interface that transmits control signals for control of each of the individual pumps in the fleet of pumps during the hydraulic fracturing operation; a capacity component, operatively coupled to at least one of the one or more processors, that estimates a real-time pumping capacity for each of the individual pumps in the fleet of pumps using at least a portion of the real-time data, where an estimated real-time pumping capacity for the fleet of pumps computed using the estimates is less than a maximum specified pumping capacity for the fleet of pumps due to operational degradation of at least one of the individual pumps; and a control component, operatively coupled to at least one of the one or more processors, that, for a target pumping rate for the fleet of pumps during the hydraulic fracturing operation, generates at least one of engine throttle and transmission gear settings for each of the individual pumps using the estimated real-time pumping capacity for each of the individual pumps, where the settings are transmissible via the control interface as one or more of the control signals. In such an example, the control component can include at least one pressure model that generates a predicted pressure where the target pumping rate depends at least in part on the predicted pressure.

As an example, a capacity component can include at least one health model that models health of at least one of the individual pumps. As an example, a capacity component can include at least one pump risk profile model that models risk of failure of at least one of a plurality of individual pumps.

As an example, data received via a data interface can include engine control unit (ECU) data from individual ECUs of corresponding individual pumps and/or can include transmission control unit (TCU) data from individual TCUs of the corresponding individual pumps.

As an example, a control component can generate a shut down setting for one of a plurality of individual pumps. For example, a shut down setting can be generated responsive to an indication from a capacity component that the one of the individual pumps is at an elevated risk of failure in comparison to the other individual pumps. In such an example, the control component can generates at least one of engine throttle and transmission gear settings for each of the remaining individual pumps to compensate for the shut down setting of the one of the individual pumps.

As an example, a control component can generate a plurality of settings for individual pumping rates of a time dependent schedule to achieve a target pumping rate for a fleet of pumps during a hydraulic fracturing operation. In such an example, the plurality of settings can call for a first ramp up of a first one of the individual pumps to a first determined pumping rate and second ramp up of a second one of the individual pumps to a second determined pumping rate and/or a first determined pumping rate and a second determined pumping rate can be the same or can be different (e.g., the first determined pumping rate and the second determined pumping rate can differ) and/or a first ramp up and a second ramp up can differ as to at least one of engine throttle and transmission gear settings with respect to time.

As an example, a control component can generate schedules of transmission gear settings for each of a plurality of individual pumps where a first of the schedules for a first one of the individual pumps differs from a second of the schedules for a second one of the individual pumps. In such an example, control signals can include gear shift control signals that depend on actual engine speed data where, for example, the actual engine speed data are received in real-time via the data interface.

As an example, a system can include a tagging component that tags real-time data for proper association with each of a plurality of individual pumps. In such an example, the system can include a health score for each of the individual pumps that is computed using computational resources using at least a portion of the tagged data. In such an example, a capacity component can utilize the health scores to estimate the real-time pumping capacity for each of the individual pumps in a fleet of pumps.

As an example, a system can provide for updating a pump risk profile for each individual pump in a fleet of pumps using at least a portion of the tagged data.

As an example, a system can include a computation component that compute a health score for each individual pump in a fleet of pumps using at least a portion of tagged data. In such an example, a capacity component can utilize the health scores to estimate the real-time pumping capacity for each of the individual pumps in the fleet of pumps.

As an example, a system can include an update component that updates a pump risk profile for each individual pump in a fleet of pumps using at least a portion of tagged data where, for example, a capacity component utilizes the updated pump risk profiles to estimate a real-time pumping capacity for each of the individual pumps in the fleet of pumps.

As an example, a real-time pumping capacity can be specified as hydraulic horsepower (HHP). As an example, a real-time pumping capacity can depend on real-time power output capacity of a corresponding pump diesel engine, operatively coupled to a transmission, where the transmission is operatively coupled to a pump unit.

As an example, a system can include an efficiency component, operatively coupled to at least one processor, that estimates an efficiency of at least one component of each individual pump in fleet of pumps. For example, consider efficiency being that of a diesel engine (e.g., diesel engine efficiency) for utilization of diesel fuel. As an example, an engine may be a single or a bi-fuel engine (e.g., natural gas and diesel, etc.). As an example, a control component can generate at least one of engine throttle and transmission gear settings using at least one of estimated efficiency. For example, consider each of a plurality of individual pumps as including a diesel engine where settings include transmission gear settings that optimize utilization of diesel fuel by the diesel engines.

As an example, a system can include a digital avatar component that includes at least one digital representation of at least one individual pump in a fleet of pumps. In such an example, the digital avatar component can simulate behavior of the individual pumps in the fleet of pumps using the digital avatar component prior to transmission of the control signals to the individual pumps in the fleet of pumps. In such an example, where simulation results of the digital avatar component indicate that the target pumping rate is not met, a control component can re-generate settings and update at least one of a PHM model and a pump risk profile (PRP) model to account for control signals that increase demand placed on at least one of the individual pumps.

As an example, a digital avatar component or components can simulate efficiency of one or more individual pumps in a fleet of pumps and act to optimize efficiency via optimizing at least one of engine throttle and transmission gear for one or more individual pumps in the fleet of pumps.

As an example, a method can include receiving real-time data for individual pumps in a fleet of pumps during a hydraulic fracturing operation; estimating a real-time pumping capacity for each of the individual pumps in the fleet of pumps using at least a portion of the real-time data, where an estimated real-time pumping capacity for the fleet of pumps computed using the estimates is less than a maximum specified pumping capacity for the fleet of pumps due to operational degradation of at least one of the individual pumps; generating, for a target pumping rate for the fleet of pumps during the hydraulic fracturing operation, at least one of engine throttle and transmission gear settings for each of the individual pumps using the estimated real-time pumping capacity for each of the individual pumps; and transmitting the settings via a control interface as one or more control signals that control each of the individual pumps in the fleet of pumps during the hydraulic fracturing operation. In such an example, the method can include generating, in a predicted pressure mode, the target pumping rate utilizing a predicted pressure from at least one pressure model; or generating, in an alternative mode, the target pumping rate utilizing treating pressure versus pumping rate data without utilizing the predicted pressure.

As an example, a method can include estimating a real-time pumping capacity in a manner that utilizes at least one health model that models health of at least one individual pump of a fleet and/or at least one pump risk profile model that models risk of failure of at least one individual pump of a fleet.

As an example, a method can include generating a shut down setting for one individual pump in a fleet of individual pumps, where the shut down setting is generated responsive to an indication that the one of the individual pumps is at an elevated risk of failure, and where such a method can include generating at least one of engine throttle and transmission gear settings for each of the remaining individual pumps to compensate for the shut down setting of the one of the individual pumps.

As an example, a method can include generating a plurality of settings for individual pumping rates of a time dependent schedule to achieve a target pumping rate for a fleet of pumps during a hydraulic fracturing operation, where the plurality of settings calls for a first ramp up of a first one of the individual pumps to a first determined pumping rate and second ramp up of a second one of the individual pumps to a second determined pumping rate.

As an example, a method can include generating schedules of transmission gear settings for each individual pump in a fleet of individual pumps, for example, where a first of the schedules for a first one of the individual pumps differs from a second of the schedules for a second one of the individual pumps. In such an example, schedules may depend on conditions, target rate, changes to a target rate, etc. As to conditions, consider current gear, efficiency (e.g., as to one or more fuels, ability to generate HHP from BHP, etc.), fluid conditions (e.g., surfactant, proppant, etc.), feedback from microseismic monitoring (e.g., as to fracture growth, extent of fracture growth, distance from an offset well, distance from a feature such as a fault, etc.). As an example, a schedule may be dynamic in that it can be changed in real-time responsive to conditions, desired fracture characteristics, etc. Such a schedule may be determined, for example, to account for conditions and/or changed thereto, where one or more pumps of a fleet of pumps are operated differently than one or more other pumps of the fleet of pumps. As an example, a system such as the system 2800 of FIG. 28 may be utilized to generate and/or control a dynamic schedule. As an example, a dynamic schedule can include information as to maintenance of one or more pumps in a fleet of pumps, which may be generated at least in part during and/or responsive to performing one or more hydraulic fracturing operations utilizing such one or more pumps. For example, consider a scenario where one of the pumps is driven to compensate for another pump that is shut down due to a risk of failure. A maintenance schedule for either or both pumps may depend on such control where, for example, the maintenance schedule can be output during and/or after performance of one or more hydraulic fracturing operations. As an example, a system may operate in a manner that aims to minimize demand for immediate post-operation maintenance, which may be in a manner that accounts for a number of stages of a multi-stage hydraulic fracturing job. For example, if a stage is not a last stage, a system can aim to minimize demand for immediate post-operation maintenance such that time to complete the job is optimized (e.g., a reduction in non-productive time (NPT)). As explained, a capacity component can provide for tracking of capacity of a fleet of pumps (e.g., HHP, etc.) where a system may utilize a capacity of a last stage of a multi-stage hydraulic fracturing job to manage utilization of the fleet of pumps for prior stages of the job. In such an example, the system can aim to reduce NPT, optimize non-final stages of the job, etc., in a manner that aims to assure capacity is available for a final stage of the job where, the system can also optimize operation of the pumps of the fleet during the final stage of the job. As an example, a method can include receiving an estimate of capacity demand for performing a final stage of a multi-stage hydraulic fracturing job and utilizing the estimate in controlling operation of pumps of a fleet of pumps to be utilized for performing the multi-stage hydraulic fracturing job. Such a method can include preserving capacity of the fleet of pumps for performing the final stage, for example, by controlling pumps during prior stages to manage health, risk of failure, etc., which can include operating one or more of the pumps according to output of one or more models (e.g., PRP, PHM, etc.). In such an example, the method may aim to optimize an entire job in a manner that may have some tradeoffs at one or more individual stages where such optimization can aim to reduce NPT due to failure of one or more pumps (e.g., with respect to capacity, etc.).

Figure 29:
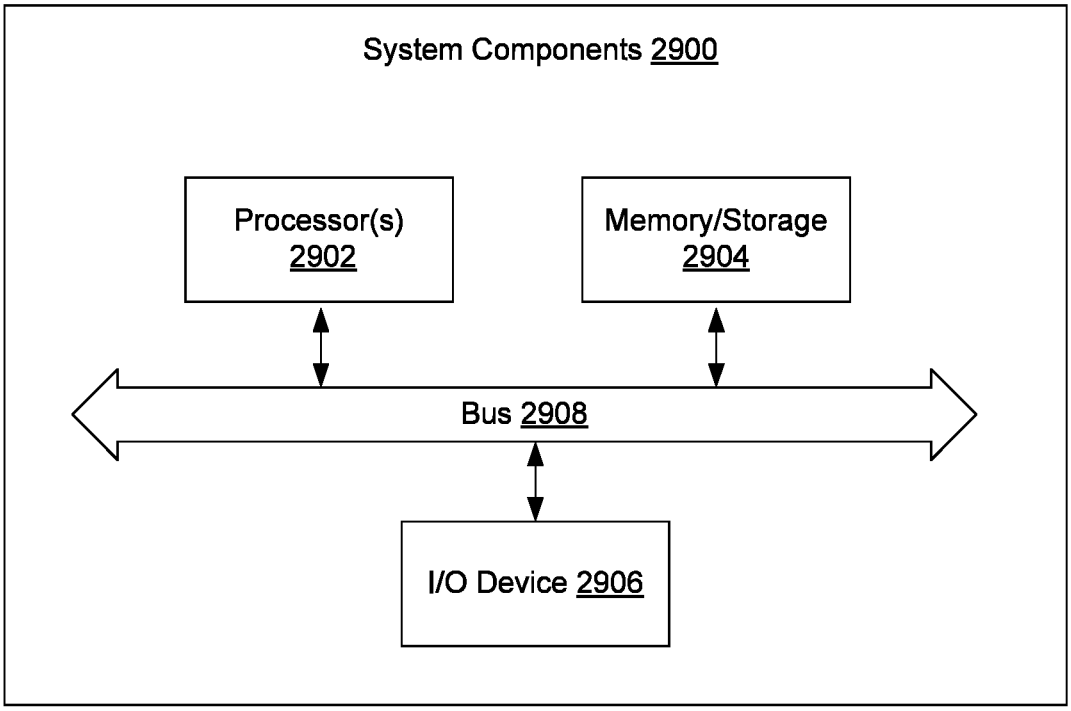
FIG. 29 illustrates example components of a system and a networked system.
Figure 29:
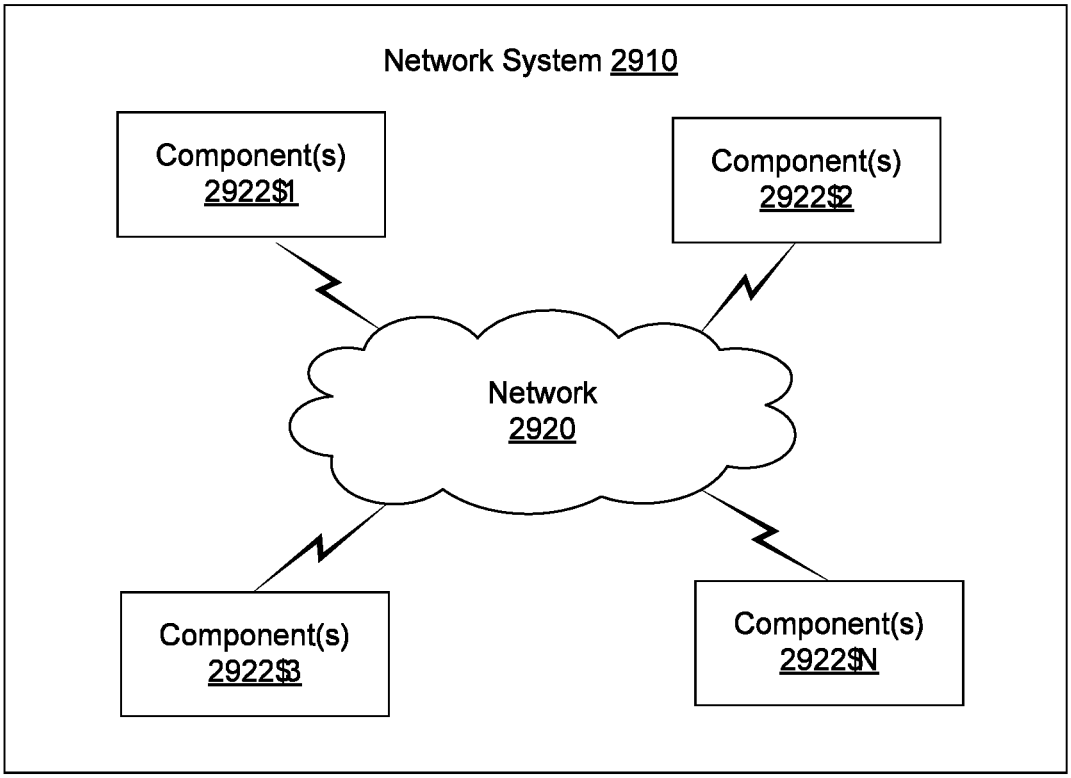

FIG. 29 shows components of an example of a computing system 2900 and an example of a networked system 2910. As an example, the system 2800 of FIG. 28 may include one or more features of the system 2900 and/or the networked system 2910. The system 2900 includes one or more processors 2902, memory and/or storage components 2904, one or more input and/or output devices 2906 and a bus 2908. In an example embodiment, instructions may be stored in one or more computer-readable media (e.g., memory/storage components 2904). Such instructions may be read by one or more processors (e.g., the processor(s) 2902) via a communication bus (e.g., the bus 2908), which may be wired or wireless. The one or more processors may execute such instructions to implement (wholly or in part) one or more attributes (e.g., as part of a method). A user may view output from and interact with a process via an I/O device (e.g., the device 2906). In an example embodiment, a computer-readable medium may be a storage component such as a physical memory storage device, for example, a chip, a chip on a package, a memory card, etc. (e.g., a computer-readable storage medium).

In an example embodiment, components may be distributed, such as in the network system 2910. The network system 2910 includes components 2922-1, 2922-2, 2922-3, . . . 2922-N. For example, the components 2922-1 may include the processor(s) 2902 while the component(s) 2922-3 may include memory accessible by the processor(s) 2902. Further, the component(s) 2902-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service). As an example, a framework may be implemented at least in part in a cloud environment.

As an example, a mobile device may be configured with a browser or other application (e.g., app, etc.) that can operatively couple to cloud resources and, for example, optionally to local resources (e.g., equipment at a rig site, wireline site, etc.). For example, a system can include performing computations locally and/or remotely where rendering of a log or logs may occur locally and/or remotely. Remote rendering may be to a mobile device where, for example, a user can see, optionally in real time, maturity values for a formation or formations, which may be from induction measurements acquired in one or more boreholes and processed by a system.

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.). Although only a few example embodiments have been described in detail above, those skilled in the art will readily appreciate that many modifications are possible in the example embodiments. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A system comprising:

a memory storing instructions;

one or more processors configured to execute the instructions, wherein the instructions, when executed by the one or more processors, cause the one or more processors to:

receive, from one or more sensors, real-time operational data from individual pumps in a fleet of pumps indicative of an operation of the individual pumps during a hydraulic fracturing operation;

receive degradation data indicative of an amount of degradation for each of the individual pumps in the fleet of pumps;

determine an estimated real-time pumping capacity for each of the individual pumps based on the operational data, the degradation data and a maximum specified pumping capacity for the fleet of pumps;

generate, for a target pumping rate for the fleet of pumps during the hydraulic fracturing operation, at least one of engine throttle and transmission gear settings for each of the individual pumps using the estimated real-time pumping capacity for each of the individual pumps; and transmit, via a control interface, the at least one of engine throttle and transmission gear settings as one or more of the control signals to at least one of the individual pumps.

2. The system of claim 1, wherein the system further comprises at least one pressure model that generates a predicted pressure and wherein the target pumping rate depends at least in part on the predicted pressure.

3. The system of claim 1, wherein the system further comprises at least one health model that models health of at least one of the individual pumps.

4. The system of claim 1, wherein the system further comprises at least one pump risk profile model that models risk of failure of at least one of the individual pumps.

5. The system of claim 1, wherein the real-time operational data comprise at least one of engine control unit (ECU) data from individual ECUs of the corresponding individual pumps and transmission control unit (TCU) data from individual TCUs of the corresponding individual pumps.

6. The system of claim 1, wherein the one or more processors generate a shut down setting for one of the individual pumps, wherein the shut down setting is generated responsive to an indication that the one of the individual pumps is at an elevated risk of failure in comparison to the other individual pumps.

7. The system of claim 6, wherein the one or more processors generate the at least one of engine throttle and transmission gear settings for each of the remaining individual pumps to compensate for the shut down setting of the one of the individual pumps.

8. The system of claim 1, wherein the one or more processors generate a plurality of settings for pumping rates for each of the individual pumps of a time dependent schedule to achieve the target pumping rate for the fleet of pumps during the hydraulic fracturing operation.

9. The system of claim 8, wherein the plurality of settings calls for a first ramp up of a first one of the individual pumps to a first determined pumping rate and second ramp up of a second one of the individual pumps to a second determined pumping rate.

10. The system of claim 9, wherein the first determined pumping rate and the second determined pumping rate are the same.

11. The system of claim 9, wherein the first determined pumping rate and the second determined pumping rate differ.

12. The system of claim 9, wherein the first ramp up and the second ramp up differ as to at least one of engine throttle and transmission gear settings with respect to time.

13. The system of claim 1, wherein the one or more processors generate schedules of transmission gear settings for each of the individual pumps and wherein a first of the schedules for a first one of the individual pumps differs from a second of the schedules for a second one of the individual pumps.

14. The system of claim 13, wherein the control signals comprise gear shift control signals that depend on actual engine speed data for each of the individual pumps, wherein the actual engine speed data are received in real-time via a data interface.

15. The system of claim 1, wherein the instructions, when executed by the one or more processors, cause the one or more processors to determine a health score for each of the individual pumps using at least a portion of the real-time operational data, wherein the one or more processors utilize the health scores to estimate the real-time pumping capacity for each of the individual pumps in the fleet of pumps.

16. The system of claim 1, wherein the real-time pumping capacity for each of the individual pumps depends on real-time power output capacity of a corresponding pump diesel engine, operatively coupled to a transmission, wherein the transmission is operatively coupled to a pump unit.

17. The system of claim 1, further comprising at least one digital representation of at least one of the individual pumps in the fleet of pumps.

18. The system of claim 17, wherein the one or more processors simulate behavior of the individual pumps in the fleet of pumps prior to transmission of the control signals to the individual pumps in the fleet of pumps.

19. The system of claim 18, wherein the one or more processors simulate efficiency of the individual pumps in the fleet of pumps and acts to optimize efficiency via optimizing at least one of engine throttle and transmission gear for the individual pumps in the fleet of pumps.

20. A method comprising:

receiving, from one or more sensors, real-time operational data for individual pumps in a fleet of pumps indicative of an operation of the individual pumps during a hydraulic fracturing operation;

receiving degradation data indicative of an amount of degradation for each of the individual pumps in the fleet of pumps;

determining an estimated real-time pumping capacity for each of the individual pumps based on the operational data, the degradation data and a maximum specified pumping capacity for the fleet of pumps;

generating, for a target pumping rate for the fleet of pumps during the hydraulic fracturing operation, at least one of engine throttle and transmission gear settings for each of the individual pumps using the estimated real-time pumping capacity for each of the individual pumps; and transmitting the settings via a control interface as one or more control signals that control each of the individual pumps in the fleet of pumps during the hydraulic fracturing operation.

21. The method of claim 20, further comprising generating, in a predicted pressure mode, the target pumping rate utilizing a predicted pressure from at least one pressure model; or generating, in an alternative mode, the target pumping rate utilizing treating pressure versus pumping rate data without utilizing the predicted pressure.

22. The method of claim 20, further comprising generating a shut down setting for one of the individual pumps, wherein the shut down setting is generated responsive to an indication that the one of the individual pumps is at an elevated risk of failure; and, wherein, the generating the at least one of engine throttle and transmission gear settings for each of the individual pumps generates the at least one of engine throttle and transmission gear settings for each of the remaining individual pumps to compensate for the shut down setting of the one of the individual pumps.

23. The method of claim 20, further comprising generating a plurality of settings for individual pumping rates of a time dependent schedule to achieve the target pumping rate for the fleet of pumps during the hydraulic fracturing operation, wherein the plurality of settings calls for a first ramp up of a first one of the individual pumps to a first determined pumping rate and second ramp up of a second one of the individual pumps to a second determined pumping rate.

24. The method of claim 20, wherein the generating comprises generating schedules of transmission gear settings for each of the individual pumps wherein a first of the schedules for a first one of the individual pumps differs from a second of the schedules for a second one of the individual pumps.

25. A method comprising:

receiving real-time data for individual pumps in a fleet of pumps during a hydraulic fracturing operation;

estimating a real-time pumping capacity for each of the individual pumps in the fleet of pumps using at least a portion of the real-time data, wherein an estimated real-time pumping capacity for the fleet of pumps computed using the real-time pumping capacity estimate for each of the individual pumps is less than a maximum specified pumping capacity for the fleet of pumps due to operational degradation of at least one of the individual pumps, wherein estimating the real-time pumping capacity for each of the individual pumps comprises utilizing at least one health model that models health of the at least one of the individual pumps and/or at least one pump risk profile model that models risk of failure of the at least one of the individual pumps;

generating, for a target pumping rate for the fleet of pumps during the hydraulic fracturing operation, at least one of engine throttle and transmission gear settings for each of the individual pumps using the estimated real-time pumping capacity for each of the individual pumps; and transmitting the settings via a control interface as one or more control signals that control each of the individual pumps in the fleet of pumps during the hydraulic fracturing operation.

* * * * *